US008320794B2

(12) United States Patent
Kikuchi et al.

(10) Patent No.: US 8,320,794 B2
(45) Date of Patent: Nov. 27, 2012

(54) ELECTROPHOTOGRAPHIC IMAGE FORMING APPARATUS

(75) Inventors: Ken Kikuchi, Mishima (JP); Tsutomu Nishiuwatoko, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 382 days.

(21) Appl. No.: 12/702,490

(22) Filed: Feb. 9, 2010

(65) Prior Publication Data

US 2010/0202797 A1 Aug. 12, 2010

(30) Foreign Application Priority Data

Feb. 9, 2009 (JP) ..... 2009-027690

(51) Int. Cl.
*G03G 21/16* (2006.01)

(52) U.S. Cl. ..... 399/111; 399/113; 399/119

(58) Field of Classification Search ..... 399/110, 399/111, 113, 119
See application file for complete search history.

(56) References Cited

U.S. PATENT DOCUMENTS 7,509,071 B2 3/2009 Yoshimura et al. ..... 399/111
2007/0160384 A1* 7/2007 Sakurai et al. ..... 399/110
* cited by examiner

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

An electrophotographic image forming apparatus for forming an image on a transfer member, includes a main assembly of the electrophotographic image forming apparatus which is provided with a transfer member for transferring a developer image onto the transfer member; a supporting member movable between an inside position which is for supporting an electrophotographic photosensitive member on which the developer image is to be formed and which is inside the main assembly, and an outside position which is outside the main assembly; and a contacting and spacing member movable between a first position for spacing the electrophotographic photosensitive member from the transfer member in the state that the supporting member is in the inside position, and a second position for contacting the electrophotographic photosensitive member to the transfer member, the contacting and spacing member being provided in the supporting member.

15 Claims, 41 Drawing Sheets

(a)

(b)

(a)

(b)

ELECTROPHOTOGRAPHIC IMAGE FORMING APPARATUS

FIELD OF THE INVENTION AND RELATED ART

The present invention relates to an electrophotographic image forming apparatus.

Heretofore, in the field of an image forming apparatus which uses an electrophotographic image forming process, the process cartridge which includes a photosensitive drum, a developing roller which acts on the photosensitive drum, and a developing unit which contains a developer (toner) to be used for the image formation as a unit is known. A developing cartridge type using the developing unit which does not include the photosensitive drum is also known. According to these cartridge types, a maintenance operation of a device can be carried out by the user without a service person, in effect. For this reason, these cartridge types are widely used for the electrophotographic image forming apparatus.

It is also known that a drawer for carrying the process cartridge or the developing cartridge is provided, and the exchange of the cartridge is capable by drawing this drawer from the inside of the main assembly to a predetermined position. According to this technique, the user can supply the developer easily, in effect.

In such a type which uses the drawer, it is preferable that a surface of the photosensitive drum in the drawer member does not contact to the surface of a transfer belt and so on, during the mounting operation into the main assembly of a drawer member. Under the circumstances, a method is known in which the drawer member is spaced from the transfer belt during the mounting operation, and after the mounting completion, the drawer member is moved toward the surface of the transfer belt, by which the photosensitive drum and the transfer belt are in contact with each other (U.S. Pat. No. 7,509,071).

In U.S. Pat. No. 7,509,071, first, the drawer member which carries the process cartridge is inserted into the main assembly in a position remote from the transfer belt. Then, a door member connected through linkage with the drawer member is closed and the entirety of the drawer member moves toward the surface of the transfer belt.

However, in such a conventional example, a mechanism for moving the entirety of the drawer member toward the transfer belt surface is required in order to contact the surface of the photosensitive drum to the transfer belt surface. For this reason, the structures of the whole device are complicated. In addition, a space for permitting the movement of the drawer member toward and away from the transfer belt surface is required, and therefore, a downsizing of the main assembly is prevented.

SUMMARY OF THE INVENTION

Accordingly it is a principal object of the present invention to provide an electrophotographic image forming apparatus, wherein the surface of an electrophotographic photosensitive member and the surface of the transfer member can be contacted to each other without a mechanism for moving a supporting member toward a surface of a transfer member, and therefore, a downsizing can be accomplished.

According to an aspect of the present invention, there is provided an electrophotographic image forming apparatus for forming an image on a recording medium, said apparatus comprising a main assembly of said electrophotographic image forming apparatus which is provided with a transfer member for transferring a developer image onto the recording medium; a supporting member movable between an inside position which is for supporting an electrophotographic photosensitive member on which the developer image is to be formed and which is inside the main assembly, and an outside position which is outside the main assembly; and a contacting and spacing member movable between a first position for spacing the electrophotographic photosensitive member from the transfer member in the state that said supporting member is in the inside position, and a second position for contacting the electrophotographic photosensitive member to the transfer member, said contacting and spacing member being provided in the supporting member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Referring to the accompanying drawings, the embodiment of the present invention will be described in detail. The preferred embodiments of the present invention will be described in conjunction with the accompanying drawings.

Embodiment Referring to FIG. 1-FIG. 21, an electrophotographic image forming apparatus (image forming apparatus) according to Embodiment 1 of the present invention will be described.

<General Arrangement of Image Forming Apparatus>

Figure 1:
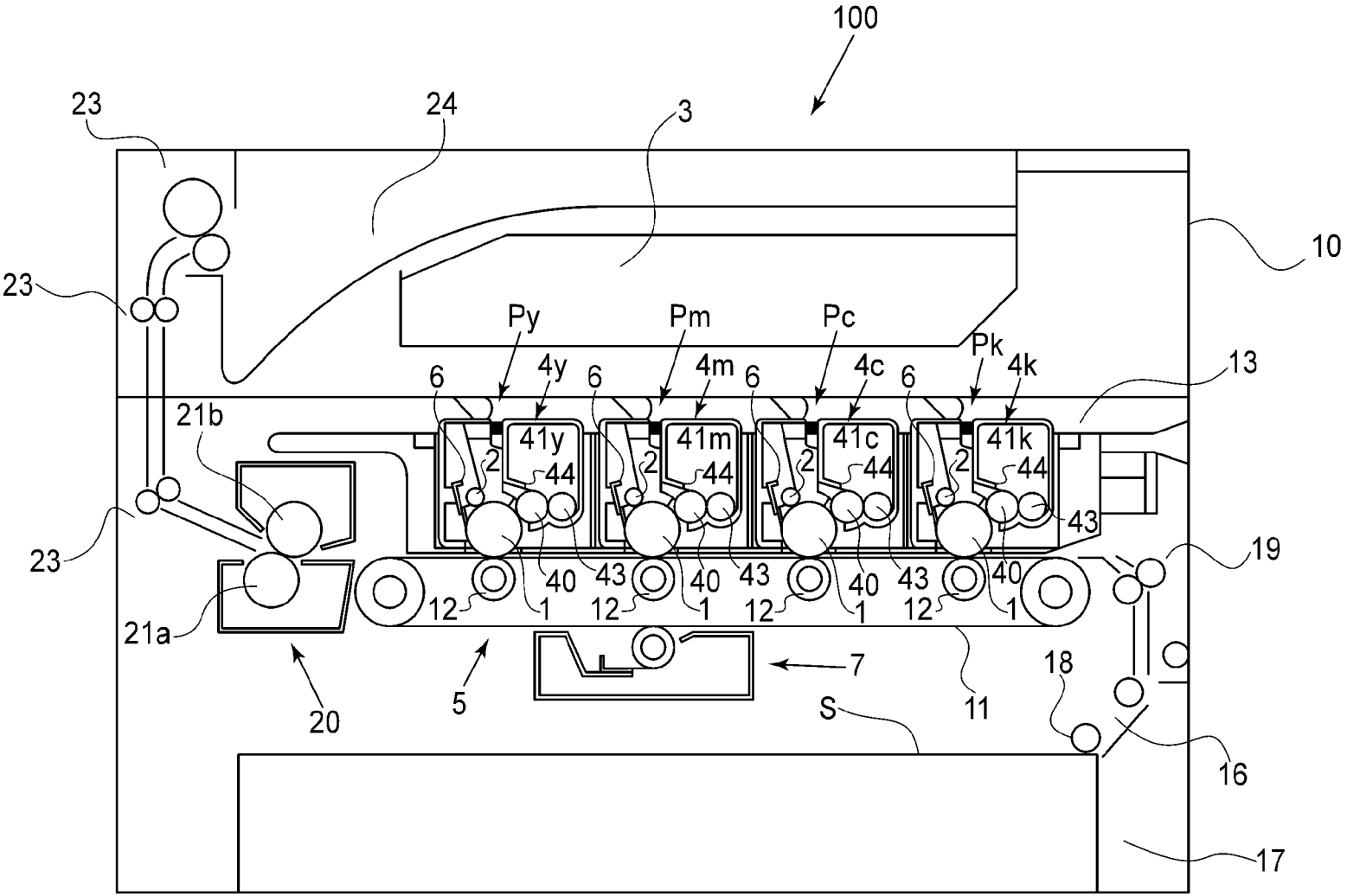
FIG. 1 is a schematic sectional view of a whole image forming apparatus according to Embodiment 1 of the present invention.
Figure 2:
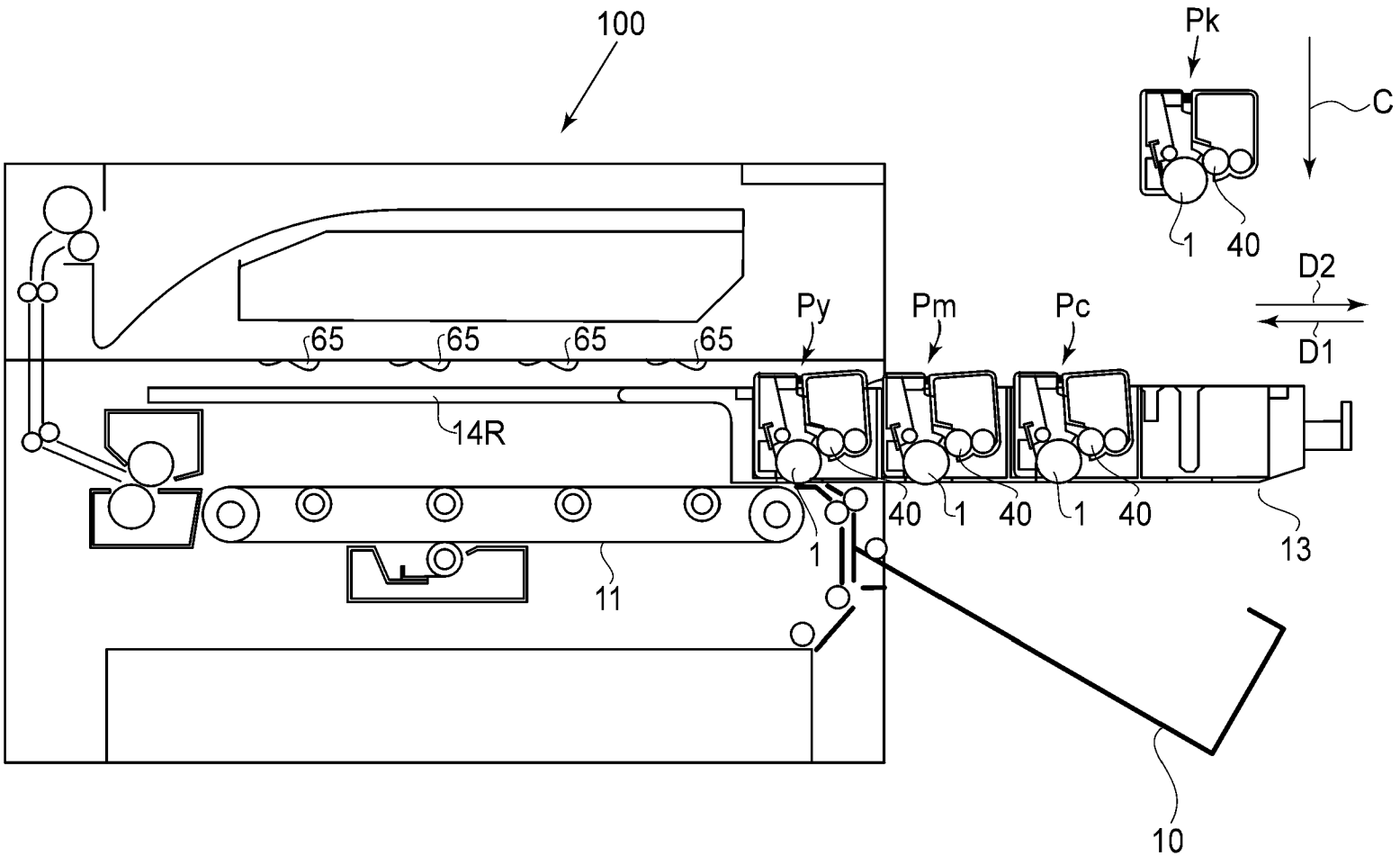
FIG. 2 is a schematic sectional view illustrating the state that a drawer unit in the image forming apparatus according to Embodiment 1 of the present invention is in an outside position.

Referring to FIGS. 1 and 2, the description will be made as to the general arrangement of the image forming apparatus according to Embodiment 1 of the present invention. FIG. 1 is a schematic sectional view of the image forming apparatus according to Embodiment 1 of the present invention. FIG. 2 is a schematic sectional view illustrating the state that the drawer unit in the image forming apparatus according to Embodiment 1 of the present invention is drawn.

In an image forming apparatus 100 according to this embodiment, the four electrophotographic photosensitive drums (photosensitive drums 1) juxtaposed horizontally is employed. The photosensitive drum 1 is rotated in the clockwise direction in FIG. 1 by unshown driving means.

The image forming apparatus 100 includes the charging means 2, a scanner unit 3, development units 4*y*, 4*m*, 4*c*, 4*k*, and the electrostatic transfer means 5 and so on as electrophotographic image forming process means, in addition to the photosensitive drum 1. The developing units 4*y*, 4*m*, 4*c*, 4*k* may be simply called developing unit 4 where doing so is clear, although y represents yellow; m represents magenta; c represents cyan; and k represents black.

Here, the charging means 2 has the function of charging a surface of the photosensitive drum 1 uniformly. The scanner unit 3 projects a laser beam onto the photosensitive drum 1 on the basis of image information to form an electrostatic latent image on the surface of the photosensitive drum 1. The developing unit 4 develops the electrostatic latent image formed on the surface of the photosensitive drum 1 using the toner which is a developer. The electrostatic transfer means 5 transfers a toner image on the photosensitive drum 1 onto a sheet material S as a recording material which is a transfer member. Specific examples of sheet material S include the paper, an OHP sheet, and cloth.

The image forming apparatus 100 includes cleaning means 6 for removing the toner which remains on the surface of the photosensitive drum after the transferring 1. Furthermore, the image forming apparatus 100 further includes cleaning means 7 for removing the residual toner deposited on the transfer belt 11 below an electrostatic transfer belt (transfer belt 11) as a transfer member which constitutes electrostatic transfer means 5.

The photosensitive drum 1 includes an aluminum cylinder and an organic photoconductor layer (OPC photosensitive member) applied on an outer surface thereof, for example. The photosensitive drum 1 is supported by an unshown supporting member rotatably at the opposite ends thereof. One of the ends is provided with an unshown drum coupling for receiving a driving force from a driving motor (unshown). By this, the photosensitive drum 1 receives the driving force of the driving motor through the drum coupling to rotate clockwisely in FIG. 1.

The charging means 2 according to this embodiment is means of a contact charging type. More specifically, the charging means 2 is an electroconductive roller in the form of the roller and contacts to the surface of the photosensitive drum 1. A charging bias voltage is applied to this roller, by which the surface of the photosensitive drum 1 is charged uniformly.

The scanner unit 3 is disposed above the photosensitive drum 1. In the scanner unit 3, the image light (laser beam) corresponding to an image signal is emitted from an unshown laser diode and it is incident on the surface of the charged photosensitive drum 1. By this, the electrostatic latent image corresponding to the image signal is formed on the surface of the photosensitive drum 1.

The developing units 4 include the toner containers 41*y*, 41*m*, 41*c*, 41*k* which accommodates the yellow, the magenta, the cyan, and the black toner, respectively. The toner containers 41*y*, 41 *m*, 41*c*, 41*k* are the developer accommodating portions which accommodate the developer (toner) to be supplied to the developing roller 40. The toner in the toner containers 41*y*, 41*m*, 41*c*, and 41*k* is fed to a toner supplying rollers 43. The toner is applied to the outer periphery of the developing roller 40, and the charge is applied to the toner, by the toner supplying roller 43 and a developing blade 44 press-contacted to an outer periphery of the developing roller 40.

By applying a developing bias to the developing roller 40, the toner is deposited on a latent image formed on the photosensitive drum 1 to form the toner image. The opposition contact of the developing roller 40 is carried out to the photosensitive drum 1. Here, the developing unit 4 and the photosensitive drum 1 form integral process cartridge P (Py, Pm, Pc, and Pk). Suffix y means yellow in the process cartridge Py, m means magenta in the process cartridge Pm, c means cyan in the process cartridge Pc, and k means black in the process cartridge Pk, but they may be called process cartridge P, for simplicity, if appropriate. In the process cartridge P, the toner is consumed with usage, and when the lifetime ends, the process cartridge P can be exchanged (so-called cartridge type).

As shown in FIG. 1, the image forming apparatus 100 includes the transfer belt 11 contacted to the photosensitive drum 1. By the transfer belt 11, the sheet material S is fed to a transfer position, where the toner image formed on the surface of the photosensitive drum 1 is transferred.

The inside of the transfer belt 11 is provided with a transfer roller 12 in a position opposed to the photosensitive drum 1. From the transfer roller 12, positive polarity charge is applied to the sheet material S through the transfer belt 11. By this, the toner image (developer image) on the photosensitive drum 1 is transferred to the sheet material S.

The image forming apparatus 100 includes a feeding portion 16 for feeding the sheet material S to an image forming station. The feeding portion 16 includes a feeding cassette 17 for accommodating a plurality of sheet materials S. At the time of the image formation, a feeding roller 18 and a registration roller couple 19 rotate in accordance with the image forming operation. By this, the sheet material S is fed one by one from the cassette 17. In synchronism with the rotation of the transfer belt 11 and the toner image, the sheet material S is fed by the registration roller pair 19 to the transfer belt 11.

Furthermore, the image forming apparatus 100 includes a fixing portion 20 for fixing a plural color toner image transferred onto the sheet material S. The fixing portion 20 comprises a rotatable heating roller 21*b* and a pressing roller 21*a* press-contacted to it. While the sheet material S onto which the toner image on the photosensitive drum 1 is transferred is nipped between the heating roller 21*b* and the pressing roller 21*a*, it is fed, during which the heat and a pressure are applied to the toner. By this, the plural color toner image is fixed on the surface of the sheet material S.

An image forming process is as follows. When the image forming operation is started, the photosensitive drum 1 is rotated. The charging means 2 applies the charge uniformly to the surface of the photosensitive drum 1, and the scanner unit 3 exposes the surface of the photosensitive drum 1 to the image light in response to the image signal to form an electrostatic latent image on the surface of the photosensitive drum 1. The developing roller 40 develops the electrostatic latent image (With the toner).

On the other hand, to the sheet material S fed by the transfer belt 11 from the feeding portion 16, the toner images formed on the surfaces of the photosensitive drums 1 is are sequentially transferred by the electric fields formed between the photosensitive drums 1 and the transfer rollers 12. The sheet material S onto which the four color toner images are transferred is fed to the fixing portion 20. A color image is fixed with the fixing portion 20, and the sheet material S is discharged from a discharging portion 24 to a position outside of the device by discharging roller pairs 23.

<Drawer Member (Supporting Member)>

A drawer member 13 will be described. It is a supporting member, and is movable between an inside position supporting the photosensitive drum 1 and an outside position of the outside of the main assembly.

Here, in this embodiment, the main assembly is the portion other than at least drawer member 13 and the members (parts) which are detachably mountable thereto or fixed thereto, among the various members (parts) which constitute the image forming apparatus 100.

As shown in FIG. 2, the drawer member 13 is movable linearly in the substantially horizontal direction (arrows D1 and D2 directions) relative to the main assembly (insertable and drawable). The drawer member 13 can be moved to the position (FIG. 1) in which it is accommodated in an inside of the main assembly and the position (FIG. 2) in which it is drawn to an outside the main assembly.

In the state that the drawer member 13 is in a drawn-out position, the process cartridges P (Py, Pm, Pc, Pk) is mounted by the user to the drawer member 13 in the substantially vertical direction (the direction of arrow C in FIG. 2). In the process cartridge P mounted in this manner, a longitudinal direction (an axial direction of the developing roller 40) thereof is perpendicular to a movement direction of the drawer member 13. The four process cartridges Py, Pm, Pc, Pk are juxtaposed in the movement direction of the drawer member 13.

In the state that such process cartridges P are mounted to the drawer member 13, they are moved into the main assembly with the drawer member 13. In the state that the drawer member 13 is in the main assembly, when a door 10 is closed, all the process cartridges are mounted to the predetermined positions in the main assembly.

In this manner, according to the image forming apparatus 100 according to this embodiment, four process cartridges Py, Pm, Pc, and Pk can be mounted into the main assembly all together, and four process cartridges Py, Pm, Pc, and Pk can be drawn all together to the outside of the main assembly. Therefore, the operativity in the exchange of each process cartridge P is excellent, as compared with the case in which the process cartridges are mounted into the main assembly individually.

<Mounting Portion of Drawer Member (Supporting Member)>

Figure 3:
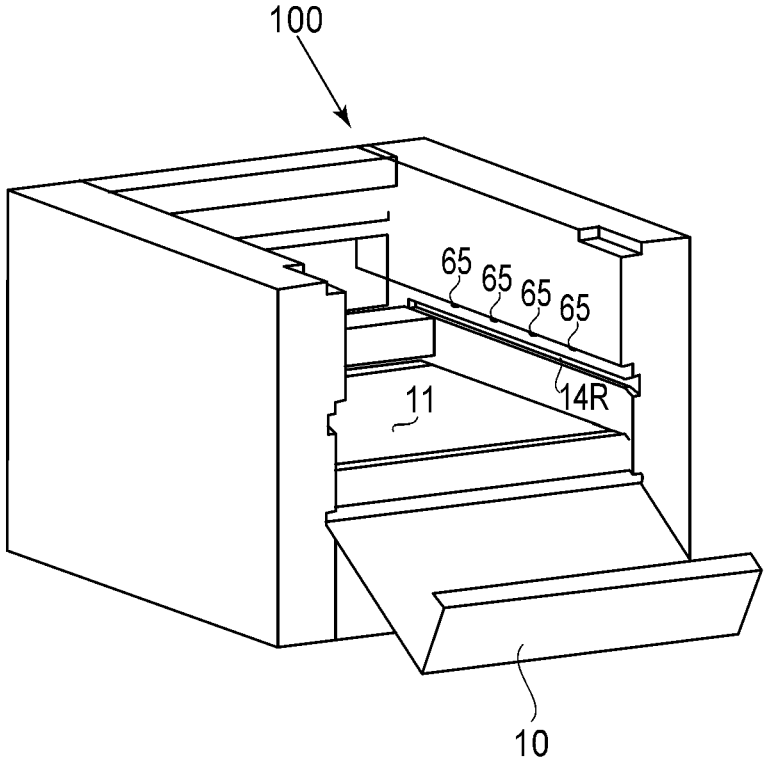
FIG. 3 is a perspective view illustrating a mounting portion for a drawer member in a main assembly of the image forming apparatus according to Embodiment 1 of the present invention.
Figure 4:
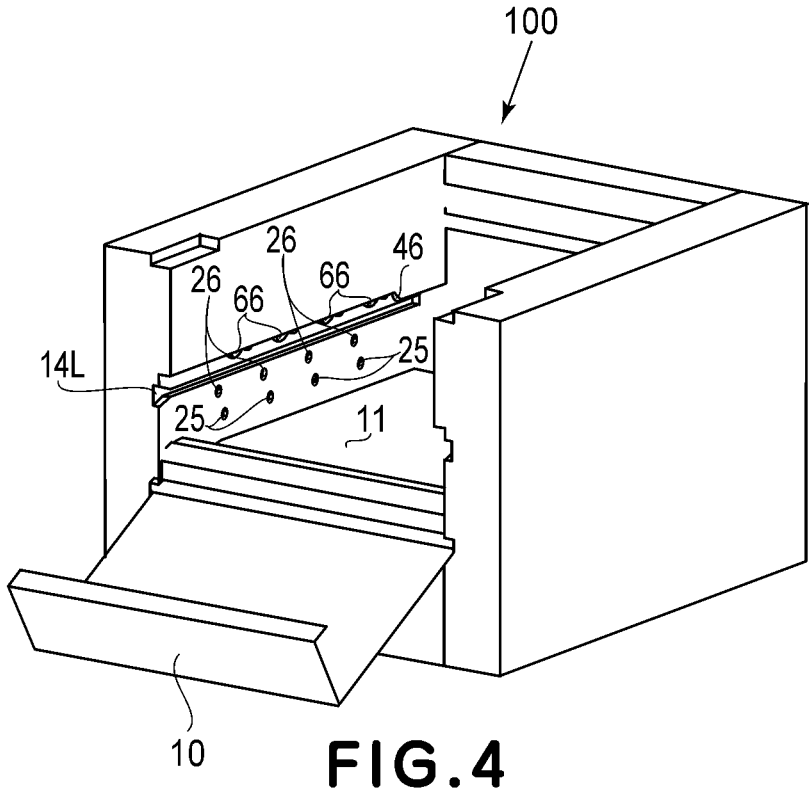
FIG. 4 is a perspective view illustrating the mounting portion for the drawer member in the main assembly of the image forming apparatus according to Embodiment 1 of the present invention.

Referring mainly to FIGS. 3 and 4, the structures of the mounting portion for the drawer member 13 in the main assembly will be described. FIGS. 3 and 4 are a perspective views illustrating the mounting portion for the drawer member in the main assembly of the image forming apparatus according to Embodiment 1 of the present invention. In FIGS. 3 and 4, the scanner unit 3 and so on are omitted among the members (parts) which constitute the main assembly, for better understanding of the structure of the mounting portion. FIG. 3 and FIG. 4 are the perspective views as seen in different directions.

On an inner wall surface of a main assembly frame, the pair of guide portions 14R, 14L which guide the movement direction of the drawer member 13 is provided opposed to each other. The guide portions 14R, 14L have the function of guiding the portions-to-be-guided 13*a*, 13*b*, 13*c*, and 13*d* (FIG. 5 and FIG. 6) of the drawer member 13 as will be described hereinafter, and have a channel-like section. The guide portions 14R, 14L are extended in the substantially horizontal direction from the neighborhood of an entrance of the main assembly (neighborhood of the door 10) to a rear side, so that the drawer member 13 can be guided from the position for drawing to an outside of the main assembly to the position of being accommodated in the inside of the main assembly.

Above the guide portions 14R, 14L, urging members 65, 66 for pressing and positioning the process cartridge P to the predetermined position is provided. These urging members 65, 66 press process cartridge P, by moving downwardly with the driving force from a main assembly side, and, thereby to position the process cartridge P in the predetermined position in the main assembly.

As shown in FIG. 4, below a guide portion 14L, a drum coupling member 25 for transmitting a drive to a photosensitive drum 1 and a development coupling member 26 for transmitting the drive to the developing roller 40 are provided, and they are disposed at equal intervals in the horizontal direction. The drum coupling member 25 and the development coupling member 26 transmit the driving forces from an unshown driving source to the process cartridge P. In the state where the door 10 is opened, the drum coupling member 25 and the development coupling member 26 are in the state of retracting in the inside, and they enter into process cartridge P in interrelation with the closing operation of the door 10.

As shown in FIG. 4, furthermore, the rear side of the guide portion 14L is provided with a driving gear 46 for applying the driving force for moving the contacting and spacing member 42 as will be described hereinafter.

<Drawer Member (Supporting Member)>

Figure 5:
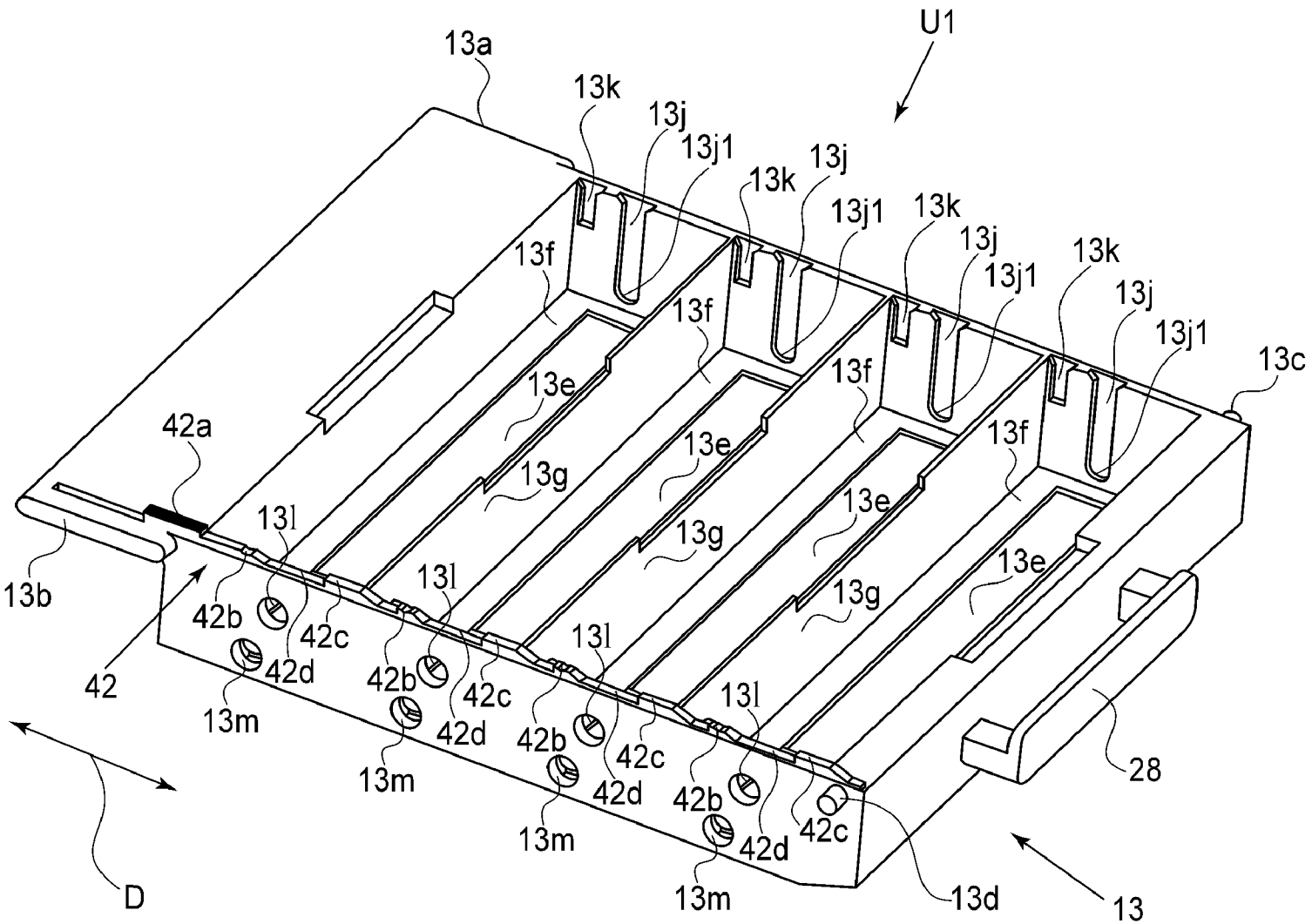
FIG. 5 is a perspective view of the drawer unit in the image forming apparatus according to Embodiment 1 of the present invention.
Figure 6:
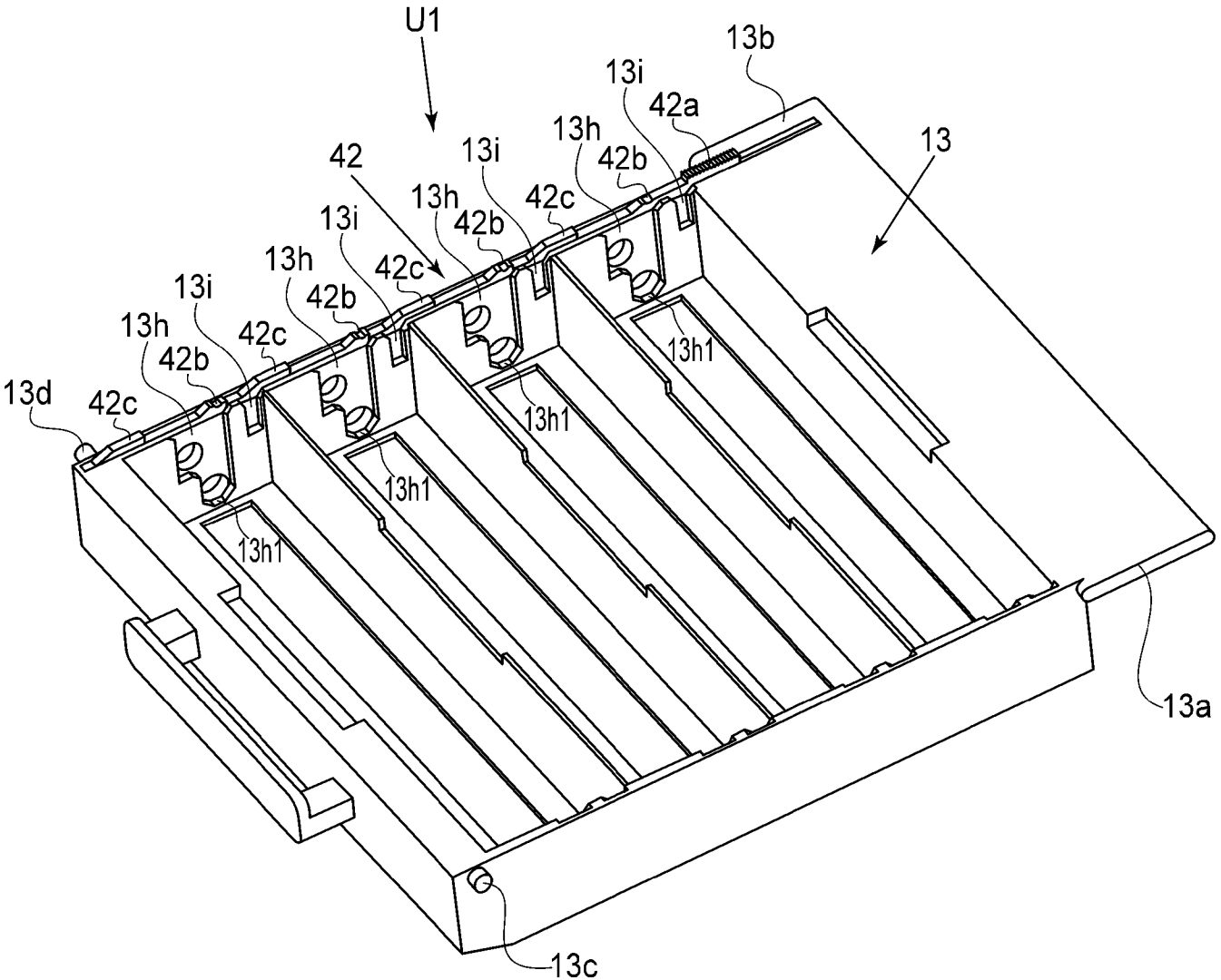
FIG. 6 is a perspective view of the drawer unit in the image forming apparatus according to Embodiment 1 of the present invention.

The drawer member 13 will be described in detail referring mainly to FIGS. 5 and 6. FIGS. 5 and 6 are perspective views of the drawer unit in the image forming apparatus according to Embodiment 1 of the present invention. FIG. 5 and FIG. 6 are the perspective views, as seen from the different directions.

Four corners of the drawer member 13 are provided with the portions-to-be-guided 13*a*, 13*b*, 13*c*, 13*d* for being guided by the guide portions 14R, 14L of the main assembly. The portions-to-be-guided 13*a*, 13*c* are guided by the guide portion 14R, and the portions-to-be-guided 13*b*, 13*d* is guided by the guide portion 14L. The portions-to-be-guided 13*a*, 13*b* project from the outside of a side surface, and are extended in a drawing direction so that the drawer member 13 does not incline in the drawn-out position. The portions-to-be-guided 13*c*, 13*d* have cylindrical shapes and project from the outside of the side surface.

The one end portion of the drawer member 13 is provided with a grip portion 28 for the convenience at the time of the user operating the drawer unit U1.

Furthermore, the drawer member 13 is provided with the mounting portions 13*f* for mounting the process cartridges P, as will be described hereinafter in an array. A partition plate 13*g* is provided between the mounting portions 13*f*, and a rough index at the time of mounting process cartridge P is provided. Lower portions of the mounting portions 13*f* are provided with opening portions 13*e*, respectively. Through these opening portions 13*e*, the photosensitive drum 1 provided in the process cartridge P can be contacted to the transfer belt 11.

The one-end portions and the other end portions of the mounting portion 13*f* are provided with the guide portions 13*h*, 13*i*, 13*j*, 13*k* for mounting the process cartridges P to the inside of the drawer member 13. The lower portions of the guide portions 13*h*, 13*j* are provided with positioning portions 13*hl*, 13*jl* for positioning the process cartridges P relative to the drawer member 13.

As shown in FIG. 5, the drawer member 13 is provided with an opening portion 13*m* for the entrance of the drum coupling member 25 and an opening portion 13*l* for the entrance of the development coupling member 26. The drum coupling member 25 and the development coupling member 26 enter the opening portion 13*m* and the opening portion 13*l* in interrelation with the closing operation of the door 10. The drum coupling member 25 and the development coupling member 26 which entered these opening portions 13*m*, 13*l* engage with the coupling member of the process cartridge P to enable the transmission of the drive to the process cartridge P.

One of the side surfaces of the drawer member 13 is provided with a contacting and spacing member 42. The contacting and spacing member 42 is extended along the movement direction of the drawer member 13, and is movable in the movement direction (direction of arrow D in FIG. 5) of the drawer member 13. A rear end portion of the contacting and spacing member 42 is provided with a rack portion 42*a* as a driving force receiving portion for receiving the driving force for the movement of the contacting and spacing member 42 from the driving gear 46 (FIG. 4).

The contacting and spacing member 42 is provided with a projection-recess configuration (first projection (force applying portion) 42*b*, second projection (force applying portion) 42*c*, and recess 42*d*) along the longitudinal direction thereof. The first projection (force applying portion) 42*b* of the contacting and spacing member 42 has a function of spacing the photosensitive drum 1 from the transfer belt 11. The second projection (force applying portion) 42*c* further projects beyond a first projection 42*b*, and has the function of spacing the developing roller 40 from the photosensitive drum 1. The details thereof will be described hereinafter. The recess 42*d* recessed from the projections is provided between the first projection 42*b* and the second projection 42*c*.

As has been described in the foregoing, the drawer unit U1 comprises the drawer member 13 and the contacting and spacing member 42.

<Process Cartridge>

Figure 7:
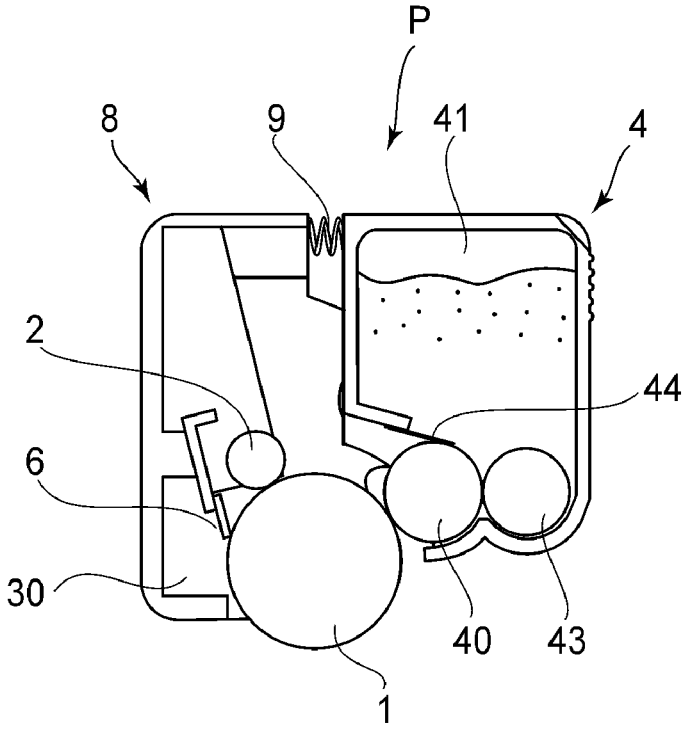
FIG. 7 is a schematic sectional view of a process cartridge according to Embodiment 1 of the present invention.
Figure 8:
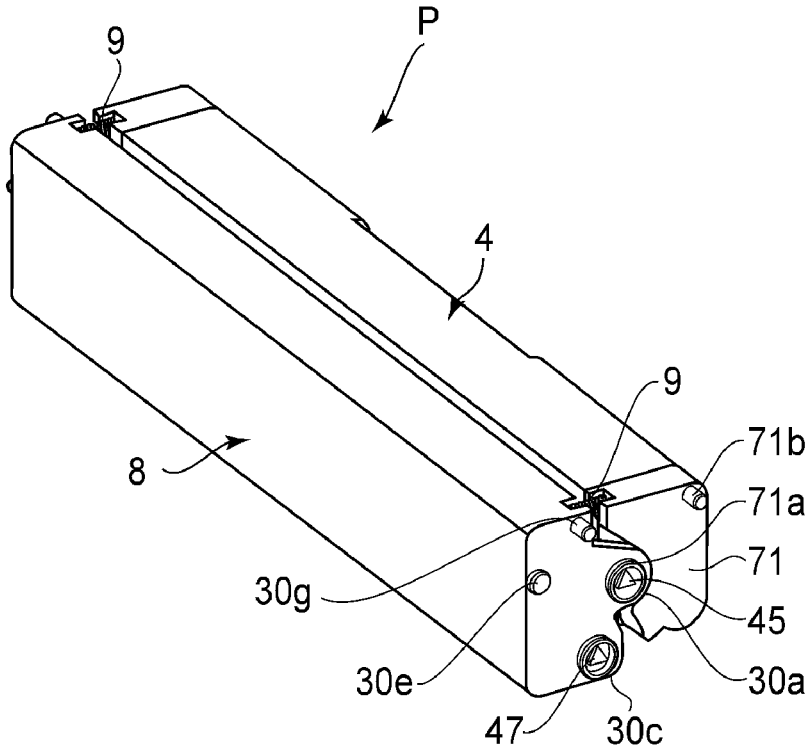
FIG. 8 is a perspective view of the process cartridge according to Embodiment 1 of the present invention.
Figure 9:
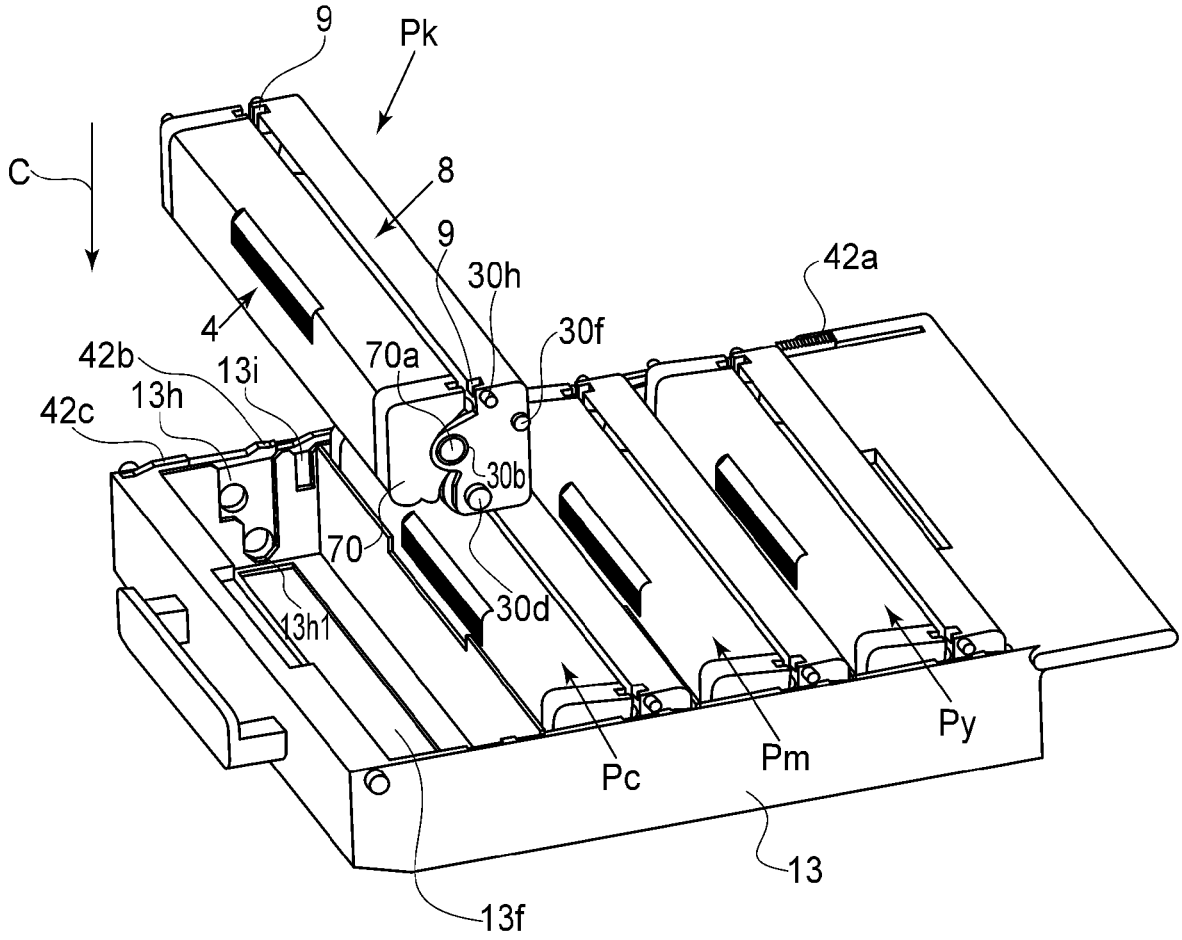
FIG. 9 is a perspective view illustrating a state that the process cartridge according to Embodiment 1 of the present invention is mounted to the drawer unit (drawer member).

Referring to FIG. 7-FIG. 9, the description will be made as to the process cartridge P mounted to the drawer member 13. FIG. 7 is a schematic sectional view of the process cartridge according to Embodiment 1 of the present invention. FIG. 8 is a perspective view of the process cartridge according to Embodiment 1 of the present invention. FIG. 9 is a perspective view illustrating the state that the process cartridge according to Embodiment 1 of the present invention is mounted to the drawer unit (drawer member).

The process cartridge P comprises a photosensitive member unit 8 and developing unit 4. The photosensitive member unit 8 comprises the photosensitive drum 1, charging means 2, cleaning means 6, and a residual toner container 30 for containing the toner removed by the cleaning means 6. The developing unit 4 comprises the developing roller 40, a toner supplying roller 43, a developing blade 44, and the toner container 41 which contains the toner used for the image formation.

As has been described hereinbefore, the toner in the toner container 41 is fed to the toner supplying roller 43. By the toner supplying roller 43 and the developing blade 44 press-contacted to the outer periphery of the developing roller 40, the toner is applied to the outer periphery of the developing roller 40, and the charge is applied to the toner. By applying the developing bias from the main assembly to the developing roller 40, the toner is deposited onto the latent image formed on the photosensitive drum 1 to form the toner image. The toner image developed on the photosensitive drum 1 is transferred onto the sheet material S, and thereafter the toner which remains on the photosensitive drum 1 surface is removed by the cleaning means 6 and is accommodated in the residual toner container 30.

Here, when the toner in the toner container 41 is consumed up, the user exchanges the process cartridge P, by which the user can carry out the printing again.

As shown in FIG. 8, the one-end portion of the process cartridge P supports a coupling member 47 for receiving the driving force from the drum coupling member 25 of the main assembly side rotatably. It also supports a coupling member 45 for receiving the driving force from the development coupling member 26 rotatably.

The coupling member 47 is provided at the end of the photosensitive drum 1, and the photosensitive drum 1 is rotated by the driving force received by the coupling member 47 from the main assembly. The driving force received by the coupling member 45 is transmitted to the developing roller 40 and the toner supplying roller 43 through an unshown intermediate gear to rotate them.

The outer periphery of the coupling member 45 is covered by a cylindrical rib and constitutes an engaging portion 71*a*. The engaging portion 71*a* is provided on a side cover 71 fixed to the outside of the toner container 41. The coupling member 45 is rotatable relative to the engaging portion 71*a*. As shown in FIG. 9, an engaging portion 70*a* is provided on the opposite side from the engaging portion 71*a*. This engaging portion 70*a* is similarly provided on a side cover 70. These engaging portions 71*a*, 70*a* are provided on the developing unit 4.

The residual toner container 30 is provided with hole portions 30*a*, 30*b* supporting the engaging portions 71*a*, 70*a*. The hole portions 30*a*, 30*b* provided in the residual toner container 30 engage with the engaging portions 71*a*, 70*a* provided in the developing unit 4, by which the photosensitive member unit 8 and the developing unit 4 connect with each other.

Here, the engaging portions 71*a*, 70*a* are movable (rotatable) relative to the hole portions 30*a*, 30*b* respectively, and therefore, the developing unit 4 can be moved relative to the photosensitive member unit 8. That is, the developing roller 40 is movable relative to the photosensitive drum 1.

As shown in FIG. 7-FIG. 9, between the photosensitive member unit 8 and the developing unit 4, a spring 9 as an urging member is provided. The spring 9 presses the developing roller 40 with the predetermined pressure to the photosensitive drum 1. When the developing unit 4 moves in the direction of separating the developing roller 40 from the photosensitive drum 1 relative to the photosensitive member unit 8, it moves against an urging force of the spring 9.

As shown in FIG. 8, the outer periphery of the coupling member 47 is covered by the cylindrical rib to form a portion-to-be-guided 30*c*. As shown in FIG. 9, a portion-to-be-guided 30*d* in the form of a cylindrical projection is provided on the opposite side of the portion-to-be-guided 30*c* with respect to the longitudinal direction. As shown in FIG. 8, a portion-to-be-guided 30*e* is provided above the portion-to-be-guided 30*c*, and as shown in FIG. 9, a portion-to-be-guided 30*f* is provided above the portion-to-be-guided 30*d*. The portions-to-be-guided 30*c*, 30*d*, 30*e*, 30*f* have the function of a guide for the mounting, into the drawer member 13, of the process cartridge P, and have a function of positioning the process cartridge P in the drawer member 13. The details thereof will be described hereinafter.

As shown in FIG. 8, an upper portion of one of the lateral sides of the photosensitive member unit, 8 is provided with an outwardly projecting force receiving portion 30*g* with respect to an axial direction of the photosensitive drum 1. The force receiving portion 30*g* receives the force from the contacting and spacing member 42 provided in the drawer member 13 to space the photosensitive drum 1 from the transfer belt 11. The details thereof will be described hereinafter. As shown in FIG. 9, furthermore, an upper portion of the other side surface of the photosensitive member unit 8 is provided with a force receiving portion 30*h*. The force receiving portions 30*g*, 30*h* receive a force from the urging members 65, 66 as will be described hereinafter to position the process cartridge P in the drawer member 13.

As shown in FIG. 8, an outwardly projecting force receiving portion, 71*b* with respect to the axial direction of the developing roller 40 is provided above the side cover 71 of the developing unit 4. The force receiving portion 71*b* receives the force from the contacting and spacing member 42 to space the developing roller 40 from the photosensitive drum 1. The details thereof will be described hereinafter.

<Mounting of Process Cartridge to Drawer Member>

Figure 10:
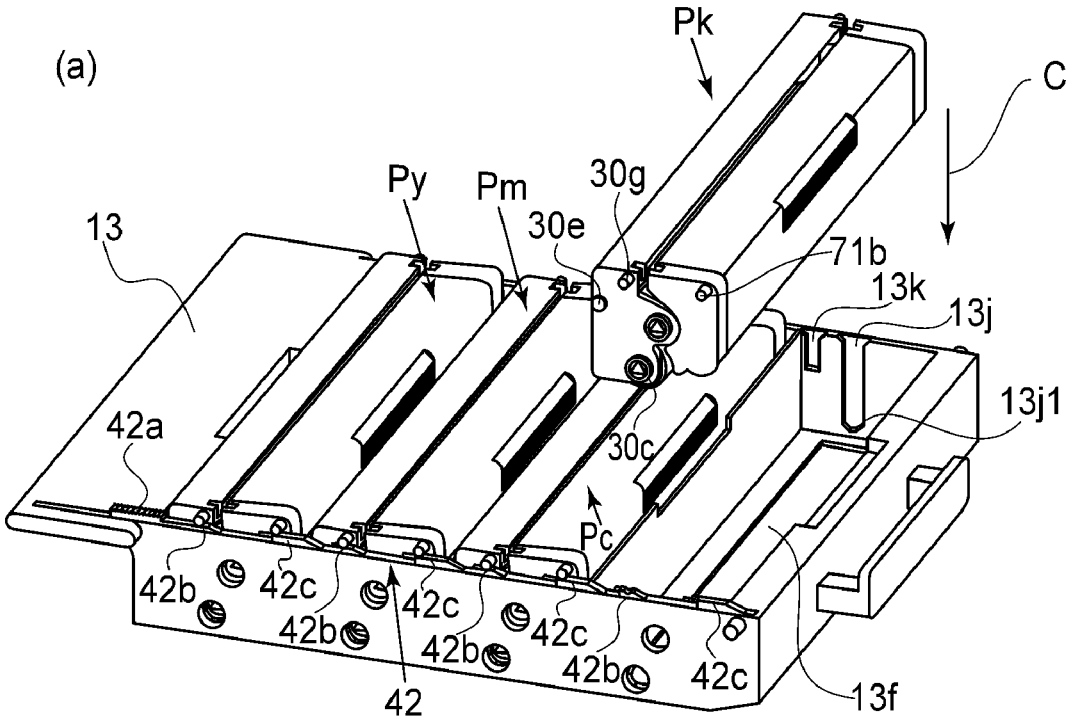
FIG. 10 is a perspective view illustrating the state that the process cartridge according to Embodiment 1 of the present invention is mounted to the drawer member.
Figure 10:
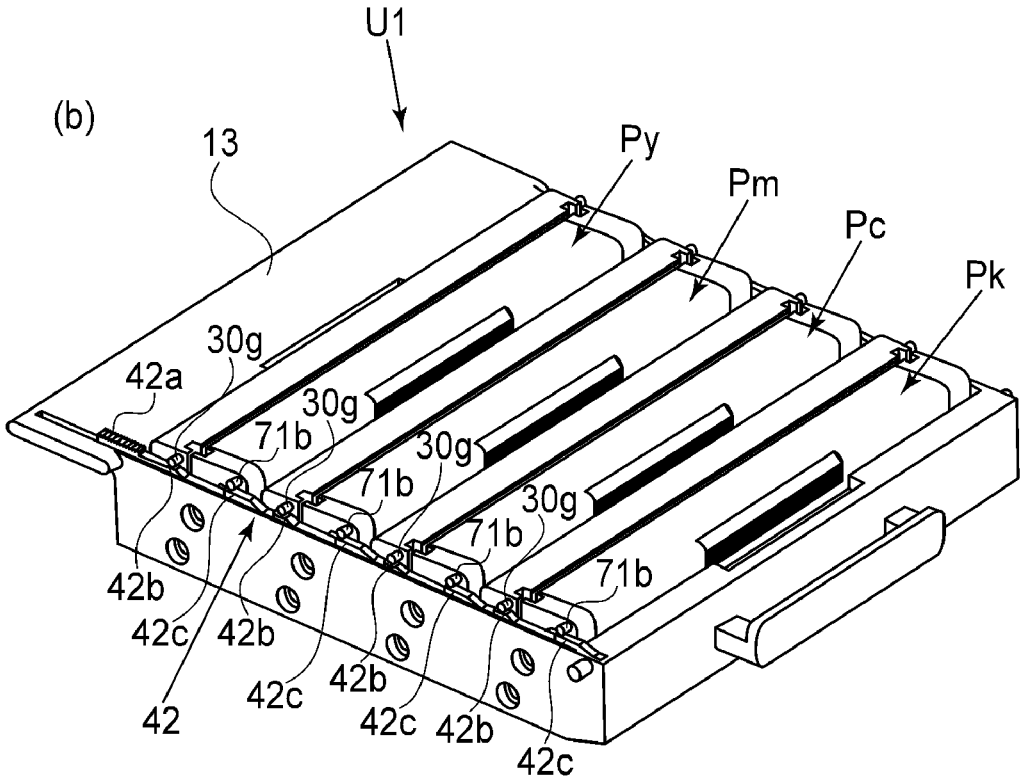
Figure 11:
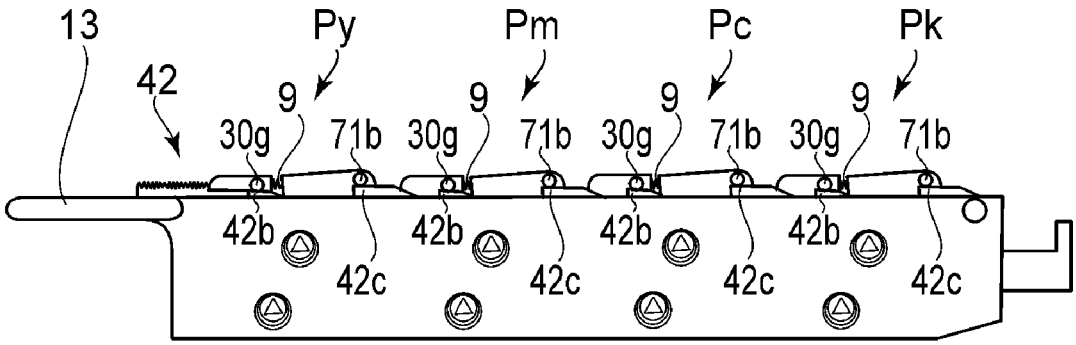
FIG. 11 is a schematic view showing the state that the process cartridge is mounted to the drawer member.
Figure 11:
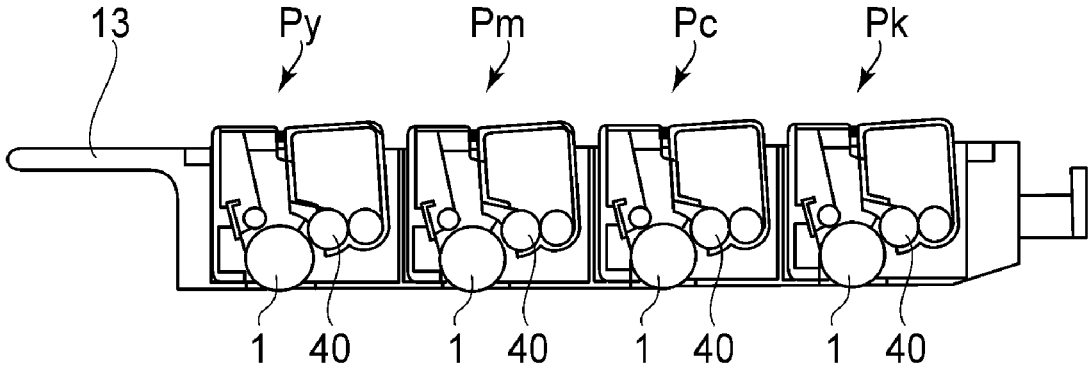

Referring to FIG. 9-FIG. 11, the description will be made as to the mounting of process cartridges P (Py, Pm, Pc, Pk) to the drawer member 13. FIGS. 9 and 10 are perspective views illustrating the state that the process cartridge according to Embodiment 1 of the present invention is mounted to the drawer member. FIG. 9 and FIG. 10 (*a*) show the mounting process of the process cartridge Pk and are views, as seen from different directions. In these views, the main assembly is omitted, for the sake of simplicity. In FIG. 10 (*b*), all the process cartridges Py, Pm, Pc, and Pk are mounted. FIG. 11 is a schematic view showing the state that the process cartridge is mounted to the drawer member. FIG. 11 (*a*) is a side view, and FIG. 11 (*b*) is a schematic longitudinal sectional view.

The process cartridges Py, Pm, Pc, and Pk are mounted into the four mounting portions 13*f* (FIG. 5) provided in the drawer member 13, respectively. The user mounts the process cartridge P in a direction of the arrow C which is substantially the direction of gravity.

In mounting the process cartridge P, first, the user moves it, so that the portions-to-be-guided 30*c*, 30*d* provided at the opposite ends of the process cartridge P are guided by the guide portions 13*h*, 13*j* of the drawer member 13. Then, the user moves it, so that the portions-to-be-guided 30*e*, 30*f* are guided by the guides 13*i*, 13*k*. By this, the process cartridge P is mounted to the inside of the drawer member 13, while being guided by the guide portions 13*h*, 13*i*, 13*j* and 13*k*.

In the process in which the process cartridge P is mounted to the drawer member 13, the force receiving portion 30*g* provided on the photosensitive member unit 8 abuts to the first projection (force applying portion) 42*b* provided on the contacting and spacing member 42. The force receiving portion 71*b* provided on the side cover 71 of the developing unit 4 abuts to the second projection (force applying portion) 42*c*.

The force receiving portion 30*g* provided on the photosensitive member unit 8 abuts to the first projection 42*b*, by which the process cartridge P is held in a position higher than the image forming position. As shown in FIG. 2, that is, the surface of the photosensitive drum 1 is held in the (spacing) position higher than the surface (recording material conveying surface) of the transfer belt 11.

Here, the contacting and spacing member 42 is provided only at one-end portion of the drawer member 13. The force receiving portion 30*g* for receiving the force from the first projection 42*b* of the contacting and spacing member 42 is also provided only at the one side of the photosensitive member unit 8. However, the portion-to-be-guided 30*d* provided at the other end portion of the process cartridge P is provided in the outside of the widthwise end of the transfer belt 11, and therefore, the surface of the photosensitive drum 1 can be separated from the surface of the transfer belt 11. That is, as for the process cartridge P, the force receiving portion 30*g* receives the force from first projection 42*b* in the one-end portion to rise. On the other hand, the state that the portion-to-be-guided 30*d* is in contact to a positioning portion 13*j*1 of the drawer member 13 is maintained in the other end portion. For this reason, the process cartridge P is oblique relative to the transfer belt 11. However, as has been described hereinbefore, the portion-to-be-guided 30*d* is provided to the outside of the widthwise end of the transfer belt 11, and therefore, the surface of the photosensitive drum 1 is spaced from the surface of the transfer belt 11.

By the force receiving portion 71*b* provided on the developing unit 4 contacting to the second projection 42*c* provided on the contacting and spacing member 42, the surface of the developing roller 40 is spaced from the surface of the photosensitive drum 1. Referring mainly to FIG. 11, the description will be made.

The second projection 42*c* provided on the contacting and spacing member 42 is higher than the first projection 42*b*. On the other hand, the force receiving portion 30*g* provided on the photosensitive member unit 8 and the force receiving portion 71*b* provided on the developing unit are substantially at the same level in the state of not receiving an external force. Therefore, the force receiving portion 71*b* abutted to the second projection 42*c* receives the weight of the developing unit 4 to space the surface of the developing roller 40 from the surface of the photosensitive drum 1 against the force of the urging member 9. That is, by the force receiving portion 71*b* receiving the force, the engaging portions 71*a*, 70*a* provided on the developing unit 4 rotates about the hole portions 30*a*, 30*b* provided in the photosensitive member unit 8, respectively.

At this time, the contacting and spacing member 42 is in such a position that the first projection 42*b* contacts to the force receiving portion 30*g*, and the second projection 42*c* contacts to the force receiving portion 71*b*. At this time, the surface of the photosensitive drum 1 can be placed in the position spaced from the surface of the transfer belt 11. The surface of the developing roller 40 can be placed in the position spaced from the surface of the photosensitive drum 1. This position is a first position, wherein the contacting and spacing member 42 can isolate the photosensitive drum 1 from the transfer belt 11, and can space the developing roller 40 from the photosensitive drum 1.

In the case where the drawer member 13 is in the state of being drawn from the main assembly, that is, in the case where the drawer member 13 is positioned in the outside of the main assembly (outside position), the contacting and spacing member 42 is placed in the first position. As shown in FIG. 11, for this reason, when the process cartridge P is mounted to the drawer member 13, the surface of the developing roller 40 is spaced from the surface of the photosensitive drum 1 together with the mounting operation. Therefore, in mounting the process cartridge P to the drawer member 13 it can be avoided that the surface of the photosensitive drum 1 and the surface of the developing roller 40 are rubbed with each other by the impact at the time of the mounting, and these surfaces are damaged.

As has been described in the foregoing, in mounting the process cartridge P to the drawer member 13, the state that the surface of the developing roller 40 is spaced from the surface of the photosensitive drum 1 is maintained. In addition, the state that the surface of the photosensitive drum 1 is spaced from the surface of the transfer belt 11 is maintained. That is, the process cartridge P is mounted to the drawer member 13 in the state that the contacting and spacing member 42 is in the first position.

<Mounting of Drawer Unit into Main Assembly>

Figure 12:
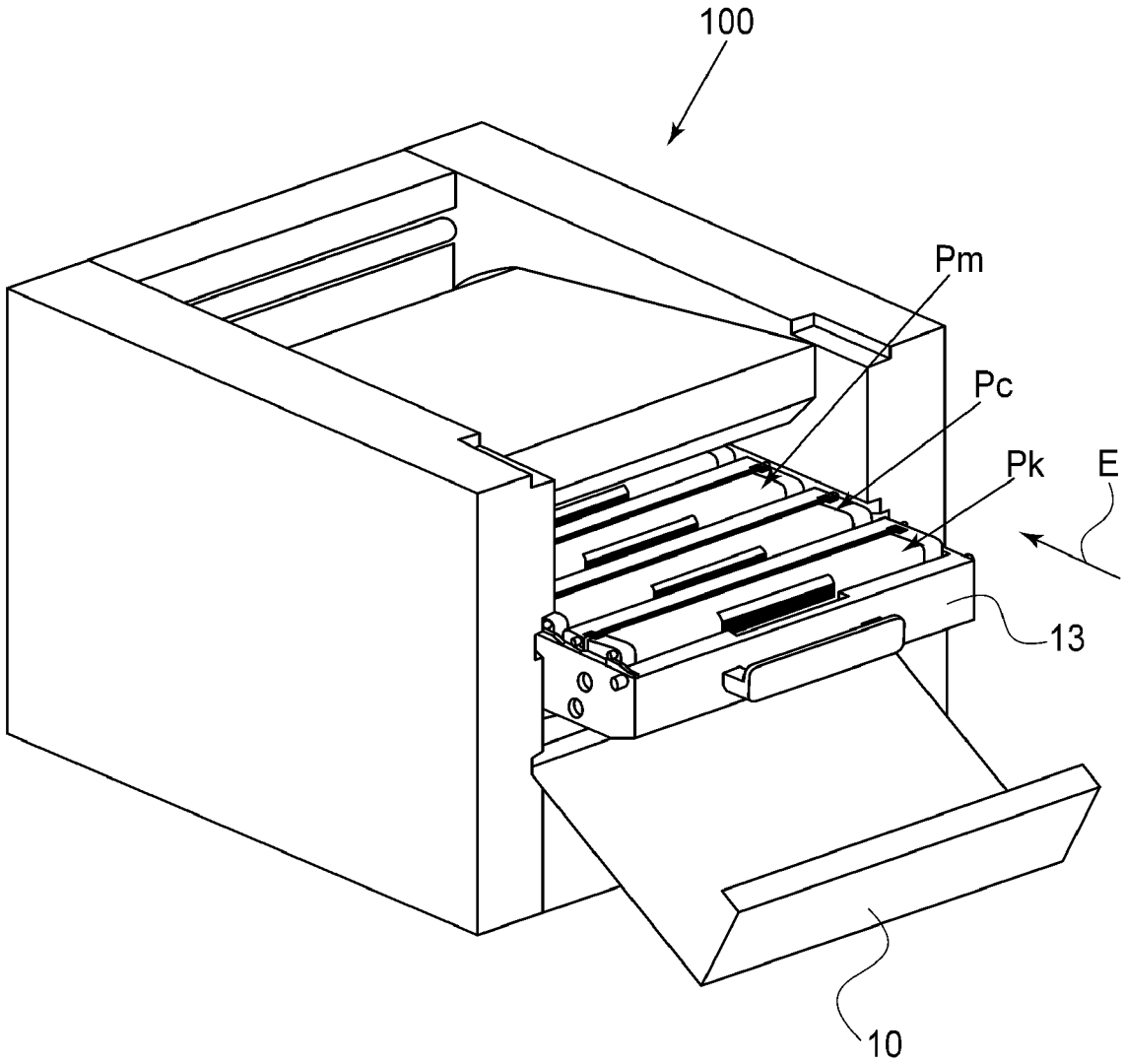
FIG. 12 is a perspective view illustrating the state that the drawer unit according to Embodiment 1 of the present invention is mounted into the main assembly.
Figure 13:
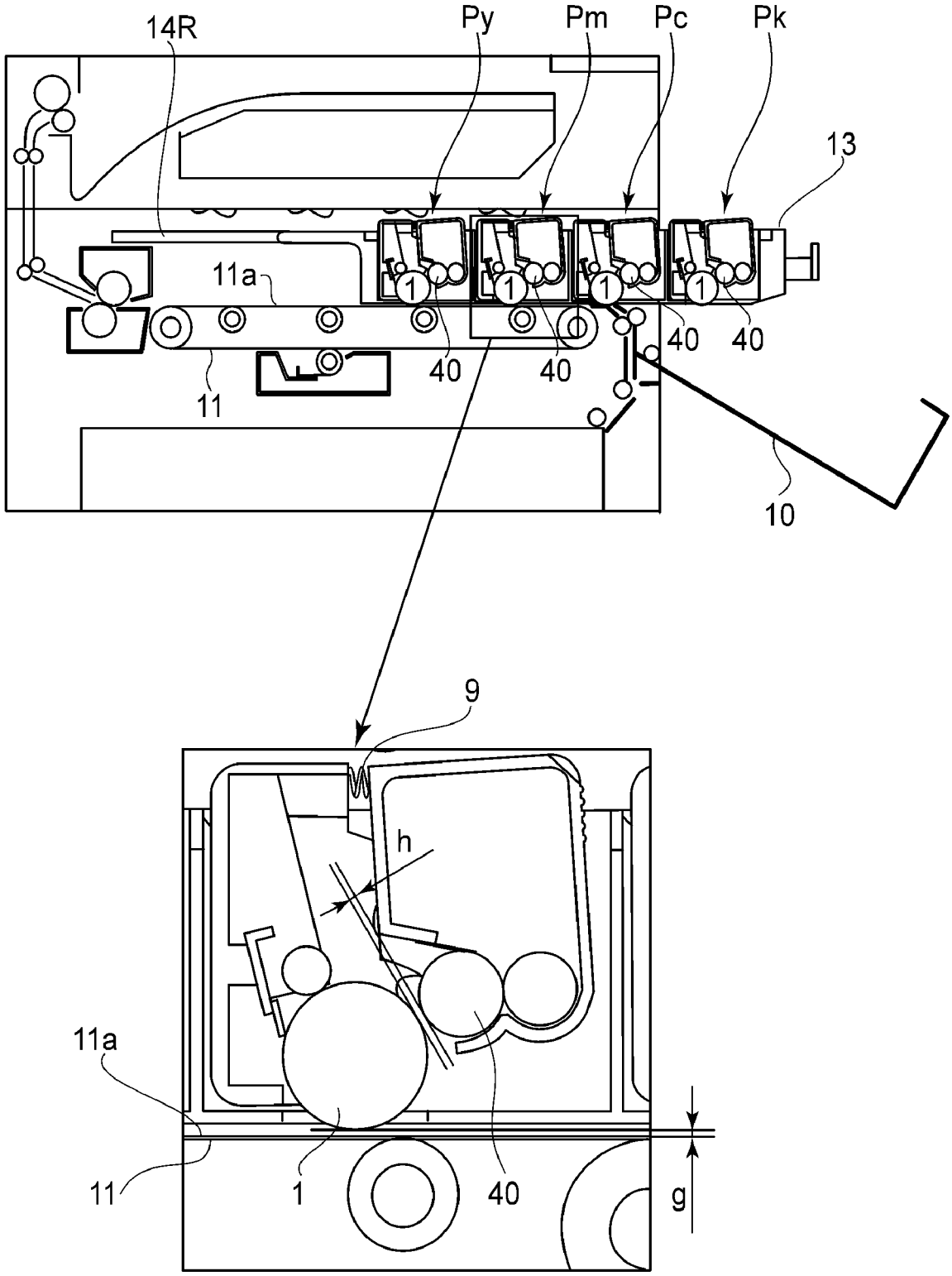
FIG. 13 is a schematic sectional view illustrating the state that the drawer unit according to Embodiment 1 of the present invention is mounted in the main assembly.
Figure 14:
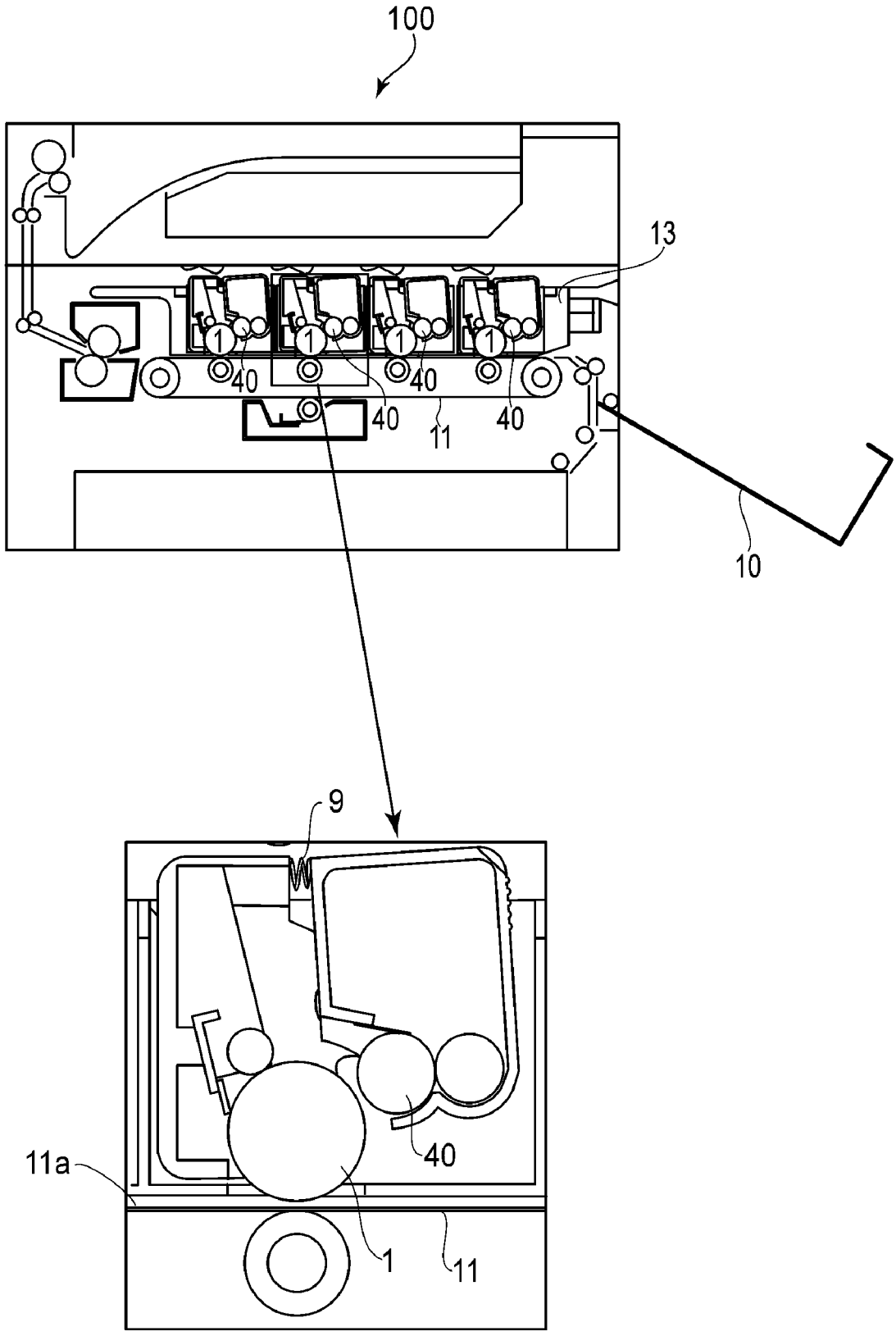
FIG. 14 is a schematic sectional view illustrating the state that the drawer unit according to Embodiment 1 of the present invention is mounted in the main assembly, and a door is open.
Figure 15:
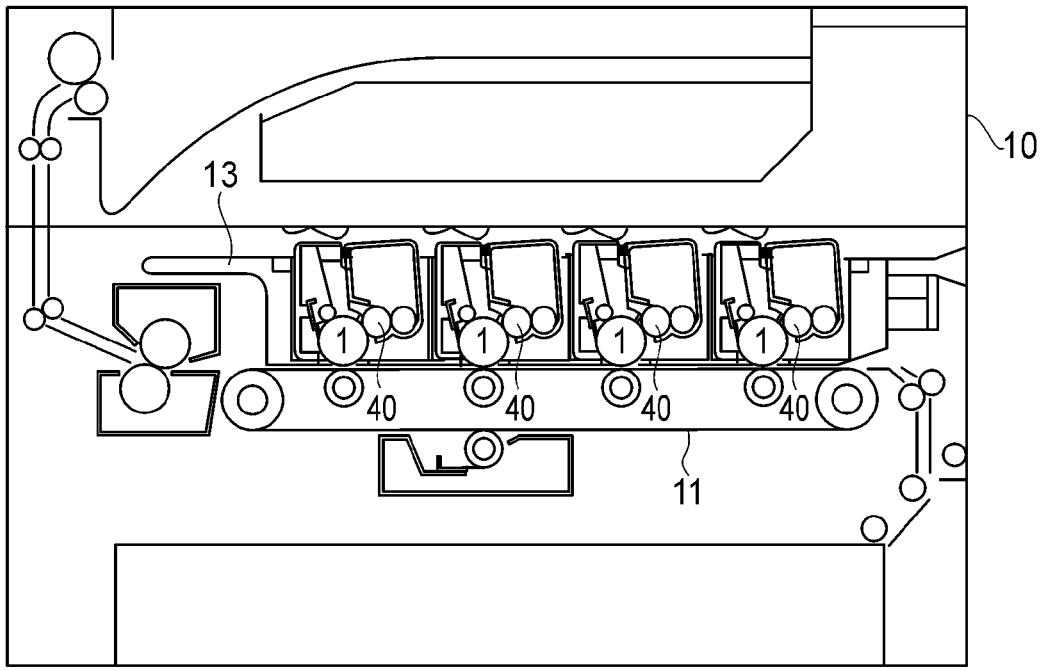
FIG. 15 is a schematic sectional view illustrating the state that the drawer unit according to Embodiment 1 of the present invention is mounted in the main assembly, and the door closes.

Referring to FIG. 12-FIG. 15 the description will be made as to the mounting operation of the drawer unit U1 into the main assembly. FIG. 12 is a perspective view illustrating the state that the drawer unit according to Embodiment 1 of the present invention is mounted to the inside of the main assembly. FIG. 13 is a schematic sectional view illustrating the state that the drawer unit according to Embodiment 1 of the present invention is mounted to the inside of the main assembly. FIG. 14 is a schematic sectional view illustrating the state that the drawer unit according to Embodiment 1 of the present invention is mounted to the inside of the main assembly, and the door is open. FIGS. 13 and 14 include the enlarged cross-sectional views of the schematic sectional views of the whole device and the neighborhood of the one photosensitive drum. FIG. 15 is a schematic sectional view illustrating the state that the drawer unit according to Embodiment 1 of the present invention is mounted to the inside of the main assembly, and the door closes. FIG. 15, the state that the image forming operation is not carried out is shown.

As shown in FIG. 12, the drawer unit U1 is mounted in a direction of arrow E while the portions-to-be-guided 13*a*, 13*b*, 13*c*, and 13*d* (FIGS. 5, 6) of the drawer member 13 is guided by the guide portions 14R and 14L of the main assembly (FIGS. 3, 4).

During the mounting operation of the drawer unit U1 (drawer member 13), the state that the surface of the photosensitive drum 1 and a recording material conveying surface 11*a* of the transfer belt 11 are spaced from each other are maintained. That is, a gap g is provided between the surface of the photosensitive drum 1 and the recording material conveying surface 11*a* of the transfer belt 11. Therefore, the drawer unit U1 can be mounted to the inside of the main assembly without the rubbing between the surface of the photosensitive drum 1 and the surface of the transfer belt 11. During the mounting operation, the drawer unit U1 is moved in substantially parallel with the recording material conveying surface 11*a* of the transfer belt 11. During the mounting operation of the drawer unit U1, the contacting and spacing member 42 is placed in the "first position".

As has been described hereinbefore, during the mounting operation of the drawer unit U1, the separation member 42 is placed in the first position, the state of spacing the surface of the photosensitive drum 1 and the developing roller 40 from each other is maintained. That is, a gap g is provided between them. Therefore, in mounting the drawer unit U1 which carries the process cartridge P to the inside of the main assembly, the damage due to the contact between the surface of the photosensitive drum 1 and the surface of the developing roller 40 by the impact at the time of the mounting or the like is suppressed.

When the drawer unit U1 is mounted to the inside of the main assembly, the rack portion 42*a* (FIG. 10) provided on the contacting and spacing member 42 and the driving gear 46 of the main assembly (FIG. 4) engage with each other. By this, the driving force is transmittable to the rack portion 42*a* from the driving gear 46.

As shown in FIG. 14, in the state that the drawer unit U1 is in the main assembly, and the door 10 is open, the surface of the photosensitive drum 1 and the recording material conveying surface 11*a* of the transfer belt 11 are still spaced from each other. The surfaces of the photosensitive drum 1 and the developing roller 40 are spaced from each other similarly.

In the state of FIG. 15, the door is closed. By the closing operation of the door 10, the drum coupling member 25 and the development coupling member 26 (FIG. 4) enter the opening portion 13*m* and 13*l* of the opening portion (FIG. 5) provided in the drawer member 13, respectively. However, the process cartridge P is not placed in a regular position (the operative position for the image formation) as yet. Therefore, the drum coupling member 25 and the development coupling member 26 are not in engagement with the coupling members 47 and 45 (FIG. 8).

Also in the state where the door 10 is closed, when the image forming operation is not carried out, the spaced state is maintained between the surface of the photosensitive drum 1 and the recording material conveying surface 11*a* of the transfer belt 11, and between the surface of the photosensitive drum 1 and the surface of the developing roller 40. That is, the contacting and spacing member 42 is placed in the first position.

In such a state, apparatus is maintained until the instruction of the image forming operation is produced from the main assembly.

<Operations at the Time of Image Forming Operation>

Figure 16:
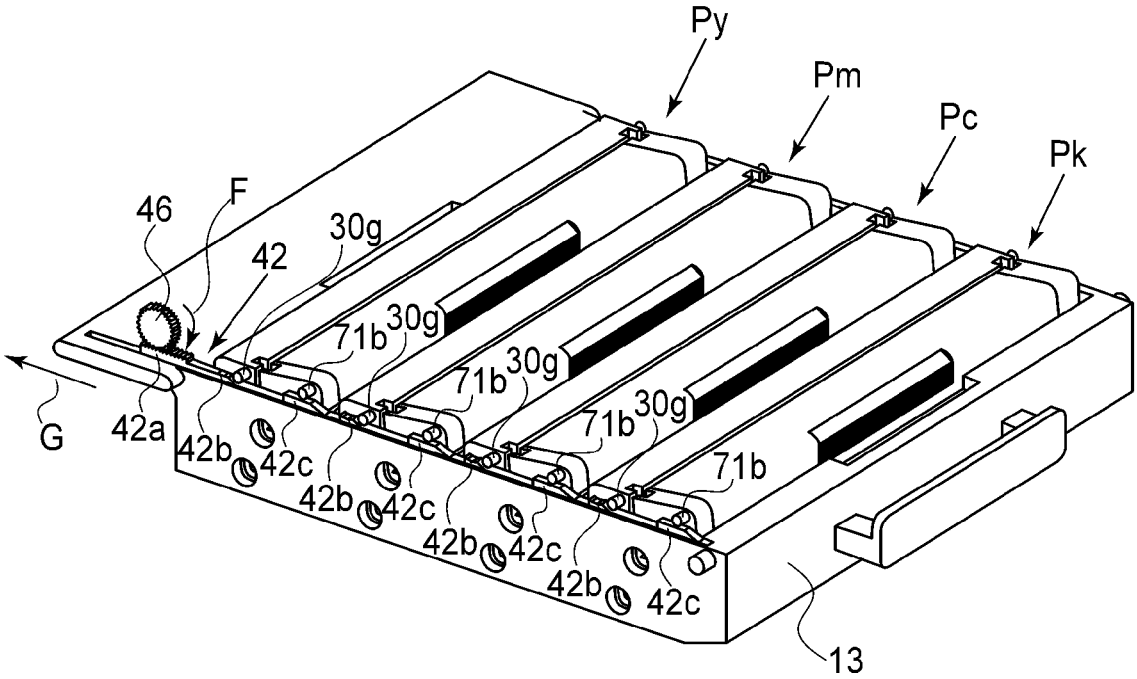
FIG. 16 is a perspective view illustrating the state immediately after the image formation instruction in the drawer unit according to Embodiment 1 of the present invention.
Figure 17:
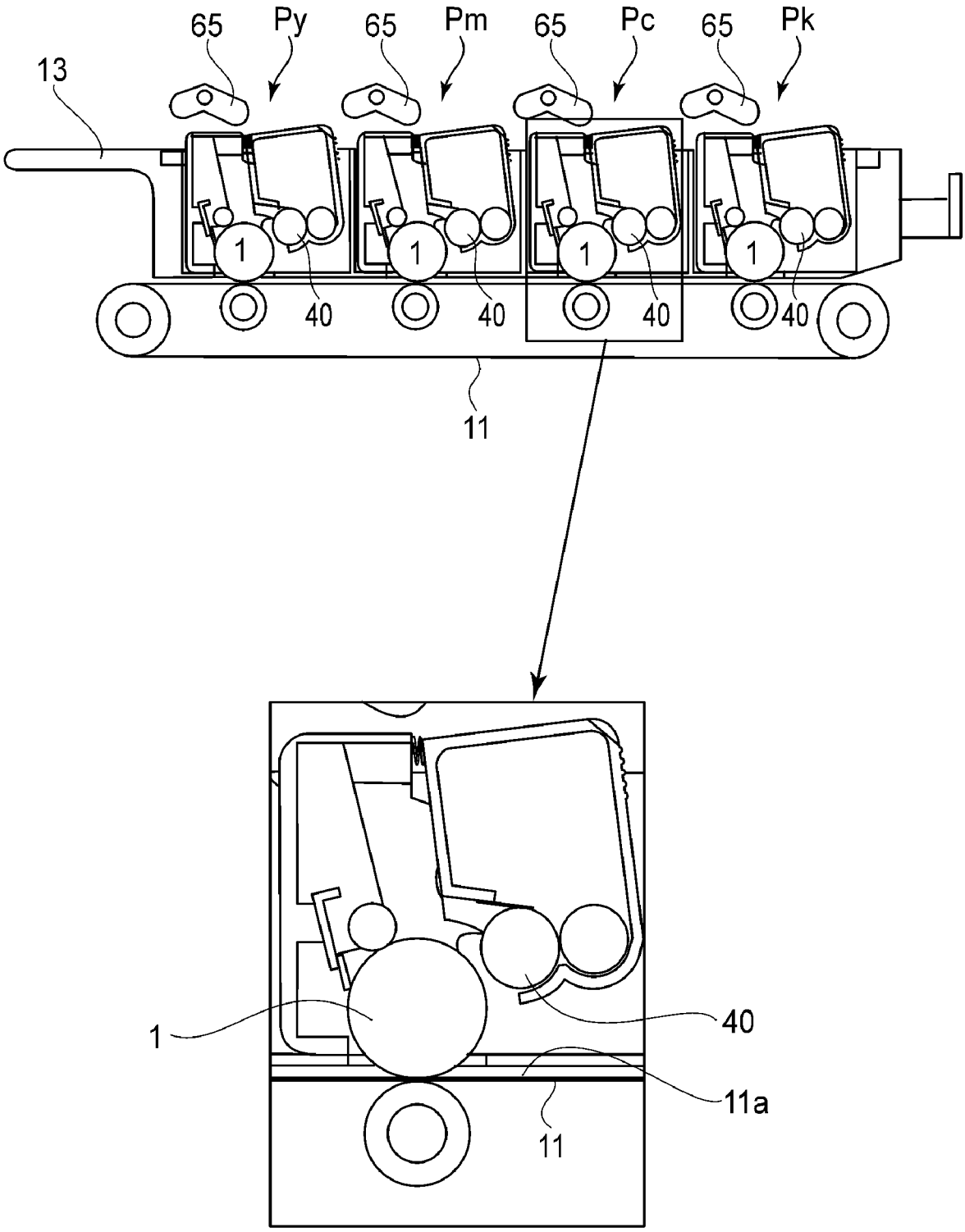
FIG. 17 is a schematic sectional view illustrating the state in the course of the drawer unit according to Embodiment 1 of the present invention being mounted in the main assembly and shifting to an image forming operation.
Figure 18:
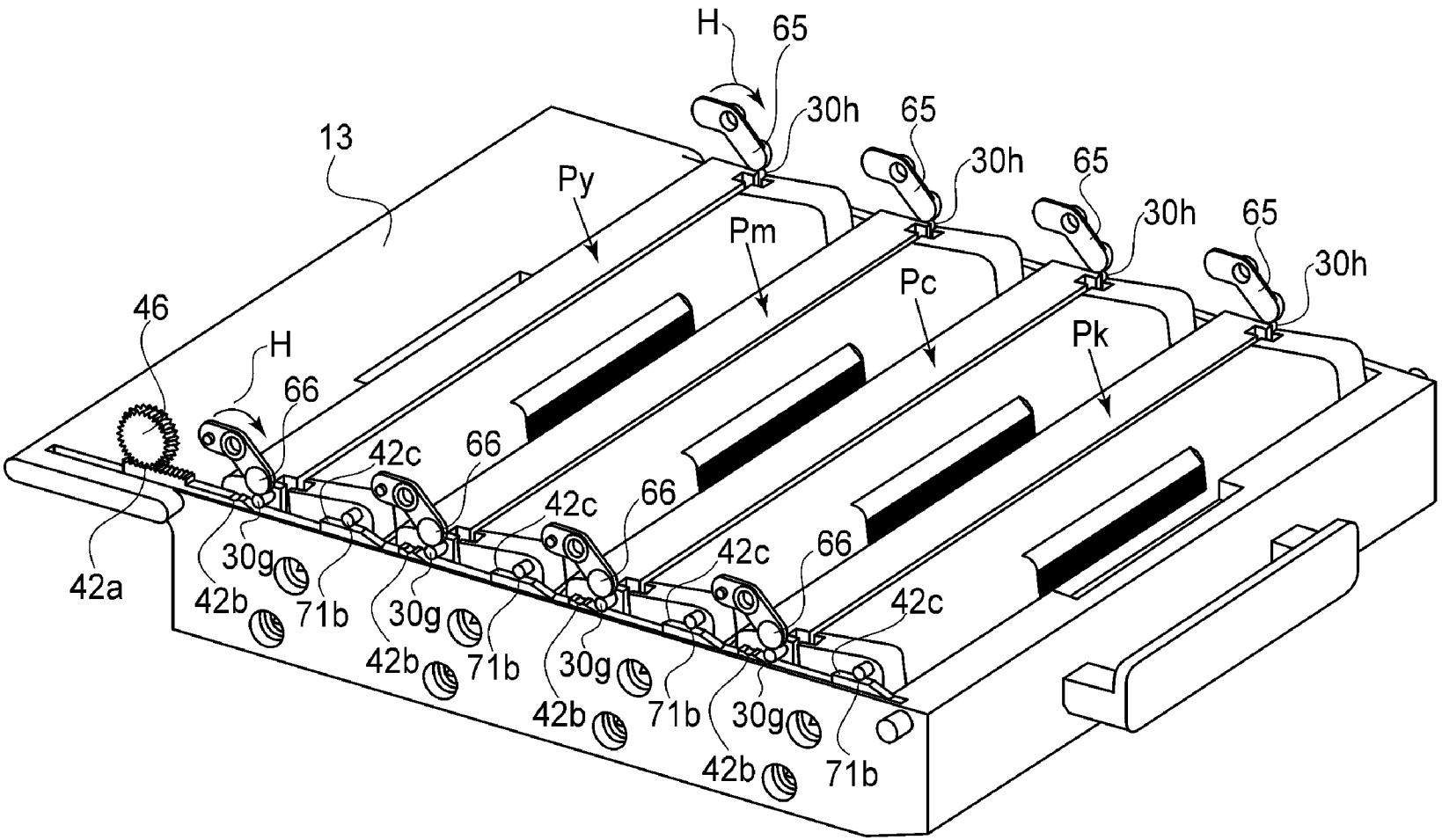
FIG. 18 is a perspective view illustrating the state in the partway of shifting to the image forming operation in the drawer unit according to Embodiment 1 of the present invention.
Figure 19:
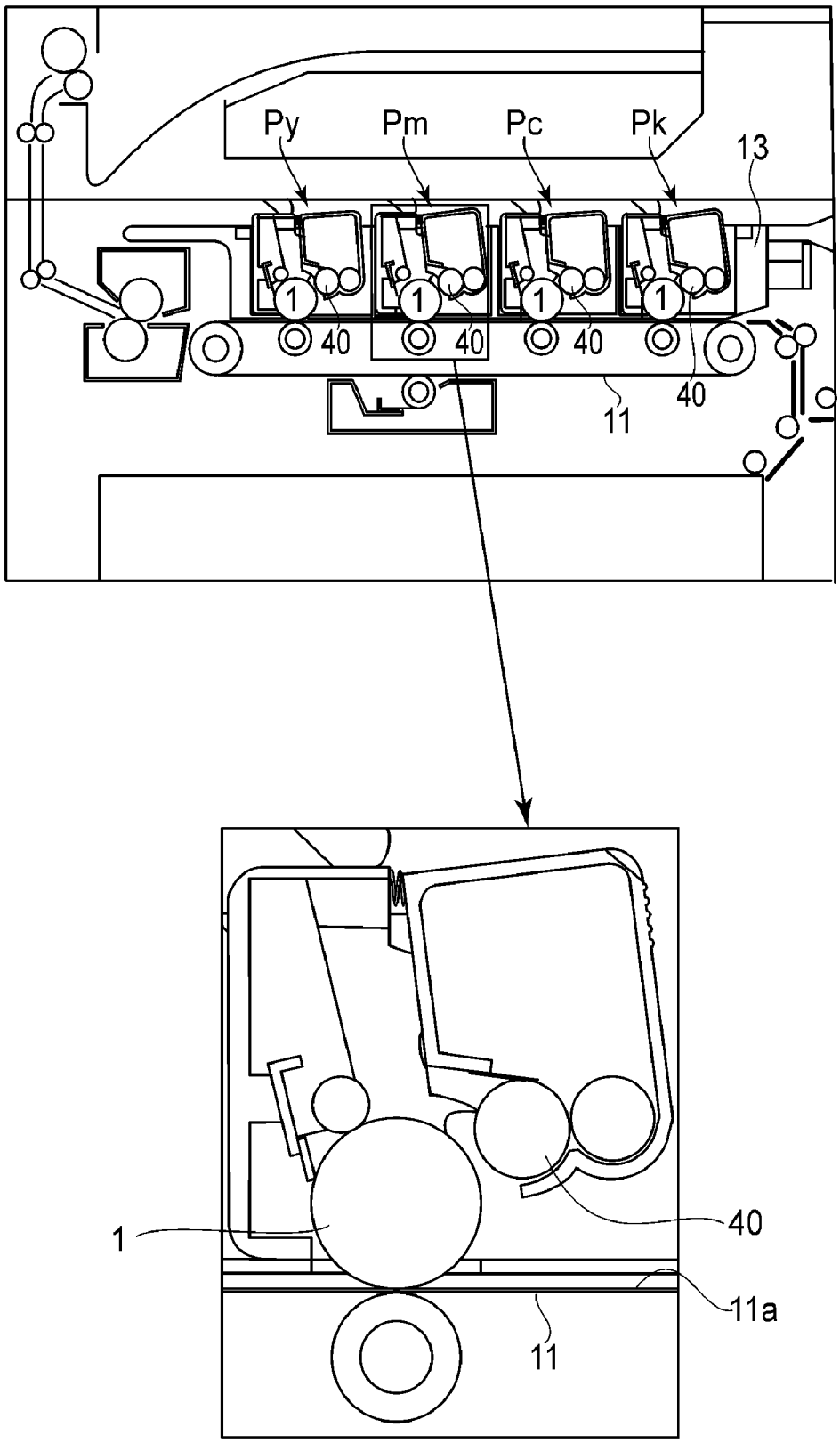
FIG. 19 is a schematic sectional view illustrating the state in the partway of shifting to the image forming operation in the image forming apparatus according to Embodiment 1 of the present invention.
Figure 20:
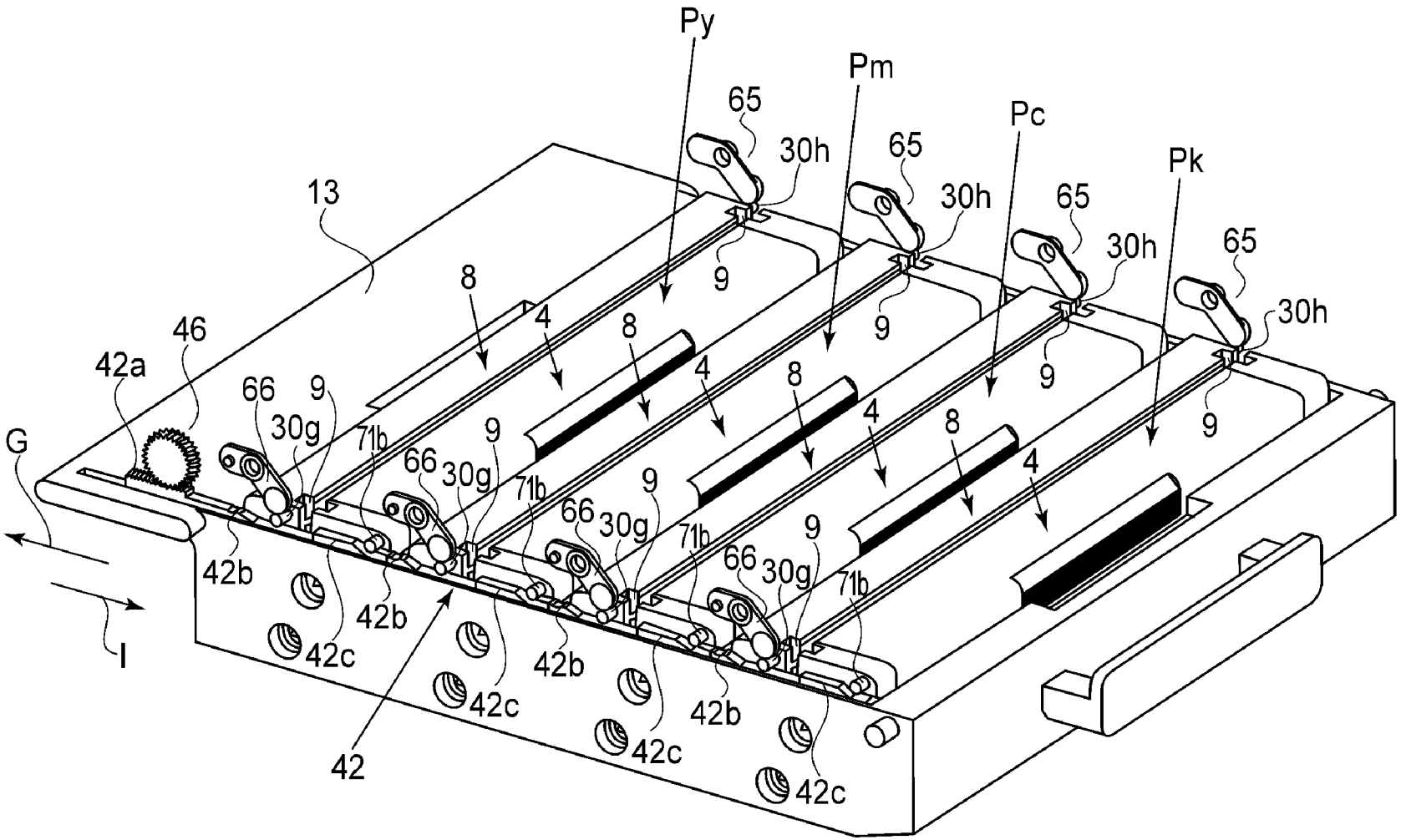
FIG. 20 is a perspective view illustrating the state of the partway shifting to the image forming operation in the drawer unit according to Embodiment 1 of the present invention.
Figure 21:
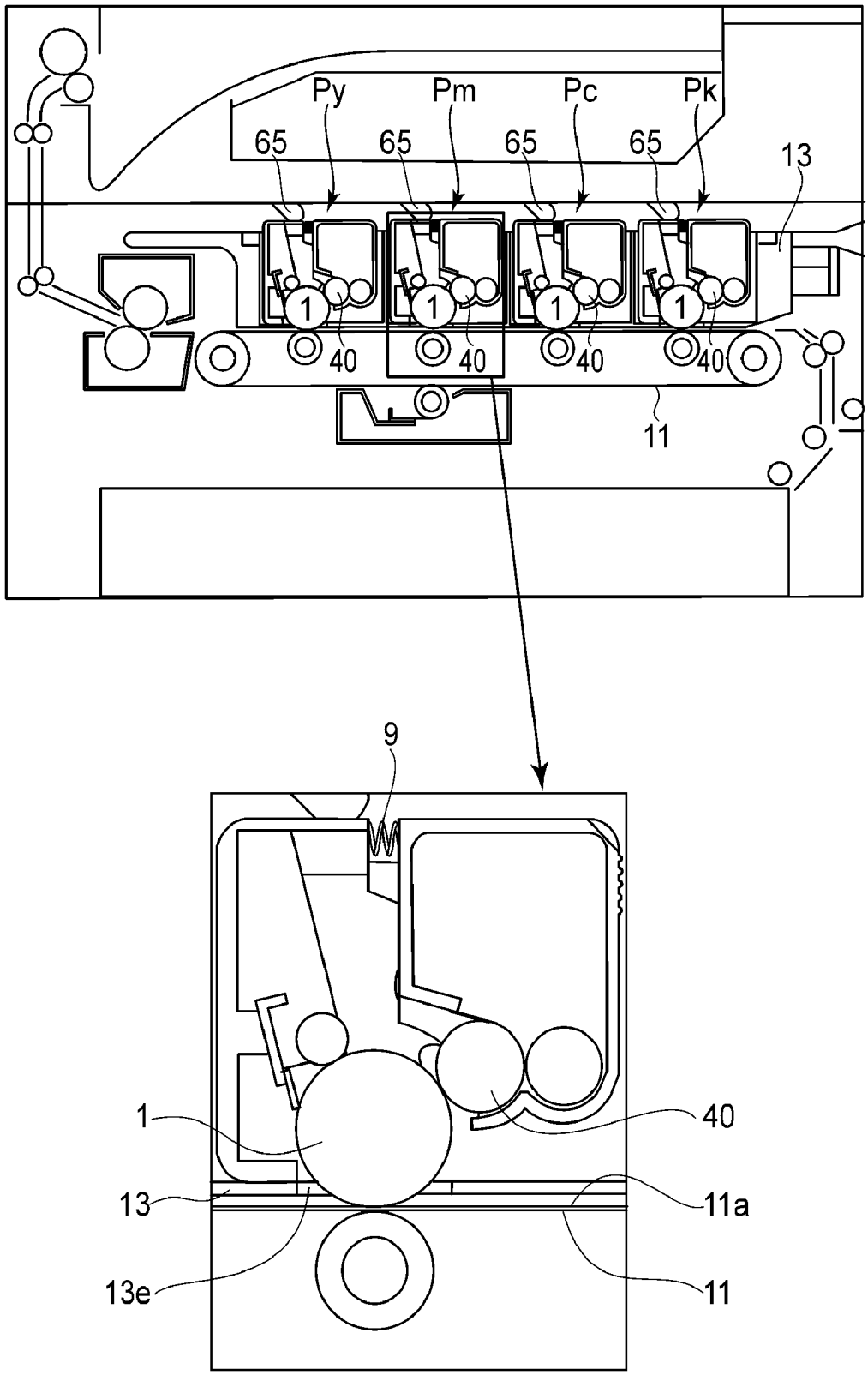
FIG. 21 is a schematic sectional view illustrating the state that the image forming operation in the image forming apparatus according to Embodiment 1 of the present invention is enabled.

Referring to FIG. 16-FIG. 21 the description will be made as to the operation of each part at the time of the image forming operation. FIG. 16 is a perspective view illustrating the state immediately after the image formation instruction in the drawer unit according to Embodiment 1 of the present invention. FIG. 17 is a schematic sectional view illustrating the state in which the drawer unit according to Embodiment 1 of the present invention is mounted to the inside of the main assembly, and in which it is of partway of shifting to the image forming operation. FIG. 17 includes a schematic sectional view of the neighborhood of the drawer unit and the transfer belt and an enlarged cross-sectional view of the neighborhood of the one photosensitive drum. FIG. 18 is a perspective view illustrating the state of the partway of shifting to the image forming operation in the drawer unit according to Embodiment 1 of the present invention. FIG. 19 is a schematic sectional view illustrating the state of the partway of shifting to the image forming operation in the image forming apparatus according to Embodiment 1 of the present invention. FIG. 19 includes a schematic sectional view of the whole device and an enlarged cross-sectional view of the neighborhood of the one photosensitive drum. FIG. 20 is a perspective view illustrating the state in the course of shifting to the image forming operation in the drawer unit according to Embodiment 1 of the present invention. FIG. 21 is a schematic sectional view illustrating the state that the image forming operation is capable in the image forming apparatus according to Embodiment 1 of the present invention. FIG. 21 includes an enlarged cross-sectional view of a schematic sectional view of the whole device and the neighborhood of one photosensitive drum.

The instruction of the image formation is produced, and the driving gear 46 connected operatively with a motor (unshown) provided in the main assembly is rotated in a direction of arrow F in FIG. 16. By this, the contacting and spacing member 42 is moved in the direction of arrow G in FIG. 16 by the rack portion 42*a* engaged with the driving gear 46. When the contacting and spacing member 42 moves to the position shown in FIG. 16, the force receiving portion 30*g* provided on the photosensitive member unit 8 separates from the first projection 42*b* of the contacting and spacing member 42. However, the force receiving portion 71*b* provided in the developing unit 4 is still placed on the second projection 42*c*. Since the second projection 42*c* is longer than the first projection 42*b*, such a mechanism is established in the movement direction of the contacting and spacing member 42.

FIG. 17 shows a positional relation among the drawer member 13, the process cartridge P, and the transfer belt 11 in the state shown in FIG. 16. As has been described hereinbefore, the force receiving portion 30*g* separates from the first projection 42*b* by a moving operation of the contacting and spacing member 42, by which the surface of the photosensitive drum 1 is contacted to the surface of the transfer belt 11. On the other hand, the force receiving portion 71*b* is maintained in the state of receiving the force from the second projection 42*c*, and therefore, the developing roller 40 is spaced from the surface of the photosensitive drum 1. This position is the second position, wherein the contacting and spacing member 42 contacts the photosensitive drum 1 to the transfer belt 11, and spaces the developing roller 40 from the photosensitive drum 1.

As shown in FIG. 18, thereafter, the urging members 65, 66 provided in the main assembly side are driven with the unshown driving source and moves in a direction of arrow H. The urging members 65, 66 abut to the force receiving portions 30*g*, 30*h* provided on the process cartridge P and apply the force to it. By this, the portion-to-be-guided 30*c* (FIG. 8) of the process cartridge P abuts to the positioning portion 13*h*1 (FIG. 9) provided on the drawer member 13. The portion-to-be-guided 30*d* (FIG. 9) abuts to the positioning portion 13*j*1 (FIG. 10). Furthermore, the portions-to-be-guided 30*e* and 30*f* (FIGS. 8, 9) engage with the guide portions 13*i* and 13*k* (FIGS. 9, 10), and the process cartridge P is positioned in the drawer member 13.

As has been described in the foregoing, by the function of the urging members 65, 66, the process cartridge P is positioned in the main assembly.

FIG. 19 shows the inside a main assembly in the state shown in FIG. 18. In the process cartridge P in this state, the surface of the developing roller 40 is spaced from the surface of the photosensitive drum 1. The surface of the photosensitive drum 1 is in contact to the surface of the transfer belt 11. That is, the position of the contacting and spacing member 42 at this time is corresponded to the second position.

As shown in FIG. 20, thereafter, in order to contact the developing roller 40 and the photosensitive drum 1 relative to each other, the driving gear 46 further rotates and moves the contacting and spacing member 42 in a direction of arrow G. By this, the force receiving portion 71*b* provided on the developing unit 4 separates from the second projection 42*c* of the contacting and spacing member 42 and does not receive the force from the second projection 42*c*. Therefore, the surface of the developing roller 40 and the surface of the photosensitive drum 1 contact to each other by the urging force of the spring 9 provided between the developing unit 4 and the photosensitive member unit 8. By this, as for the image forming apparatus 100, the image formation is enabled. This position is a third position, wherein the contacting and spacing member 42 contacts the photosensitive drum 1 to the transfer belt 11, and contacts the developing roller 40 to the photosensitive drum 1 to enable the image formation. The image forming operation is as has been described hereinbefore. FIG. 21 shows the inside of the main assembly at the time of being in the state that the image forming operation is capable.

When the image formation finishes, the driving gear 46 is rotated in the direction opposite the direction of arrow F shown in FIG. 16 to move the contacting and spacing member 42 in the direction of arrow I in FIG. 20. By this, the contacting and spacing member 42 is moved to the second position, and spaces the surface of the developing roller 40 from the surface of the photosensitive drum 1 (FIGS. 18, 19).

Thereafter, the urging members 65, 66 carry out in movement in the direction opposite the above described pressing direction, and the contacting and spacing member 42 further moves in a direction of arrow I. By this, the surface of the photosensitive drum 1 is spaced from the surface of the transfer belt 11. In this state, the apparatus waits for the instruction of the next image formation. Or, in the case where the drawer member 13 is drawn, the state is maintained in which the surface of the photosensitive drum 1 and the surface (recording material conveying surface 11*a*) of the transfer belt 11 are spaced from each other and the surface of the photosensitive drum 1 and the surface of the developing roller 40 are spaced from each other. That is, the contacting and spacing member 42 is placed in the first position. Therefore, when the drawer member 13 which carries the process cartridge P is drawn from the main assembly, the damage due to the contact between the surface of the photosensitive drum 1 and the surface of the developing roller 40 by the impact at the time of the movement or the like is suppressed.

As has been described in the foregoing, according to the image forming apparatus 100 of this embodiment, the contacting and spacing member 42 is the movement between the first position and the second position. By the movement of the contact member 42, timely, the photosensitive drum 1 is spaced from the transfer belt 11, or contacts to the transfer belt 11. By this, in the case that the image formation is not carried out, for example when the drawer unit U1 (drawer member 13) is drawn, the photosensitive drum 1 and the transfer belt 11 are maintained at the spaced state from each other.

According to the image forming apparatus 100 of this embodiment, the contacting and spacing member 42 is provided in the drawer member 13. Therefore, in order to contact the photosensitive drum to a transfer belt, a mechanism for moving the whole drawer member toward a transfer belt surface is not required, unlike the conventional example. Since the space for moving the whole drawer member toward the transfer belt surface is unnecessary, a downsizing of the main assembly can be accomplished.

Furthermore, in this embodiment, the driving force of the main assembly moves the contacting and spacing member 42 to the first position, the second position, or the third position timely. Therefore, the user can contact and space the surface of the photosensitive drum 1 and the surface of the transfer belt 11 relative to each other, and can contact and space the surface of the photosensitive drum 1 and the surface of the developing roller 40 relative to each other without requiring a special force.

In this embodiment, as for the example of the transfer belt 11, the sheet material S which is the transfer member is fed to the surface of the photosensitive drum 1, and the developer image on the photosensitive drum 1 is directly transferred onto the sheet material S. However, the present invention is applicable also to the image forming apparatus, wherein the transfer belt receives the developer image formed on the photosensitive drum and, finally the image is transferred onto the recording material (sheet material) (intermediary transfer belt type).

In this embodiment, the contacting and spacing member 42 is provided only at the one-end portion of the drawer member 13. However, a contacting and spacing member may also be provided like the other end portion of the drawer member 13. In this case, the force receiving portion for receiving the force from the contacting and spacing member is also provided in the other end portion. If the contacting and spacing member is provided at the respective sides, the shafts of the photosensitive drum and the developing roller in the process cartridge do not incline during the movement thereof. Therefore, the spaced state between the photosensitive drum and the transfer belt and the spaced state between the photosensitive drum and the developing roller can further be stabilized.

Embodiment 2

FIG. 22-FIG. 36 illustrates the various parts by Embodiment 2 of the present invention. In Embodiment 1, the process cartridge P which contains the photosensitive member unit 8 which includes the photosensitive drum 1 and the developing unit 4 which includes the developing roller 40 integrally is mounted to the drawer member 13. In this embodiment, a photosensitive member unit which includes the photosensitive drum 1 and the developing unit which includes the developing roller 40 are mounted individually to a drawer member 63. The like reference numerals as in the foregoing embodiment are assigned to the elements having the corresponding functions.

<Developing Cartridge>

Figure 22:
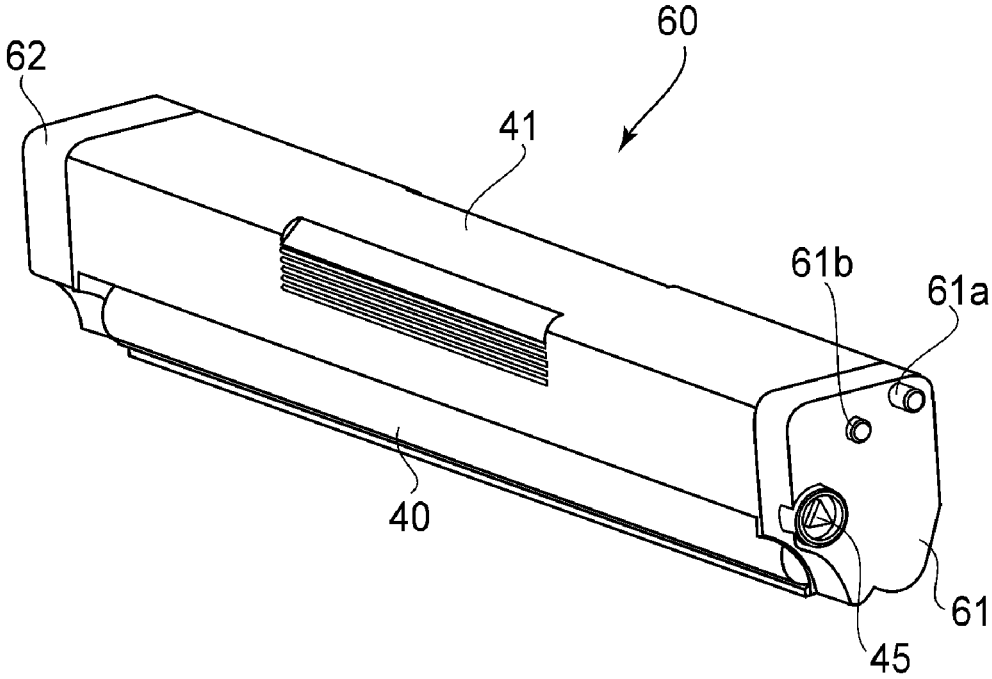
FIG. 22 is a perspective view of a developing cartridge according to Embodiment 2 of the present invention.
Figure 22:
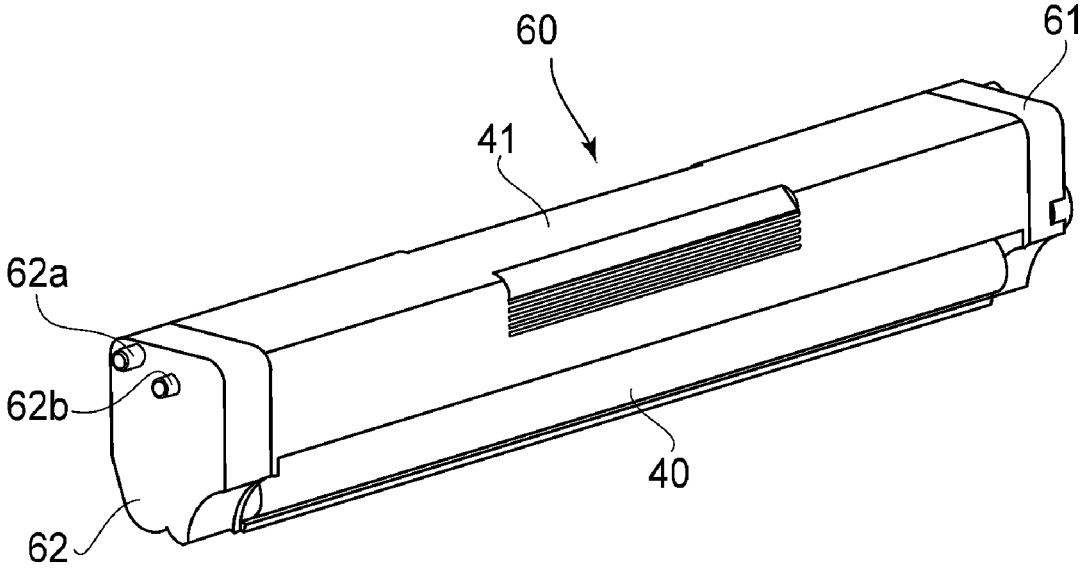

Referring to FIG. 22, the description will be made as to the developing cartridge which is the developing unit according to Embodiment 2 of the present invention. FIG. 22 is a perspective view of the developing cartridge according to Embodiment 2 of the present invention. In FIG. 22, they are perspective views, as seen from the different directions ((a) and (b)).

A developing cartridge 60 according to this embodiment comprises the developing roller 40, a toner supplying roller (unshown), a developing blade (unshown), and a toner container 41 which contains the toner which is the developer used for the image formation. In the image forming apparatus according to this embodiment, four developing cartridges 60 which contain the toner of the different colors are used. The reference numerals for these cartridges are 60*y*, 60*m*, 60*c*, and 60*k*, but the reference numerals may be referred to as simply "60" if no confusion arises. Here, y means yellow, m means magenta, c means cyan, and k means black.

As shown in FIG. 22, the one-end portion of the developing cartridge 60 rotatably supports the coupling member 45 for receiving the driving force from the development coupling member 26 of the main assembly side. The driving force received by the coupling member 45 is transmitted to the developing roller 40, the toner supplying roller, and so on through the unshown intermediate gear.

The upper portion of the side cover, 61 of one side of the developing cartridge 60 is provided with an outwardly projecting force receiving portion 61*a* with respect to the axial direction which is the developing roller 40. This force receiving portion 61*a* receives the force from the contacting and spacing member 42 (FIG. 24) to space the developing roller 40 from the photosensitive drum 1. The details thereof will be described hereinafter. Furthermore, the upper portion of a side cover 62 of the another side of the developing cartridge 60 is provided with a force receiving portion 62*a*. The force receiving portions 61*a*, 62*a* is pressed by the urging members provided in the main assembly to position the developing cartridge 60 relative to the drawer member 63. The details thereof will be described hereinafter.

Adjacent to the force receiving portions, 61*a*, 62*a*, a portions to be positioned 61*b*, 62*b* are provided, and they outwardly project with respect to the axial direction which is the developing roller 40. The details thereof will be described hereinafter.

<Photosensitive Member Cartridge>

Figure 23:
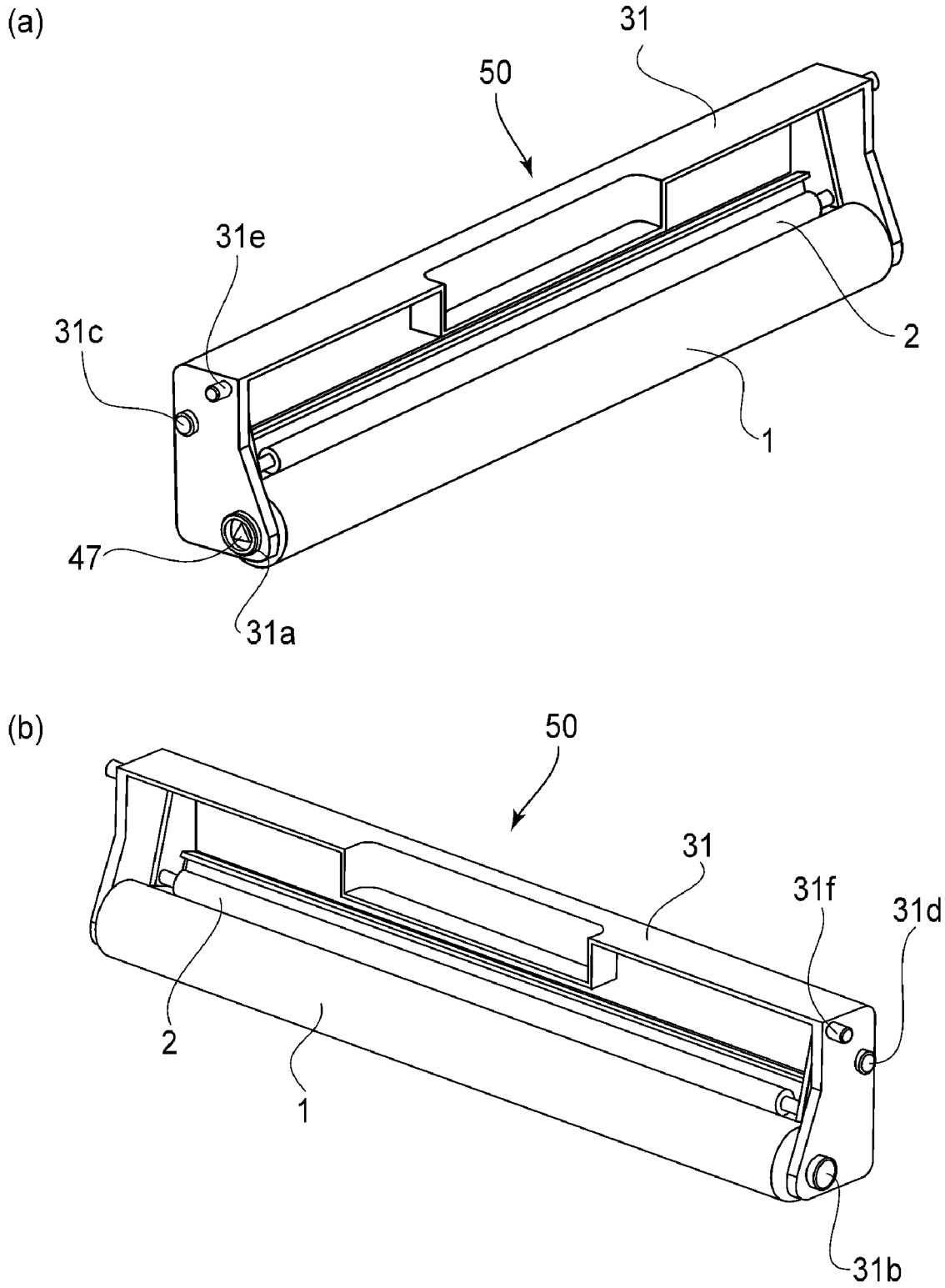
FIG. 23 is a perspective view of a photosensitive member cartridge according to Embodiment 2 of the present invention.

Referring to FIG. 23 the description will be made as to the photosensitive member cartridge which is the photosensitive member unit according to Embodiment 2 of the present invention. FIG. 23 is a perspective view of the photosensitive member cartridge according to Embodiment 2 of the present invention. In FIG. 23, they are the perspective views, as seen from the different directions ((a) and (b)).

A photosensitive member cartridge 50 according to this embodiment comprises the photosensitive drum 1, the charging means 2, the cleaning means (unshown), and a residual toner container 31 for containing the toner removed by the cleaning means. As for the image forming apparatus according to this embodiment, the four photosensitive member cartridges 50 which contain the toner of the different colors are used. The reference numerals for these cartridges are 50*y*, 50*m*, 50*c*, and 50*k*, but the reference numerals may be referred to as simply "50" if no confusion arises, although y means yellow, m means magenta, c means cyan, and k means black.

As shown in FIG. 23, one-end portion of the photosensitive member cartridge 50 supports the coupling member 47 for receiving the driving force from the drum coupling member 25 of the main assembly side rotatably. The coupling member 47 is provided at the end of the photosensitive drum 1, and the photosensitive drum 1 rotates by the driving force received by the coupling member 47 from the main assembly side.

An outer periphery of the coupling member 47 is covered by the cylindrical rib to constitute a portion-to-be-guided 31*a*. On the opposite side of the portion-to-be-guided 31*a*, a portion-to-be-guided 31*b* which is provided with the cylindrical projection is provided. Above the portion-to-be-guided 31*a*, a portion-to-be-guided 31*c* is provided, and above the portion-to-be-guided 31*b*, a portion-to-be-guided 31*d* is provided. The portions-to-be-guided 31*a*, 31*b*, 31*c*, 31*d* has the guiding function, when the photosensitive member cartridge 50 is mounted into the drawer member 63 and when it is positioned in the drawer member 63. The details thereof will be described hereinafter.

One of the upper portions of the ends of the photosensitive member cartridge, 50 is provided with a force receiving portion 31*e* outwardly projected with respect to the axial direction from the photosensitive drum 1. The force receiving portion 31*e* receives the force from the contacting and spacing member 42 (FIG. 24) provided in the drawer member 63 to space the photosensitive drum 1 from the transfer belt 11. The details thereof will be described hereinafter. Furthermore, the other end of the photosensitive member cartridge 50 is provided with a force receiving portion 31*f*. The force receiving portions 31*e*, 31*f* is pressed by the urging members provided in the main assembly, to position the photosensitive member cartridge 50 relative to the drawer member 63. The details thereof will be described hereinafter.

<Drawer Member (Supporting Member)>

Figure 24:
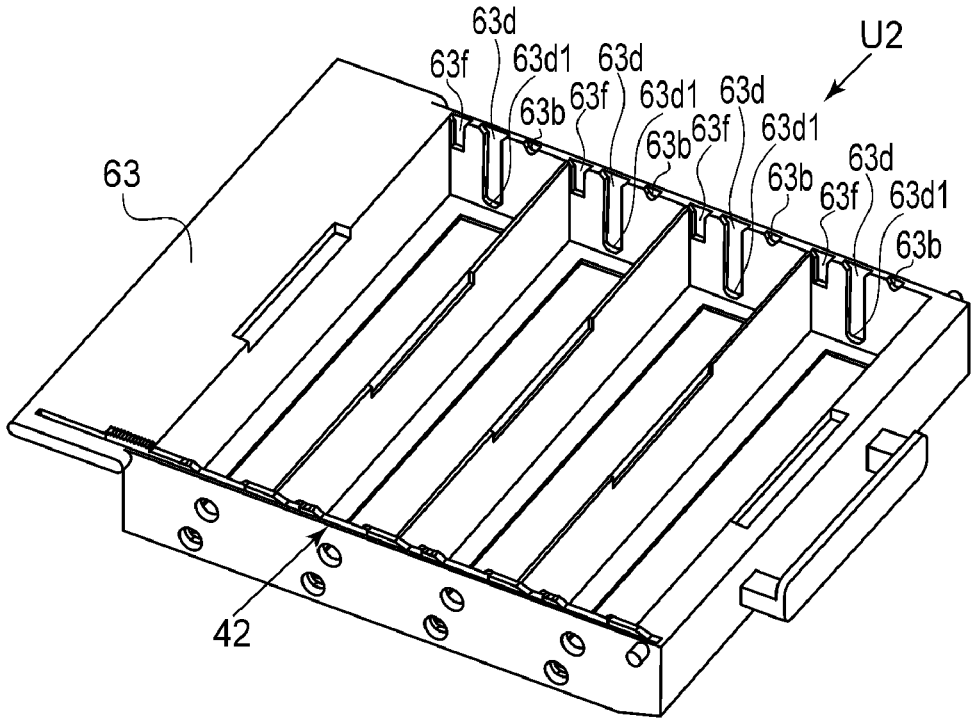
FIG. 24 is a perspective view of the drawer unit in the image forming apparatus according to Embodiment 2 of the present invention.
Figure 25:
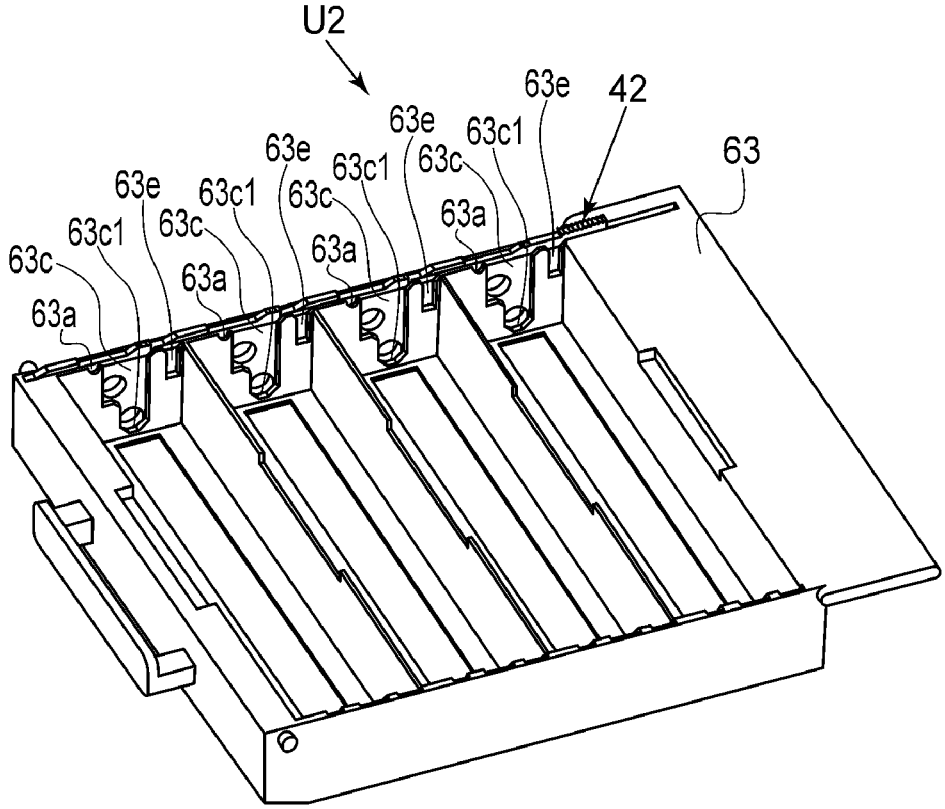
FIG. 25 is a perspective view of the drawer unit in the image forming apparatus according to Embodiment 2 of the present invention.

Referring to FIGS. 24 and 25 the description will be made as to the drawer member 63 according to Embodiment 2 of the present invention. FIGS. 24 and 25 are perspective views of the drawer unit in the image forming apparatus according to Embodiment 2 of the present invention. FIGS. 24 and 25 are the perspective views, as seen from different directions.

The drawer unit U2 according to this embodiment is different from Embodiment 1 in that the drawer member 63 is provided with the positioning portions 63*a*, 63*b* in order to position the developing cartridge 60 in the drawer member 63.

The developing cartridge 60 is positioned in the drawer member 63 by the portions to be positioned 61*b* and 62*b* (FIG. 22) engaging with the positioning portions 63*a*, 63*b* provided in the drawer member 63.

Similarly to Embodiment 1, the drawer member 63 is provided with the contacting and spacing member 42. Since the structure of the contacting and spacing member 42 is similar to Embodiment 1, the description is omitted for the sake of simplicity. In addition, similarly to Embodiment 1, the drawer unit U2 comprises the drawer member 63 and the contacting and spacing member 42.

<Mounting of Photosensitive Member Cartridge and Developing Cartridge to Drawer Member>

Figure 26:
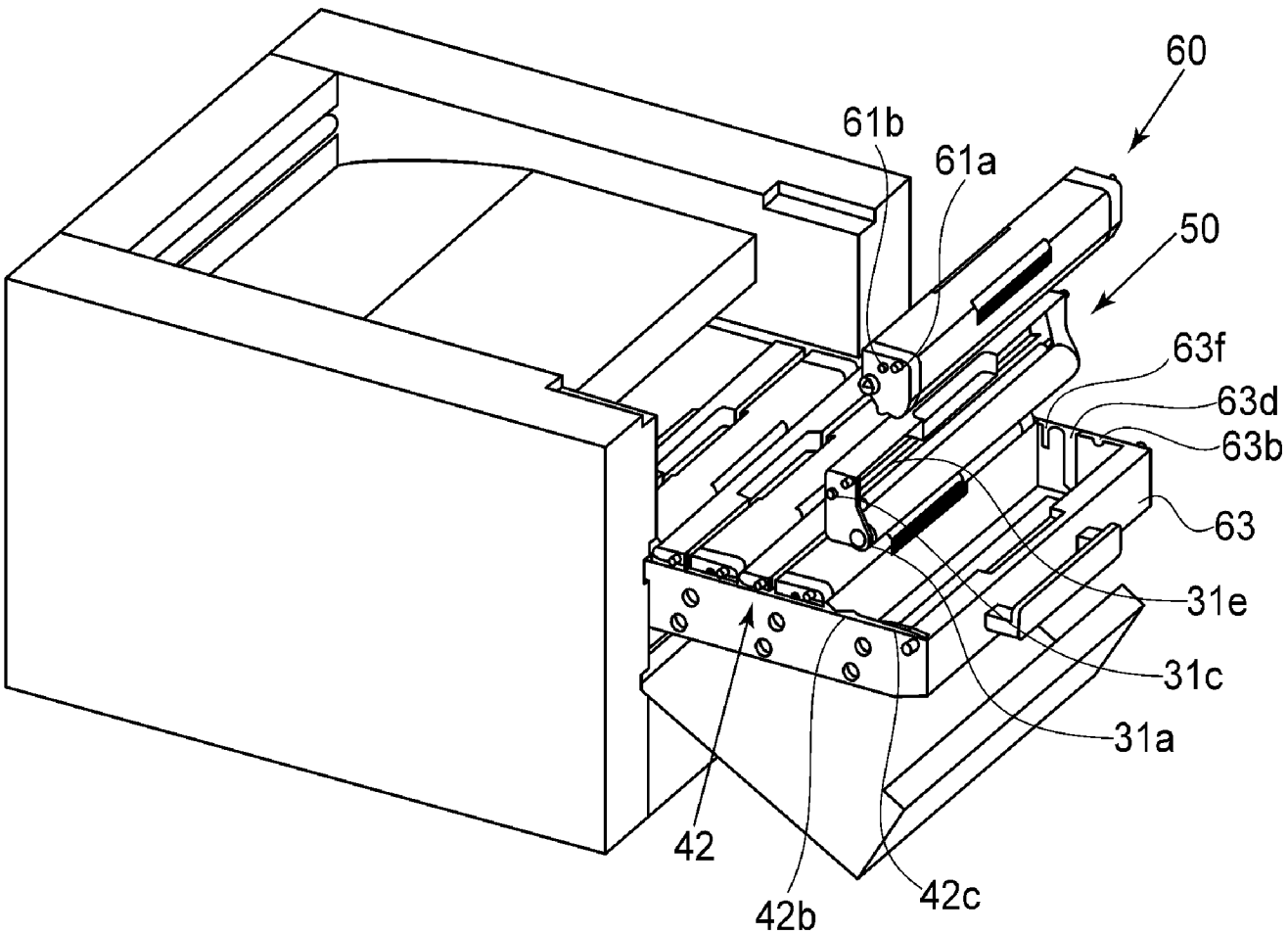
FIG. 26 is a perspective view illustrating the state that the photosensitive member cartridge and the developing cartridge according to Embodiment 2 of the present invention is mounted to the drawer member.
Figure 27:
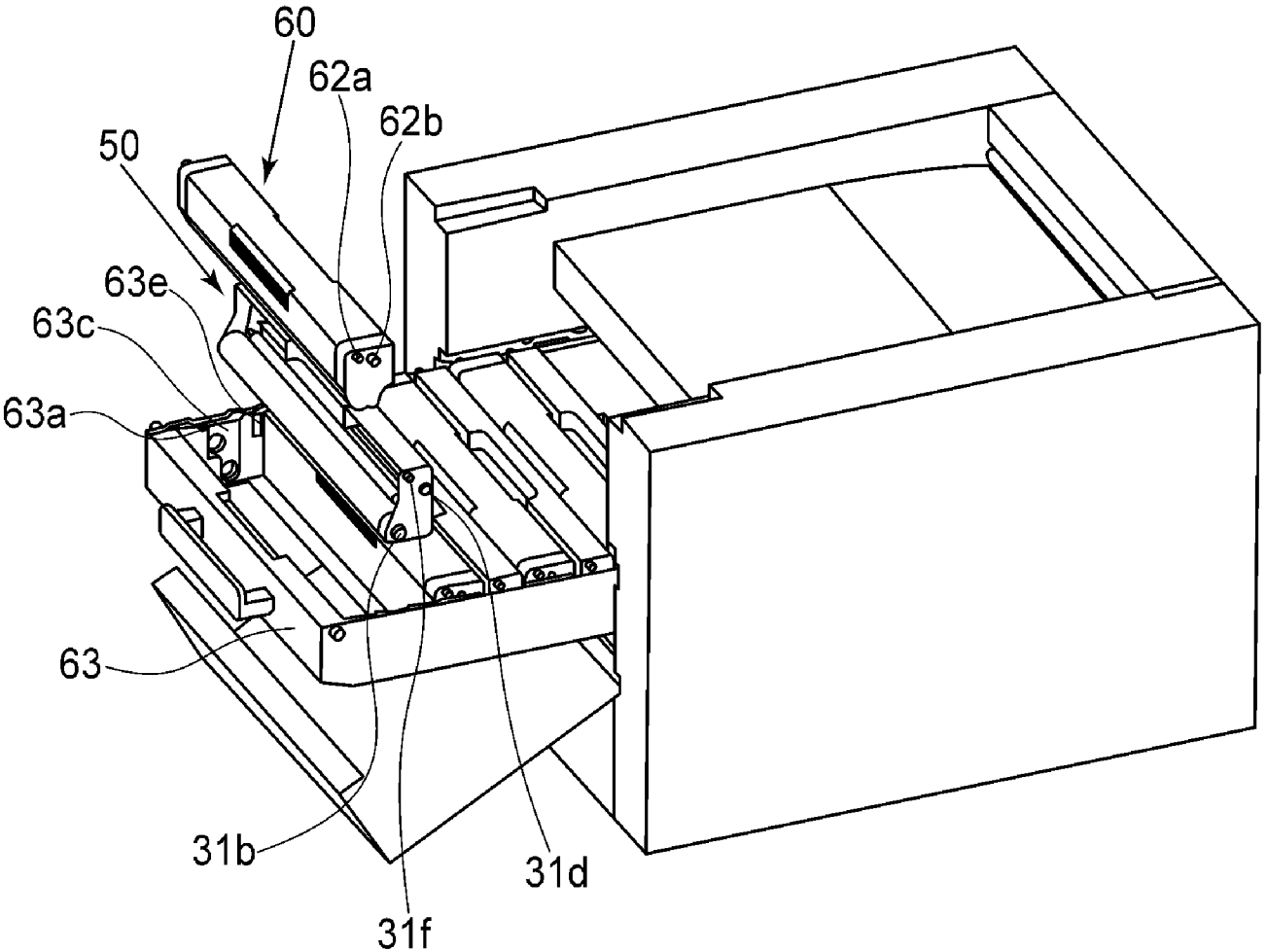
FIG. 27 is a perspective view illustrating the state that the photosensitive member cartridge and the developing cartridge according to Embodiment 2 of the present invention is mounted to the drawer member.

Referring to FIGS. 26 and 27, the description will be made as to the mounting of the developing cartridges 60 (60*y*, 60*m*, 60*c*, 60*k*) and the photosensitive member cartridges 50 (50*y*, 50*m*, 50*c*, 50*k*) to the drawer member 63. FIGS. 26 and 27 are perspective views illustrating the state of mounting the photosensitive member cartridge and the developing cartridge according to Embodiment 2 of the present invention to the drawer member.

FIGS. 26 and 27 illustrate the state of the process of the mounting of the cartridge and are views, as seen from different directions.

In this embodiment, the photosensitive member cartridge 50 and the developing cartridge 60 are mounted individually into the drawer member 63. In the case of mounting them to the drawer member 63, the photosensitive member cartridge 50 is mounted, and thereafter the developing cartridge 60 is mounted.

In the case of mounting the photosensitive member cartridge 50, it is mounted by the user while the portions-to-be-guided 31*a*, 31*b* provided at the opposite ends of the photosensitive member cartridge 50 are guided to the guide portions 63*c*, 63*d* of the drawer member 63. Then, it is mounted while the portions-to-be-guided 31*c*, 31*d* are guided by the guide portions 63*e*, 63*f*. By this, the photosensitive member cartridge 50 is mounted to the inside of the drawer member 63.

In the case of mounting the developing cartridge 60, the user mounts the developing cartridge 60, so that the portions to be positioned 61*b*, 62*b* of the developing cartridge 60 aligns with the positioning portions 63*a*, 63*b* provided in the drawer member 63. However, the portions to be positioned 61*b*, 62*b* are not contacted to the positioning portions 63*a*, 63*b* at the time mounting.

In the process in which the photosensitive member cartridge 50 is mounted to the drawer member 63, the force receiving portion 31*e* provided on the photosensitive member cartridge 50 contacts to the first projection (force applying portion) 42*b* (FIG. 26) provided on the contacting and spacing member 42. The force receiving portion 61*a* provided on the side cover 71 of the developing cartridge 60 contacts to the second projection (force applying portion) 42*c* (FIG. 26).

By the force receiving portion 31*e* provided on the photosensitive member cartridge 50 contacting to the first projection 42*b*, the photosensitive member cartridge 50 is held at the position higher than the image forming position. That is, the surface of the photosensitive drum 1 is held at the position (spaced position) higher than the surface (recording material conveying surface 11*a*) of the transfer belt 11.

Figure 28:
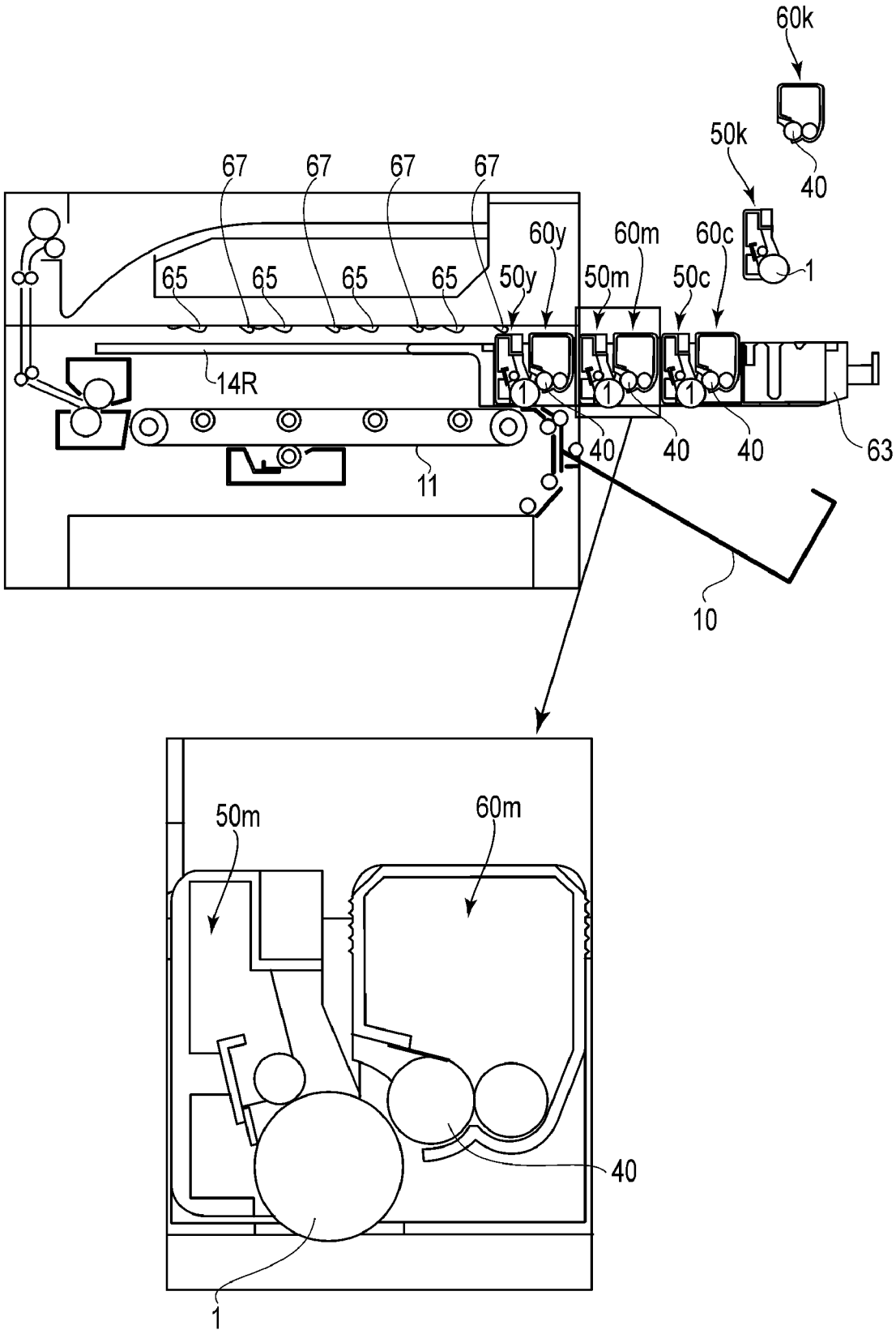
FIG. 28 is a schematic sectional view illustrating the state that the drawer unit according to Embodiment 2 of the present invention is mounted in the main assembly.

By the force receiving portion 61*a* provided on the developing cartridge 60 contacting to the second projection 42*c* provided on the contacting and spacing member 42, the surface of the developing roller 40 is spaced from the surface of the photosensitive drum 1. As to this, the description will be made referring to FIG. 28. FIG. 28 is a schematic sectional view illustrating the state that the drawer unit according to Embodiment 2 of the present invention is mounted into the main assembly. In FIG. 28, a schematic sectional view of the whole device and a schematic enlarged cross-sectional view of a photosensitive drum neighborhood are shown.

The second projection 42*c* provided on the contacting and spacing member 42 is disposed at the position higher than the first projection 42*b*. On the other hand, the force receiving portion 31*e* provided in the photosensitive member cartridge 50 and the force receiving portion 61*a* provided in the developing cartridge 60 are substantially at the same heights in the state of not receiving the external force. By this, the developing cartridge 60 is held at the position higher than the photosensitive member cartridge 50.

Therefore, the surface of the developing roller 40 is separated from the surface of the photosensitive drum 1.

Here, the contacting and spacing member 42 is provided only at the one-end portion of the drawer member 63. The force receiving portion 61*a* for receiving the force from the second projection 42*c* of the contacting and spacing member 42 is also provided only on the one side of the developing cartridge 60. However, since the portion to be positioned, 62*b* provided at the other end portion of the developing cartridge, 60 is outwardly provided beyond the end with respect to the longitudinal direction of the photosensitive drum 1, the surface of the developing roller 40, can be separated from the surface of the photosensitive drum 1. That is, the force receiving portion 61*a* receives the force from the second projection 42*c*, so that the developing cartridge 60 rises at the one-end portion. On the other hand, in the other end portion, the portion to be positioned 62*b* is in contact to a positioning portion 63*b* of the drawer member 63. For this reason, the developing cartridge 60 is oblique relative to the photosensitive drum 1. However, as has been described hereinbefore, since the portion to be positioned 62*b* is outwardly provided beyond the longitudinal end of the photosensitive drum 1, the surface of the developing roller 40 is spaced from the surface of the photosensitive drum 1.

In this manner, when the photosensitive member cartridge 50 and the developing cartridge 60 are mounted, the contacting and spacing member 42 is in such a position that the first projection 42*b* contacts to the force receiving portion 31*e*, and the second projection 42*c* contacts to the force receiving portion 61*a*. At this time, the surface of the photosensitive drum 1 can be placed in the position spaced from the surface of the transfer belt 11. The surface of the developing roller 40 can be placed in the position spaced from the surface of the photosensitive drum 1. Similarly to Embodiment 1, such a position that the contacting and spacing member 42 spaces the photosensitive drum 1 from the transfer belt 11, and spaces the developing roller 40 from the photosensitive drum 1, is a first position.

In this manner, in the process in which the developing cartridge 60 is mounted to the drawer member 63, in the state that the surface of the developing roller 40 is spaced from the surface of the photosensitive drum 1, the developing cartridge 60 is mounted. Therefore, in mounting the developing cartridge 60 to the drawer member 63 the surface damage due to the rubbing between the surface of the photosensitive drum 1 and the surface of the developing roller 40 by the impact at the time of the mounting can be suppressed.

As has been described in the foregoing, the photosensitive member cartridge 50 and the developing cartridge 60 are mounted to the drawer member 63 while spacing is established between the surface of the developing roller 40 and the surface of the photosensitive drum 1 and between the surface of the photosensitive drum 1 and the surface of the transfer belt 11. That is, the photosensitive member cartridge 50 and the developing cartridge 60 are mounted to the drawer member 63 in the state that the contacting and spacing member 42 is in the first position.

<Mounting of Drawer Unit into Main Assembly>

Figure 29:
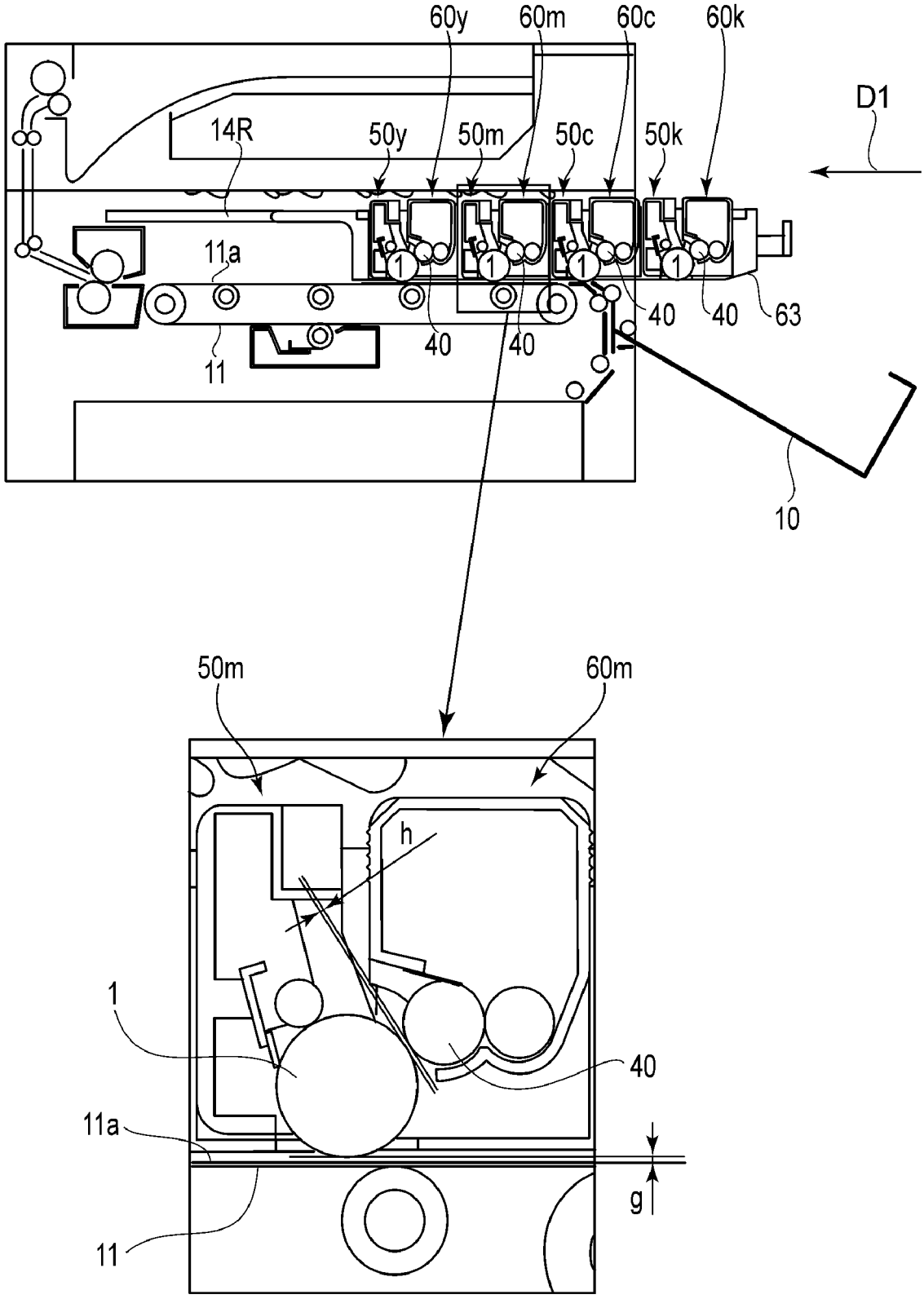
FIG. 29 is a schematic sectional view illustrating the state that the drawer unit according to Embodiment 2 of the present invention is mounted in the main assembly.
Figure 30:
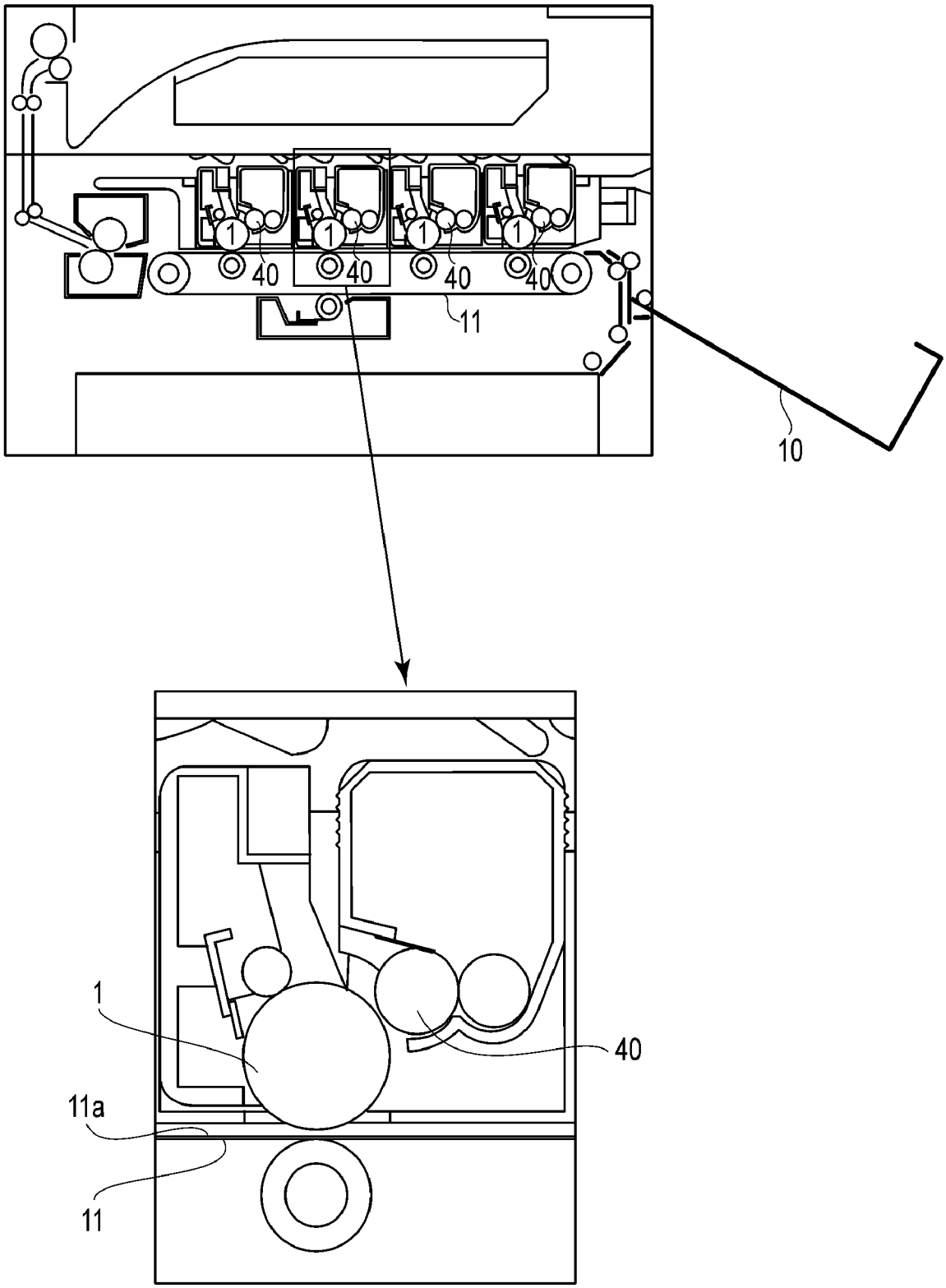
FIG. 30 is a schematic sectional view illustrating the state of the state that o mounting of the drawer unit according to Embodiment 2 of the present invention is done in the main assembly, and the door is open.
Figure 31:
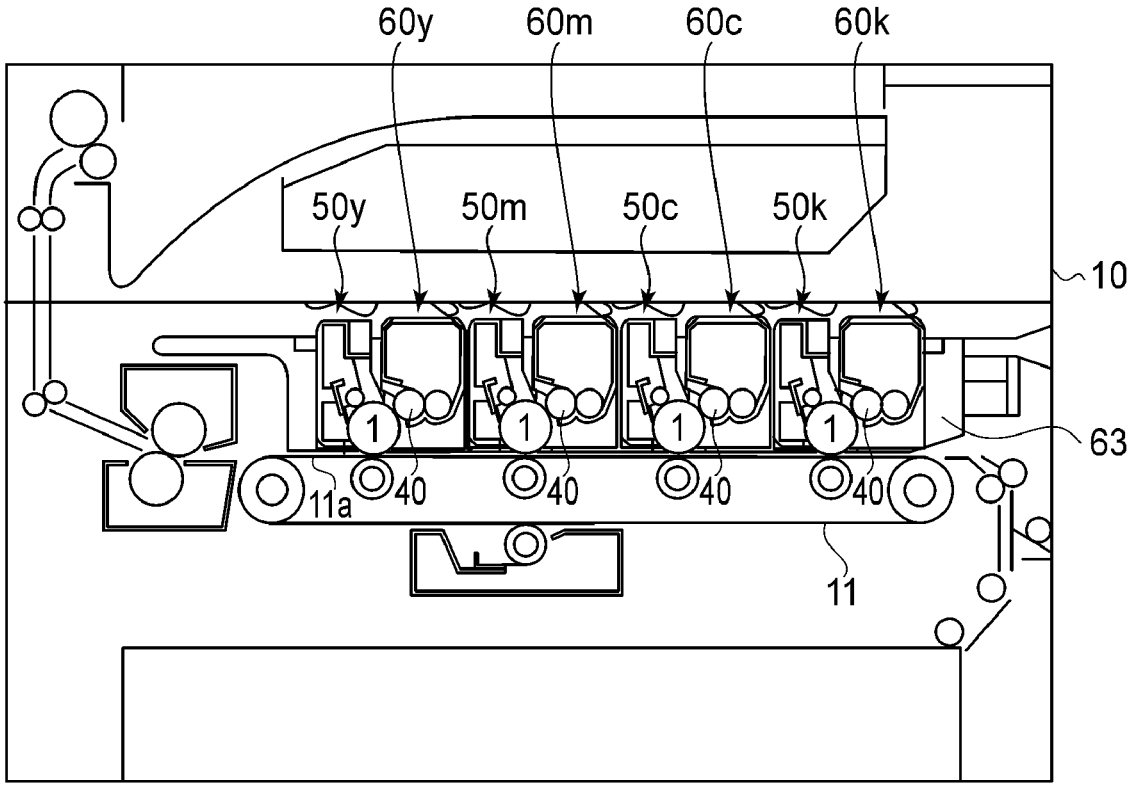
FIG. 31 is a schematic sectional view illustrating the state that the drawer unit according to Embodiment 2 of the present invention is mounted in the main assembly and the door closes.

Referring to FIG. 29-FIG. 31, the description will be made as to the mounting operation of the drawer unit U2 into the main assembly. FIG. 29 is a schematic sectional view illustrating the state that the drawer unit according to Embodiment 2 of the present invention is mounted to the inside of the main assembly. FIG. 30 is a schematic sectional view illustrating the state which the drawer unit according to Embodiment 2 of the present invention is mounted to the inside of the main assembly, and the door opens. FIGS. 29 and 30 include a schematic sectional view of the whole device and a schematic enlarged cross-sectional view of the neighborhood of one photosensitive drum are shown. FIG. 31 is a schematic sectional view illustrating the state that the drawer unit according to Embodiment 2 of the present invention is mounted to the inside of the main assembly, and the door closes. In FIG. 31, the image forming operation is not carried out.

As shown in FIG. 29, the drawer unit U2 (drawer member 63) is mounted to the inside of the main assembly in a direction of the arrow D1. During the mounting operation of the drawer unit U2, the surface of the photosensitive drum 1 and the recording material conveying surface 11*a* of the transfer belt 11 are spaced from each other. That is, a gap g is provided between the surface of the photosensitive drum 1 and the recording material conveying surface 11*a* of the transfer belt 11. Therefore, the drawer unit U2 can be mounted to the inside of the main assembly without the surface of the photosensitive drum 1 rubbing with the surface of the transfer belt 11. The contacting and spacing member 42 is placed in the first position among the mounting operation of the drawer unit U2.

As has been described hereinbefore, during the mounting operation of the drawer unit U2, the contacting and spacing member 42 is placed in the first position, and the surfaces of the photosensitive drum 1 and the developing roller 40 are also spaced from each other. That is, the gap g is provided therebetween. Therefore, in mounting the drawer unit U2 to the inside of the main assembly, the damage due to the contact between the surface of the photosensitive drum 1 and the surface of the developing roller 40 by the impact at the time of the mounting and so on can be suppressed.

As shown in FIG. 30, in the state that the drawer unit U2 is inserted into the main assembly, and the door 10 is open, the surface of the photosensitive drum 1 and the recording material conveying surface 11*a* of the transfer belt 11 are still spaced from each other. The surfaces of the photosensitive drum 1 and the developing roller 40 are also spaced from each other.

FIG. 31 shows the state where the door is closed. Even if the door 10 is in the closed state, when the image forming operation is not carried out, the space is kept between the surface of the photosensitive drum 1 and the recording material conveying surface 11*a* of the transfer belt. 11 and between the surface of the photosensitive drum 1 and the surface of the developing roller 40. That is, the contacting and spacing member 42 is placed in the first position.

In the state as described above, the device waits for the instruction of the image forming operation from the main assembly.

<Operation of Each Part at the Time of Image Forming Operation>

Figure 34:
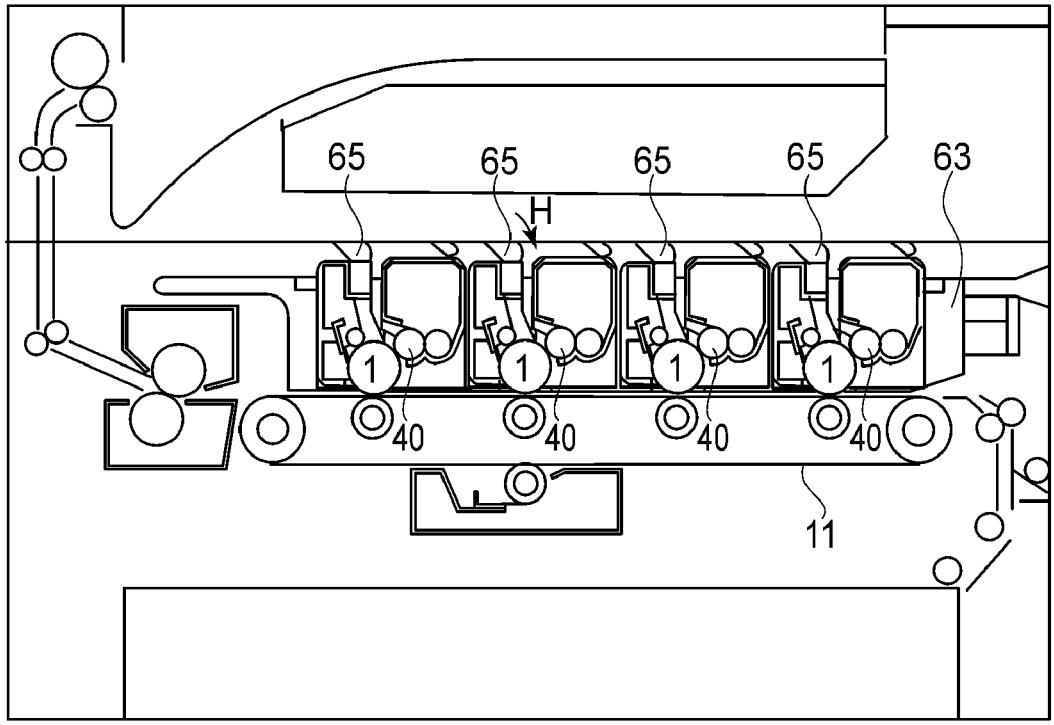
FIG. 34 is a schematic sectional view illustrating the state in the course of the shifting to the image forming operation in the image forming apparatus according to Embodiment 2 of the present invention.
Figure 32:
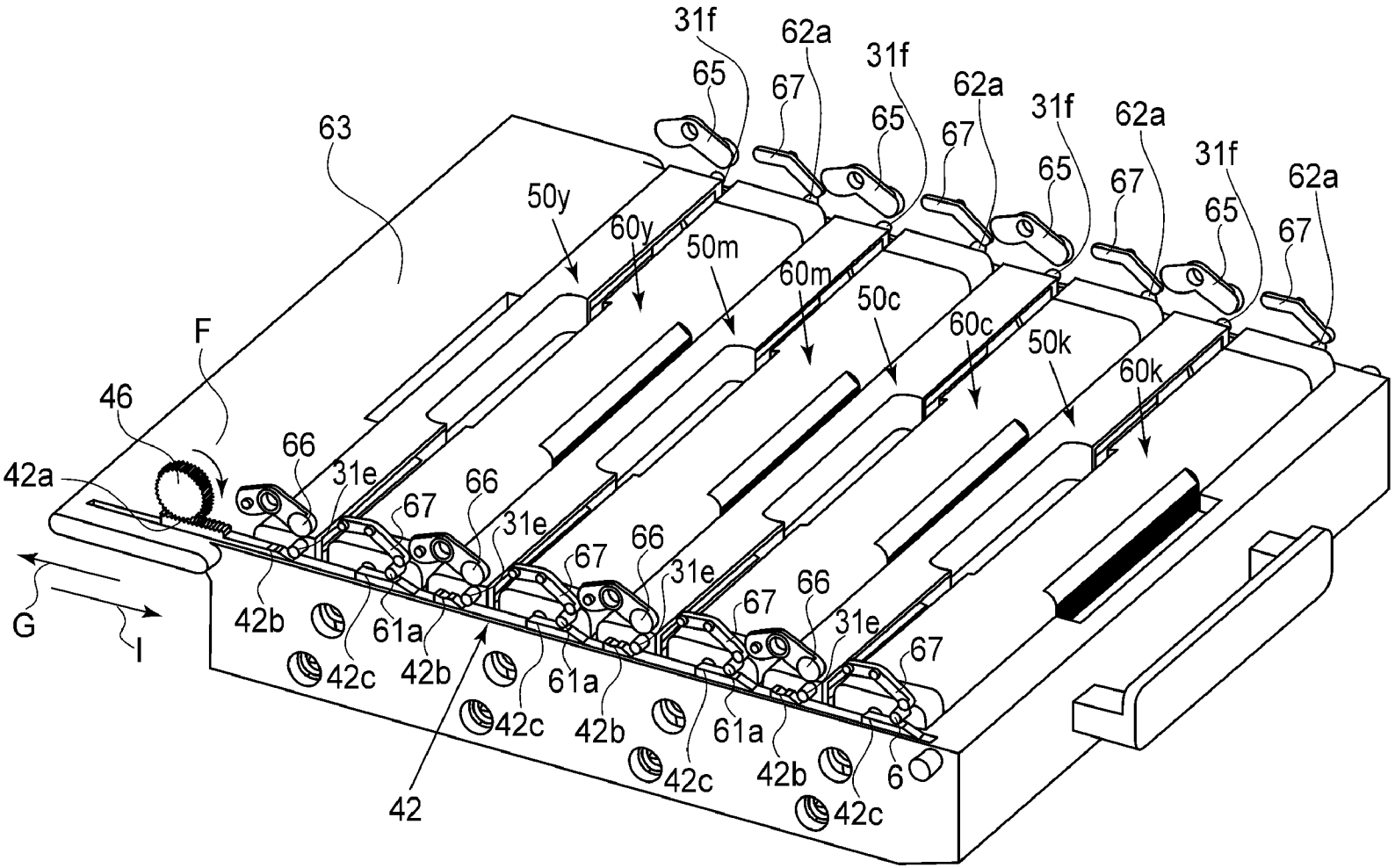
FIG. 32 is a perspective view illustrating the state immediately after the image formation instruction in the drawer unit according to Embodiment 2 of the present invention.
Figure 33:
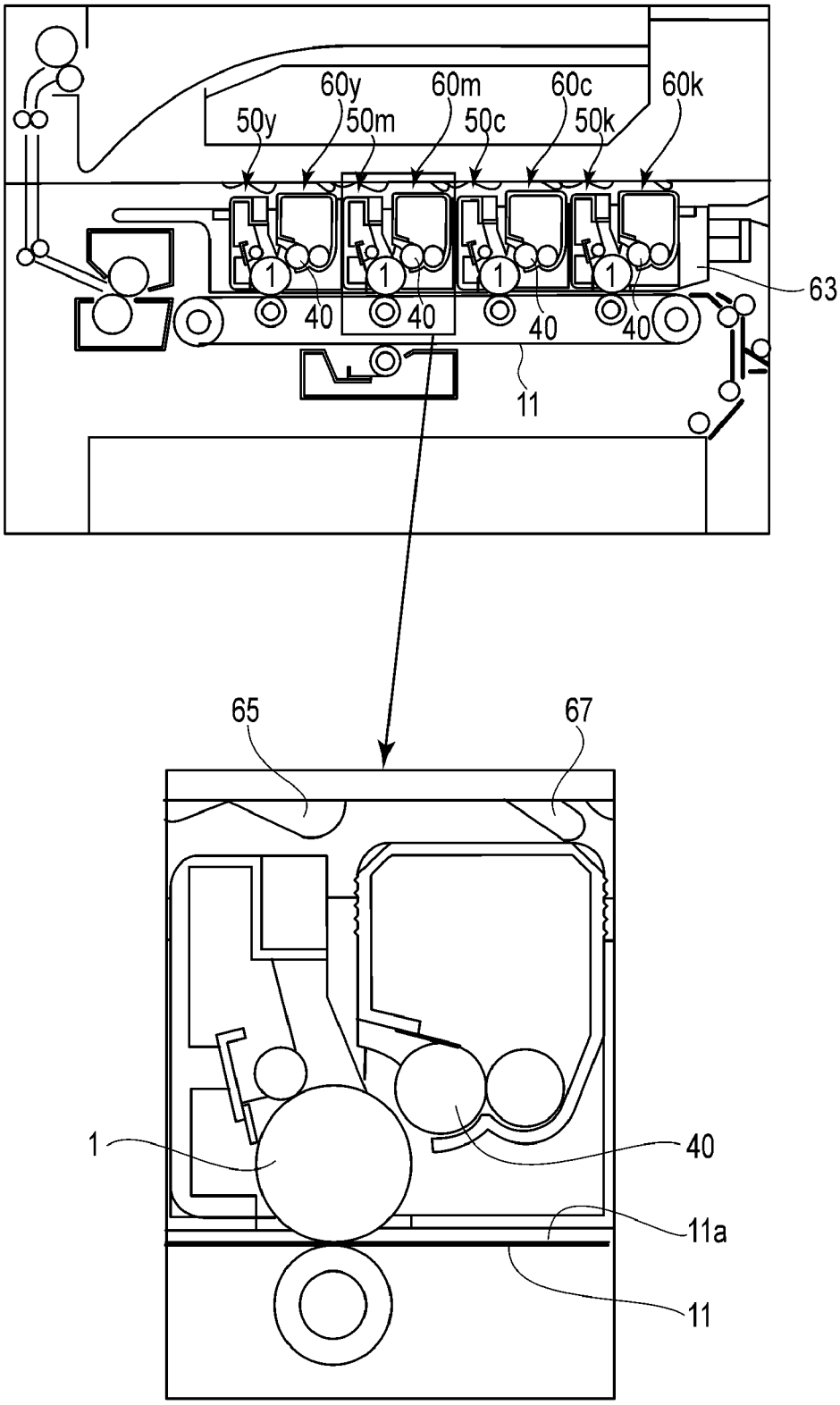
FIG. 33 is a schematic sectional view illustrating the drawer unit according to Embodiment 2 of the present invention, which is mounted in the main assembly and, and which is in the partway of shifting to the image forming operation.
Figure 35:
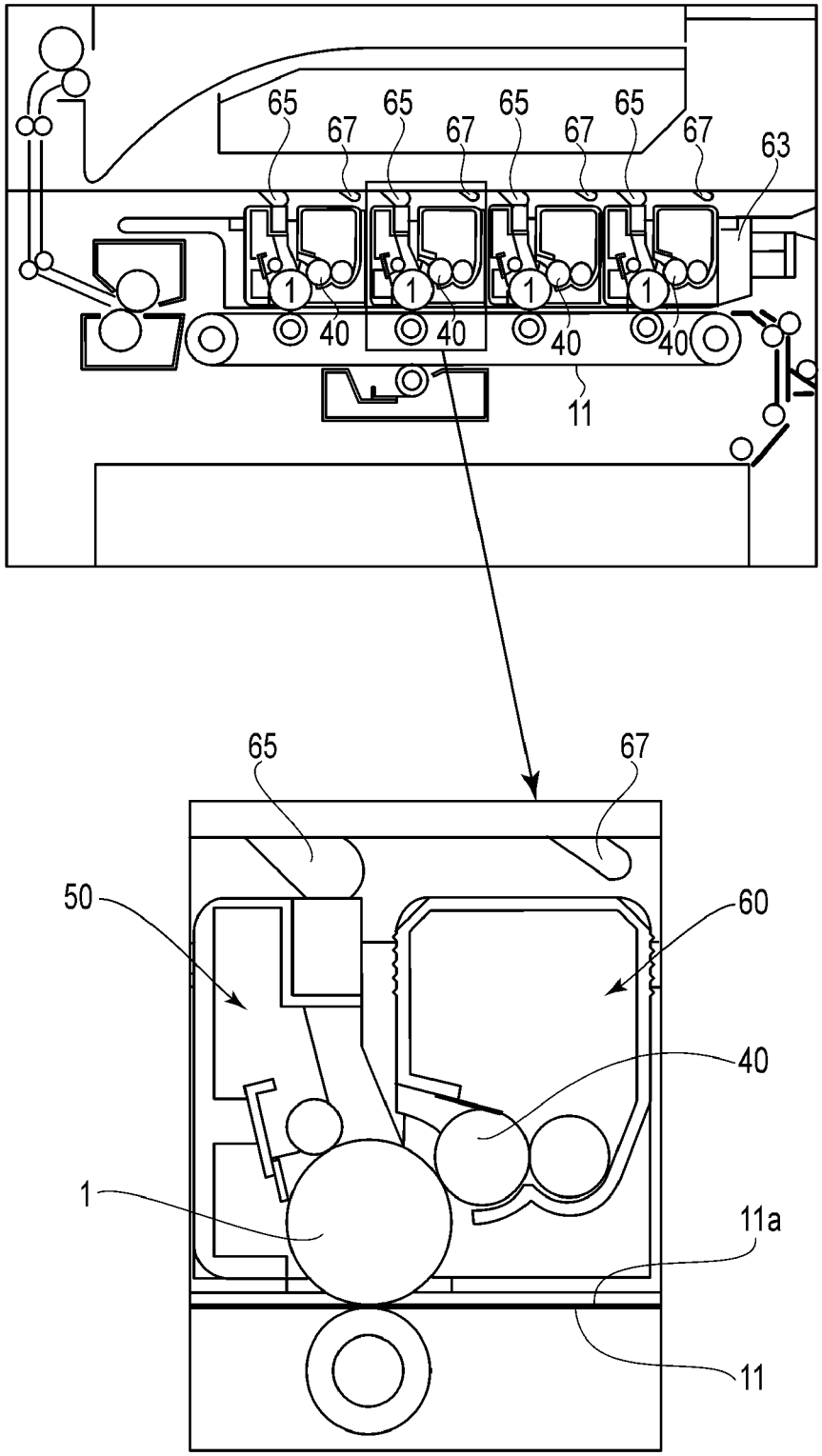
FIG. 35 is a schematic sectional view illustrating the state in the course of the shifting to the image forming operation in the image forming apparatus according to Embodiment 2 of the present invention.
Figure 36:
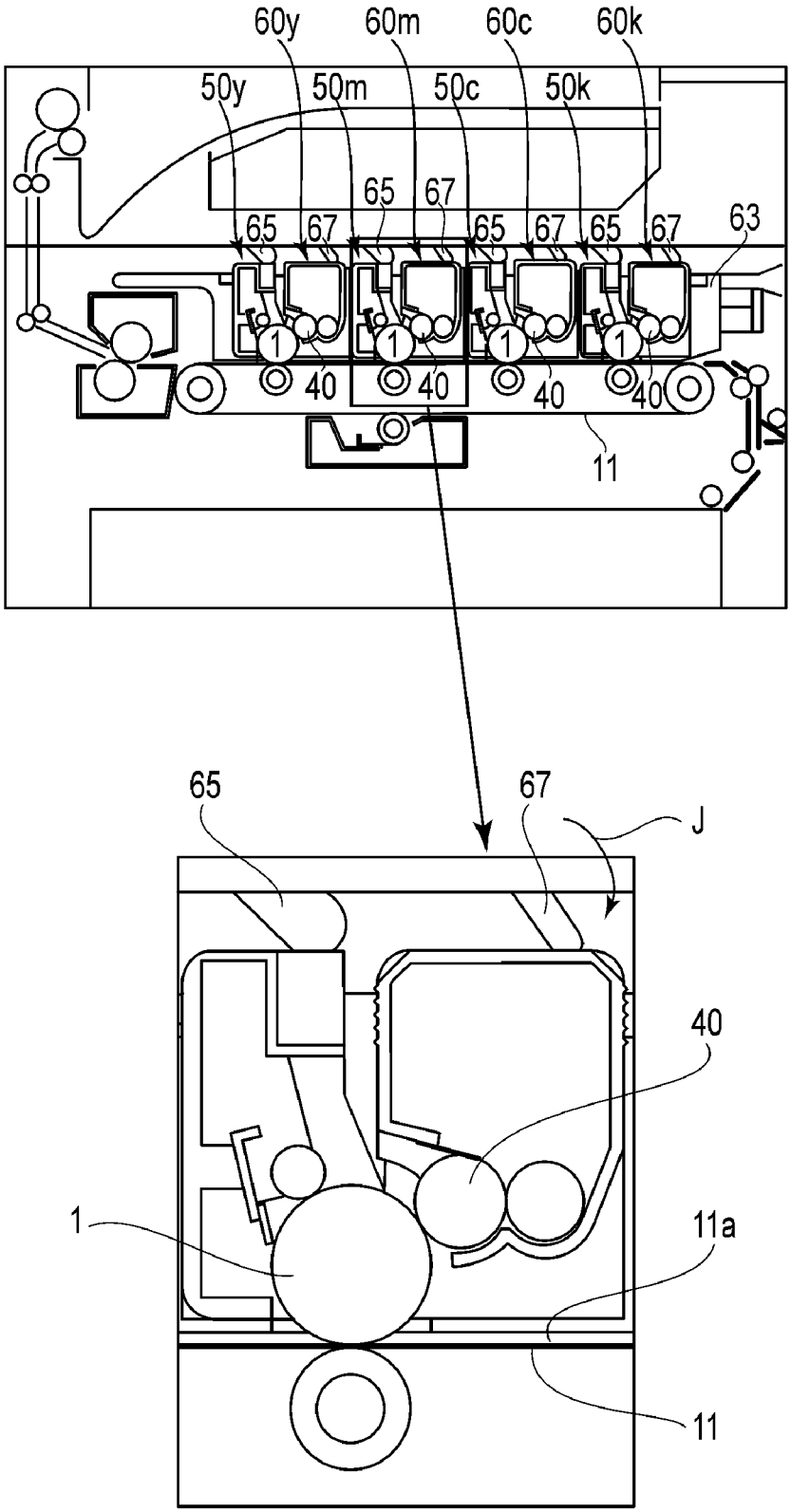
FIG. 36 is a schematic sectional view illustrating the state that the image forming operation in the image forming apparatus according to Embodiment 2 of the present invention is enabled.

Referring to FIG. 32-FIG. 36, the description will be made as to the operation of each part at the time of the image forming operation. FIG. 32 is a perspective view illustrating the state immediately after the image formation instruction in the drawer unit according to Embodiment 2 of the present invention. FIG. 33 is a schematic sectional view illustrating the state in the course of the drawer unit according to Embodiment 2 of the present invention being mounted to the inside of the main assembly, and shifting to the image forming operation. FIG. 33 includes a schematic sectional view of the whole device and a schematic enlarged cross-sectional view of the neighborhood of the one photosensitive drum. FIG. 34 is a schematic sectional view illustrating the state in the course of shifting to the image forming operation in the image forming apparatus according to Embodiment 2 of the present invention. FIG. 35 is a schematic sectional view illustrating the state in the course of shifting to the image forming operation in the image forming apparatus according to Embodiment 2 of the present invention. FIG. 35 includes a schematic sectional view of the whole device and a schematic enlarged cross-sectional view of the neighborhood the one photosensitive drum. FIG. 36 is a schematic sectional view illustrating the state that the image forming operation is enabled in the image forming apparatus according to Embodiment 2 of the present invention. FIG. 36 includes a schematic sectional view of the whole device and a schematic enlarged cross-sectional view of the neighborhood of the one photosensitive drum.

When the instruction of the image formation is produced, the driving gear 46 connected operatively with the motor (unshown) provided in the main assembly rotates in the direction of arrow F as shown in FIG. 32. Therefore, by the rack portion 42*a* in engagement with the driving gear 46, the contacting and spacing member 42 is moved in the direction of arrow G in FIG. 32. When the contacting and spacing member 42 moves to the position shown in FIG. 32, the force receiving portion 31*e* provided on the photosensitive member cartridge 50 separates from the first projection 42*b* of the contacting and spacing member 42. However, the force receiving portion 61*a* provided on the developing cartridge 60 is still placed on the second projection 42*c*. Such a mechanism is established because the second projection 42*c* is longer than the first projection 42*b* with respect to the movement direction of the contacting and spacing member 42.

FIG. 33 shows a schematic sectional view of the entirety of the device in the state of FIG. 32. As has been described hereinbefore, the force receiving portion 31*e* separates from the first projection 42*b* by the moving operation of a contacting and spacing member 42, by which the surface of the photosensitive drum 1 is contacted to the surface of the transfer belt 11. On the other hand, the force receiving portion 61*a* is still in the state of receiving the force from the second projection 42*c*, and therefore, the developing roller 40 is spaced from the surface of the photosensitive drum 1. The position in which the contacting and spacing member 42 contacts the photosensitive drum 1 to the transfer belt 11, and spaces the developing roller 40 from the photosensitive drum 1, is a second position.

As shown in FIG. 34, thereafter, the urging members 65, 66 provided in the main assembly side are driven by the unshown driving source to move in the direction of arrow H. The urging members 65, 66 contact to the force receiving portions 31*e* and 31*f* (FIG. 23) provided on the photosensitive member cartridge 50 to apply a force thereto. By this, the portion-to-be-guided 31*a* (FIG. 23) of the photosensitive member cartridge 50 contacts to a positioning portion 63*c*1 (FIG. 25) provided in the drawer member 63. The portion-to-be-guided 31*b* (FIG. 23) contacts to the positioning portions 63*d*1 (FIG. 24). Furthermore, the portions-to-be-guided 31*c* and 31*d* (FIG. 23) fitting with the guide portions 63*e* and 63*f* (FIGS. 24, 25), and, and the photosensitive member cartridge 50 is positioned in the drawer member 63.

As has been described in the foregoing, by the function of urging members 65, 66, the photosensitive member cartridge 50 is positioned in the main assembly.

Thereafter, in order to contact the developing roller 40 to the photosensitive drum 1, the driving gear 46 further rotates, and the contacting and spacing member 42 is further moved to the direction of arrow G (FIG. 32). By this, the force receiving portion 61*a* provided in the developing cartridge 60 separates from the second projection 42*c* of the contacting and spacing member 42 and does not receive the force from a second projection 42C. By this, the developing cartridge, 60 is moves downwardly with respect to the vertical direction by the weight thereof, so that the surface of the developing roller 40 and the surface of the photosensitive drum 1, contact to each other. At this time, the portions to be positioned 61*b* and 62*b* (FIG. 22) of the developing cartridge 60 and the positioning portions 63*a* and 63*b* (FIGS. 24, 25) provided in the drawer member 63 are not in contact yet to each other. FIG. 35 is a schematic sectional view illustrating the state at that time. In this state, as has been described hereinbefore, the surface of the developing roller 40 and the surface of the photosensitive drum 1 contact to each other. The position in which the contacting and spacing member 42 contacts the photosensitive drum 1 to the transfer belt 11, and contacts the developing roller 40 to the photosensitive drum 1, is a third position.

As shown in FIG. 36, thereafter, an urging member 67 provided in the main assembly is driven by the unshown driving source to move in a direction of arrow J. The urging members 67 are provided on the both side surfaces of the main assembly, and four pairs thereof are provided correspondingly to the developing cartridge 60.

The pair of urging members 67 abut to the force receiving portions 61*a* and 62*a* (FIG. 22) provided on the developing cartridge 60 to apply a force. By this, the portions to be positioned 61*b* and 62*b* (FIG. 22) of the developing cartridge 60 is pressed toward the positioning portions 63*a* and 63*b* (FIGS. 24, 25) provided in the drawer member 63. The surface of the developing roller 40 is pressed toward the surface of the photosensitive drum 1 as the fulcrum in the portions to be positioned 61*b*, 62*b*. The surface of the photosensitive drum 1 enters into the surface of the developing roller 40, and at the time of the amount of entrances reaches the predetermined level, the portions to be positioned 61*b*, 62*b* of the developing cartridge 60 and the positioning portions 63*a*, 63*b* provided on the drawer member 63 contact to each other.

As has been described in the foregoing, the developing cartridge 60 is positioned in the main assembly by the urging member 67.

When the positioning of the developing cartridge 60 is completed, the image formation is enabled in the image forming apparatus 100. In this state, the contacting and spacing member 42 is placed in the third position, wherein the photosensitive drum 1 is contacted to the transfer belt 11, and the developing roller 40 can be contacted to the photosensitive drum 1. As for the image forming operation, the description in Embodiment 1 applies.

When the image formation finishes, the urging member 67 is moved in the opposite direction (opposite direction to arrow J in FIG. 36) to the above-described pressing direction with the unshown driving source. The driving gear 46 is rotated in the direction of arrow F shown in FIG. 32 is the opposite direction, and the contacting and spacing member 42 is moved in the direction of arrow I in FIG. 32. By this, the contacting and spacing member 42 is moved to the second position, and the surface of the developing roller 40 is spaced from the surface of the photosensitive drum 1 (FIG. 34).

Thereafter, urging members 65, 66 move in the opposite direction to the above-described pressing direction, and the contacting and spacing member 42 further moves in the direction of arrow I. By this, the surface of the photosensitive drum 1 is spaced from the surface of the transfer belt 11 (FIG. 31). In this state, the device waits for the instruction of the next image formation. Or, in the case of drawing the drawer member 63, the spacing is maintained between the surface of the photosensitive drum 1 and the surface (recording material conveying surface 11*a*) of the transfer belt 11, and between the surface of the photosensitive drum 1 and the surface of the developing roller 40. That is, the contacting and spacing member 42 is placed in the first position. Therefore, in drawing the drawer member 63 to the outside of the main assembly, the damage due to the contact between the surface of the photosensitive drum 1 and the surface of the developing roller 40 by the impact at the time of the movement and so on can be suppressed. Furthermore, since this spacing can be maintained, the rubbing between these surfaces can be prevented.

As has been described in the foregoing, according to the image forming apparatus 100 according to this embodiment, the contacting and spacing member 42 is movable between the first position and the second position. By the movement of the contact member 42, the photosensitive drum 1 moves timely to the position spaced from the transfer belt 11 and the position contacted to the transfer belt 11. By this, when the image formation is not carried out, for example during the drawing operation of the drawer unit U2 (drawer member 63), the photosensitive drum 1 and the transfer belt 11 are not contacted to each other.

According to the image forming apparatus 100 according to this embodiment, the contacting and spacing member 42 is provided on the drawer member 63. Therefore, unlike the above-described conventional example, the mechanism for moving the whole drawer member toward the transfer belt surface is unnecessary in order to abut the photosensitive drum to the transfer belt. The space for permitting the movement of the whole drawer member toward the transfer belt surface is unnecessary, and therefore, the downsizing of the main assembly can be accomplished.

Furthermore, in this embodiment, the contacting and spacing member 42 is moved to the first position, the second position, and the third position timely by the driving force of the main assembly. Therefore, the user can contact and space the surface of the photosensitive drum 1, and the surface of the transfer belt 11 relative to each other, and the surface of the photosensitive drum 1 and the surface of the developing roller 40 can be contacted and spaced relative to each other without requiring the special force.

In the example of the transfer belt 11 in this embodiment, the transfer belt 11 feeds the sheet material S to the photosensitive drum 1 surface, and the developer image on the photosensitive drum 1 is directly transferred onto the sheet material S. However, the present invention is applicable to an image forming apparatus, wherein the developer image formed on the photosensitive drum is transferred, and finally it is re-transferred onto the recording material (sheet material) (intermediary transfer belt system).

In this embodiment, the contacting and spacing member 42 is provided only at the one-end portion of the drawer member 63. However, the contacting and spacing member may be similarly provided also at the other end portion of the drawer member 63. However, in this case, it is preferable that the force receiving portion for receiving the force from the contacting and spacing member is also provided at the opposite ends. If the contacting and spacing members are provided on the respective sides, the shafts of the photosensitive drum and the developing roller of the photosensitive member cartridge and the developing cartridge do not incline during the movement of the cartridges. Therefore, the spacing state between the photosensitive drum and the transfer belt and the spaced state between the photosensitive drum and the developing roller can further be stabilized.

Embodiment 3

Figure 37:
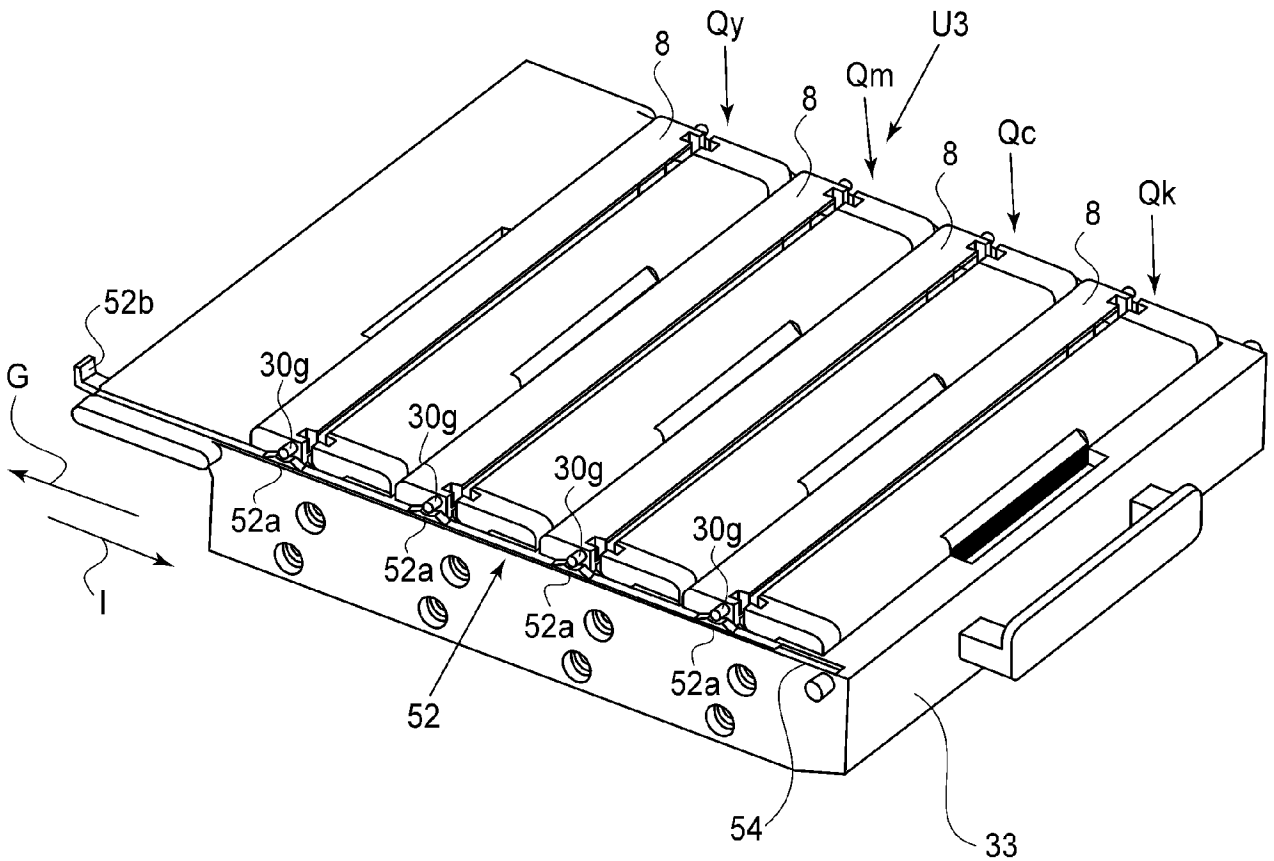
FIG. 37 is a perspective view of the drawer unit according to Embodiment 3 of the present invention.

FIG. 37-FIG. 41 illustrates Embodiment 3 of the present invention. In Embodiment 1, the contacting and spacing member 42 provided on the drawer member 13 as the supporting member is moved by the driving force from the main assembly. In this embodiment, the contacting and spacing member 52 provided on a drawer member 33 as the supporting member is moved in interrelation with the moving operation of the drawer member 33. As to the fundamental structure other than the drawer member and the contacting and spacing member, it is the same as that of the embodiment described above, and therefore the description of the structures of the same 1 is omitted. The like reference numerals as in the foregoing embodiments are assigned to the elements having the corresponding functions FIG. 37 is a perspective view of the drawer unit according to Embodiment 3 of the present invention. All the process cartridges Qy, Qm, Qc, Qk are mounted in FIG. 37. Suffix y means yellow in the process cartridges Qy, Qm, Qc, Qk, and m means magenta, c means cyan, and k means black, but they may be called process cartridge Q, for simplicity, if it is proper.

In the state, the drawer unit U3 is drawn from the main assembly, process cartridge Q is simply mounted to the drawer member 33, and the force receiving portion 30*g* provided on the photosensitive member unit 8 is in contact to a projection 52*a* provided to the contacting and spacing member 52 (FIG. 37). Similarly to Embodiment 1, therefore, process cartridge Q is held at the position higher than the image forming position.

Thus, in the state, the drawer unit U3 is drawn from the main assembly, and process cartridge Q is mounted to the drawer member 33, the contacting and spacing member 52 spaces the surface of the photosensitive drum 1 from the surface of the transfer belt 11. The position of the contacting and spacing member 52 in which the photosensitive drum 1 and the transfer belt 11 are spaced from each other is a first position.

The one-end portion of the contacting and spacing member 52 according to this embodiment is provided with a projection (force receiving portion) 52*b* which projects beyond an upper surface of the drawer member 33. The projection 52*b* is contacted to a force applying portion 53 (FIG. 38) provided in the main assembly by the position of the drawer member 33 to move the contacting and spacing member 52.

The other end portion of the contacting and spacing member 52 is provided with an urging member 54 for urging the contacting and spacing member 52 toward the one-end portion (direction of arrow G in the Figure). The drawer member 33 is provided with the unshown disengagement preventing means (stopper, for example) for preventing the contacting and spacing member 52 urged by the urging member 54 from disengagement from the drawer member 33. The contacting and spacing member 52 can be moved in the drawer member 33 by the disengagement preventing means without disengaging from the drawer member 33.

Figure 38:
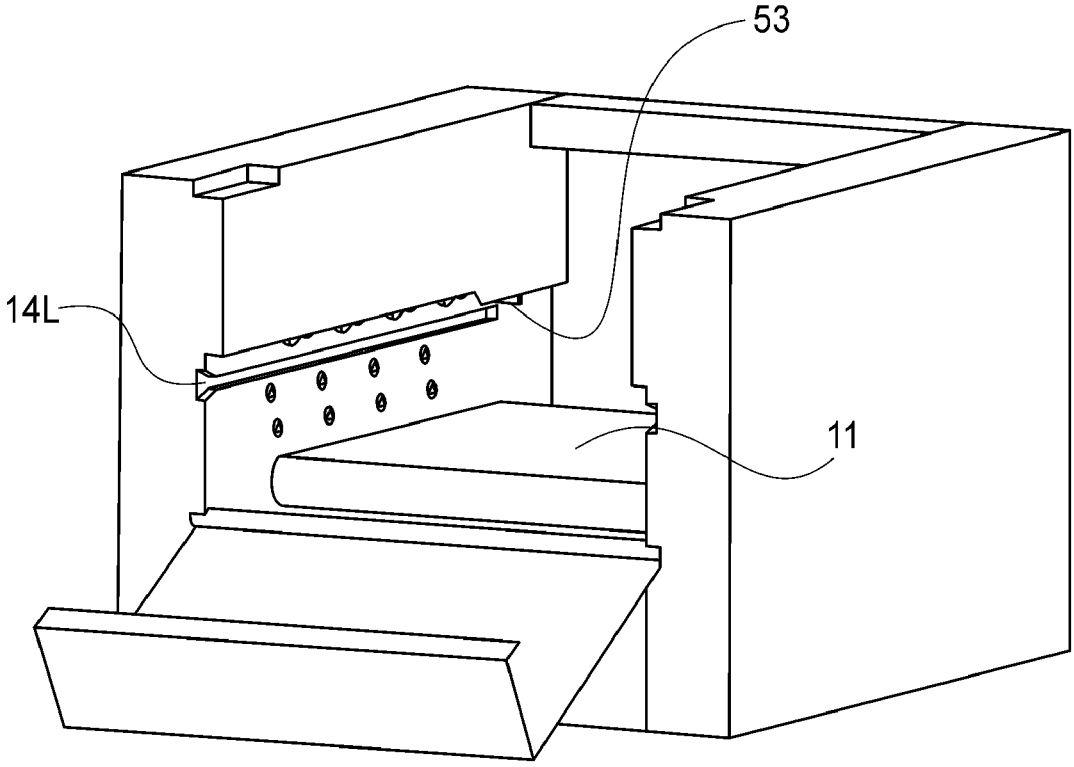
FIG. 38 is a perspective view illustrating the mounting portion for the drawer member in the main assembly of the image forming apparatus according to Embodiment 3 of the present invention.

FIG. 38 is a perspective view illustrating the mounting portion, for the drawer member, of the main assembly of the image forming apparatus according to Embodiment 3 of the present invention. In FIG. 38, the scanner unit 3 and so on is omitted among the members (parts) which constitute the main assembly s for better understanding of the structure of the mounting portion.

As illustrated, the back portion of the guide portion 14L for guiding the drawer member 33 is provided with a force applying portion 53.

Figure 39:
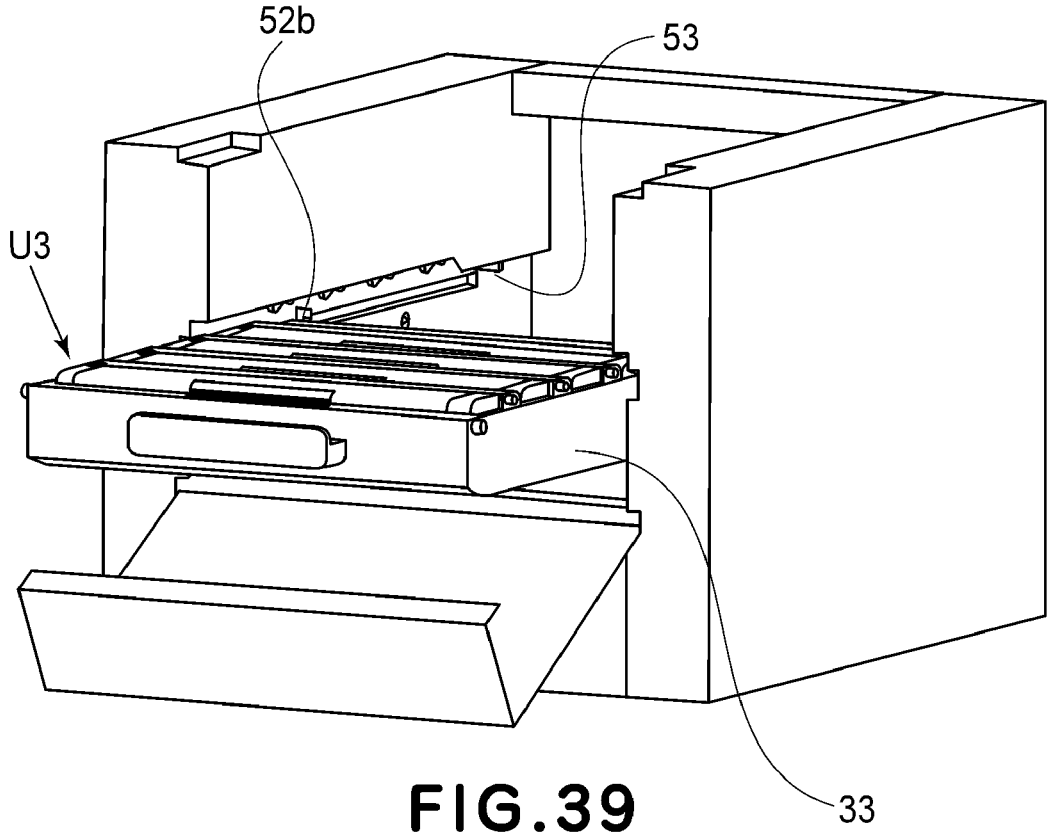
FIG. 39 is a perspective view illustrating the state that the drawer unit is drawn from the main assembly of the image forming apparatus according to Embodiment 3 of the present invention.

FIG. 39 is a perspective view illustrating the state that the drawer unit is drawn from the main assembly of the image forming apparatus according to Embodiment 3 of the present invention. In FIG. 39, the scanner unit 3 and so on is omitted among the members (parts) which constitute the main assembly s for better understanding of the drawer unit.

At the time of the exchange of process cartridge Q and so on, the drawer unit U3 is moved from the position shown in FIG. 39 to a mount position in the main assembly by a mounting operation of the user. During the mounting operation of the drawer member 33, the contacting and spacing member 52 is in the first position, and the surface of the photosensitive drum 1 and the transfer belt 11 maintain the spaced state from each other. Therefore, the drawer unit U3 can be inserted into the main assembly without the rubbing between the surface of the photosensitive drum 1 and the surface of the transfer belt 11.

Figure 40:
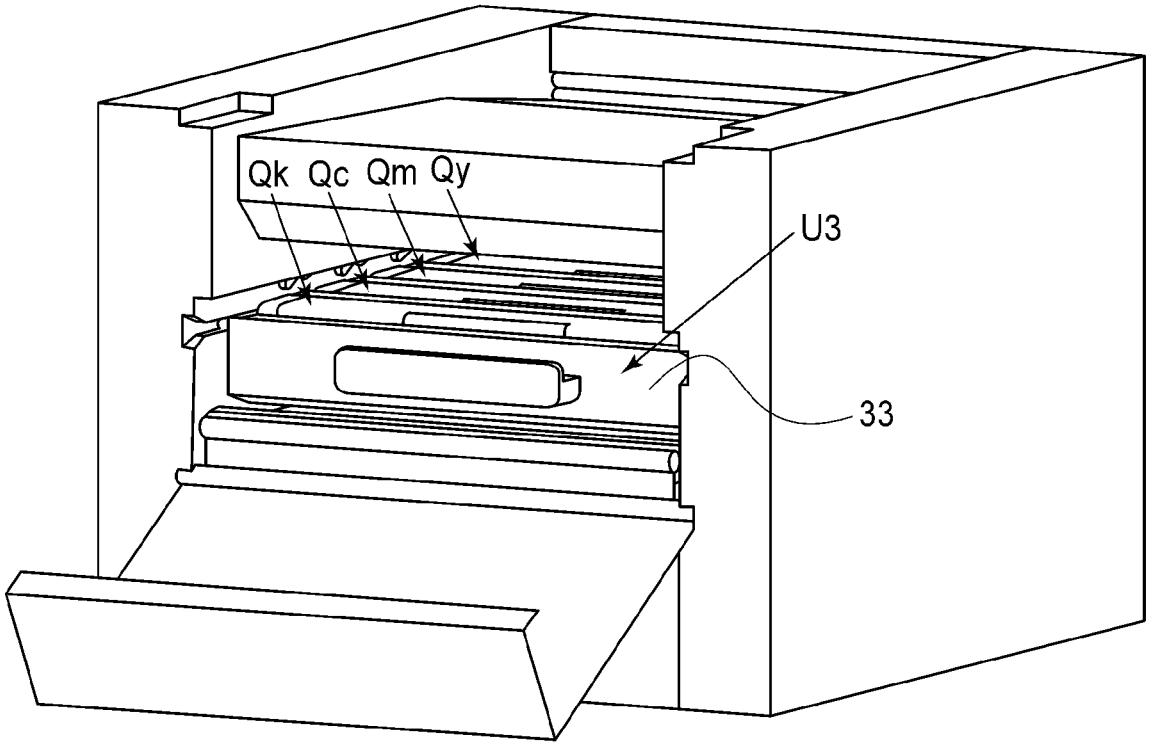
FIG. 40 is a perspective view illustrating the state that the drawer unit is mounted to the main assembly of the image forming apparatus according to Embodiment 3 of the present invention.
Figure 41:
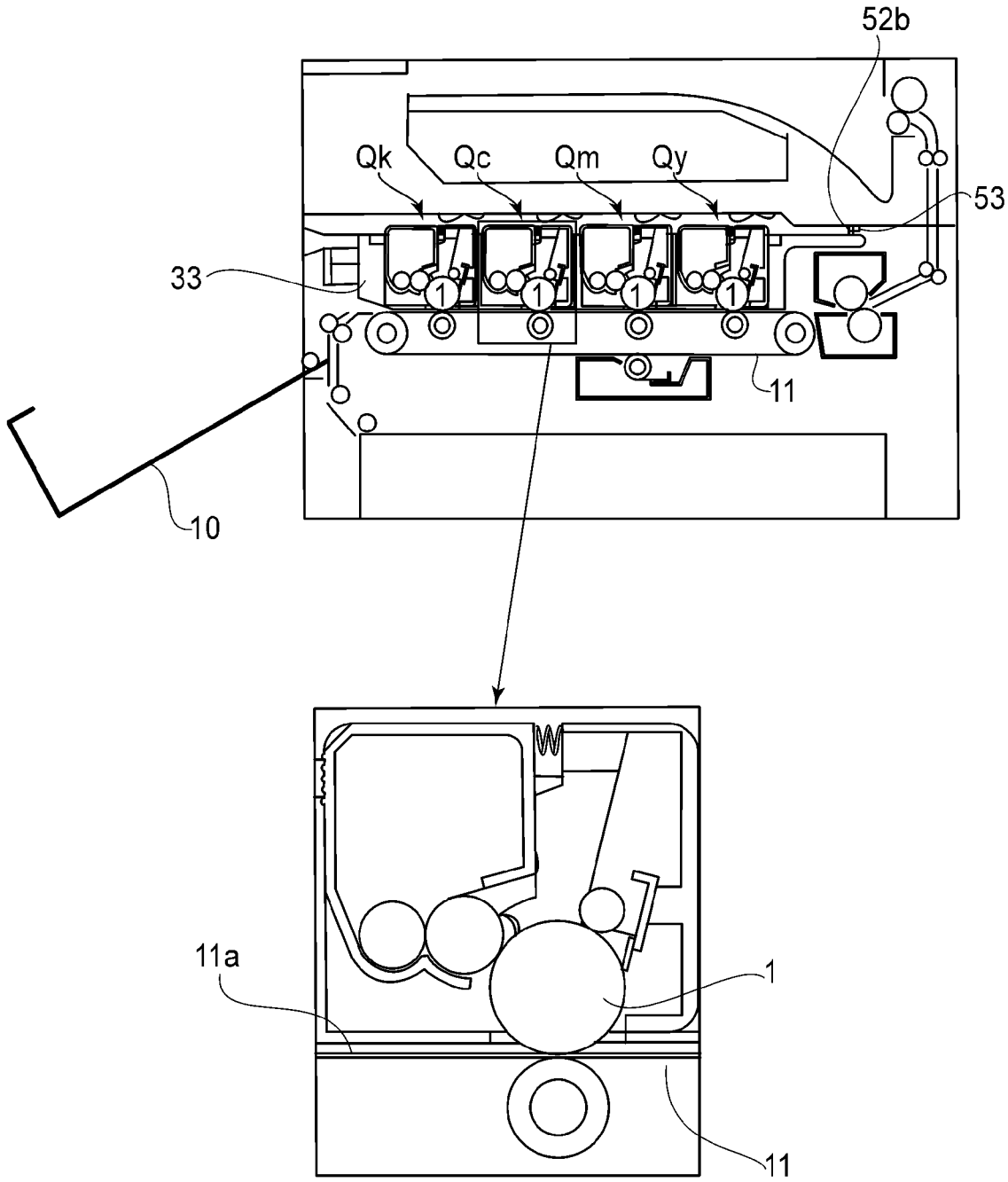
FIG. 41 is a schematic sectional view illustrating the state that the drawer unit is mounted to the main assembly of the image forming apparatus according to Embodiment 3 of the present invention.

FIG. 40 is a perspective view illustrating the state that the drawer unit is mounted to the main assembly of the image forming apparatus according to Embodiment 3 of the present invention. FIG. 41 is a schematic sectional view illustrating the state that the drawer unit is mounted to the main assembly of the image forming apparatus according to Embodiment 3 of the present invention.

In the mounting process of the drawer member 33, the projection 52*b* of the contacting and spacing member 52 abuts to the force applying portion 53 provided in the main assembly. Furthermore, by pushing in the drawer member 33 into the main assembly, the contacting and spacing member 52 receives the force from the force applying portion 53 to move in the direction of arrow I in FIG. 37 relative to the drawer member 33 against the urging force of the urging member 54. By this, the force receiving portion 30*g* separates from the projection 52*a*, by which the photosensitive member unit 8 moves downwardly by the weight, and the surface of the photosensitive drum 1 is contacted to the surface of the transfer belt 11. The position for the contacting and spacing member 52 contacting the photosensitive drum 1 to the transfer belt 11 is the second position.

FIG. 41 is a schematic sectional view illustrating the state that the drawer unit according to Embodiment 3 of the present invention is mounted in the main assembly and the door is open. FIG. 41 includes a schematic sectional view of the whole device and a schematic enlarged cross-sectional view of the neighborhood the one photosensitive drum.

As illustrated, when the drawer unit U3 (drawer member 33) is in the mount position, the contacting and spacing member 52 is placed in the second position, and the surface of the photosensitive drum 1 is contacted to the recording material conveying surface 11*a* of the transfer belt 11.

Thereafter, the image forming operation is enabled by shutting the door 10. The image forming operation is similar to Embodiment 1.

In the case of taking out process cartridge Q, the user opens the door 10 and moves the drawer member 33 in the direction of arrow I in FIG. 37. With the movement of the drawer member 33, the projection 52*b* of the contacting and spacing member 52 separates from the force applying portion 53 provided in the main assembly, and the contacting and spacing member 52 is moved in the direction of arrow G in FIG. 37 relative to the drawer member 33 by the urging force of the urging member 54.

Therefore, the projection 52*a* of the contacting and spacing member 52 contacts to the force receiving portion 30*g* of the photosensitive member unit 8 to space the surface of the photosensitive drum 1 from the surface of the transfer belt 11. More particularly, the contacting and spacing member 52 is in the first position, and in this state, the drawer member 33 can be moved to the outside position of the main assembly. Therefore, the drawer member 33 can be moved to an outside of the main assembly without the surface of the photosensitive drum 1 rubbing with the surface of the transfer belt 11.

As has been described in the foregoing, in this embodiment, the contacting and spacing member 52 provided in the drawer member 33 can be moved in interrelation with the moving operation of the drawer member 33. Therefore, as compared with Embodiment 1, the contacting and spacing member 52 can be moved from the first position to the second position by the simple structure.

Embodiment 4

FIG. 42-FIG. 47 illustrate the structures of Embodiment 4 of the present invention. In the above-described Embodiment 1, the contacting and spacing member 42 provided in the drawer member 13 as the supporting member is moved by the driving force from the main assembly. On the contrary, in this embodiment, a contacting and spacing member 55 provided in a drawer member 35 as the supporting member is moved in interrelation with an opening and closing operation of a door 34. The fundamental structures other than the structure of the drawer member and the contacting and spacing member is are the same as those of the above-described embodiments, and therefore the detailed description thereof is omitted for the sake of simplicity. For these structures, the same reference numerals are added.

Figure 42:
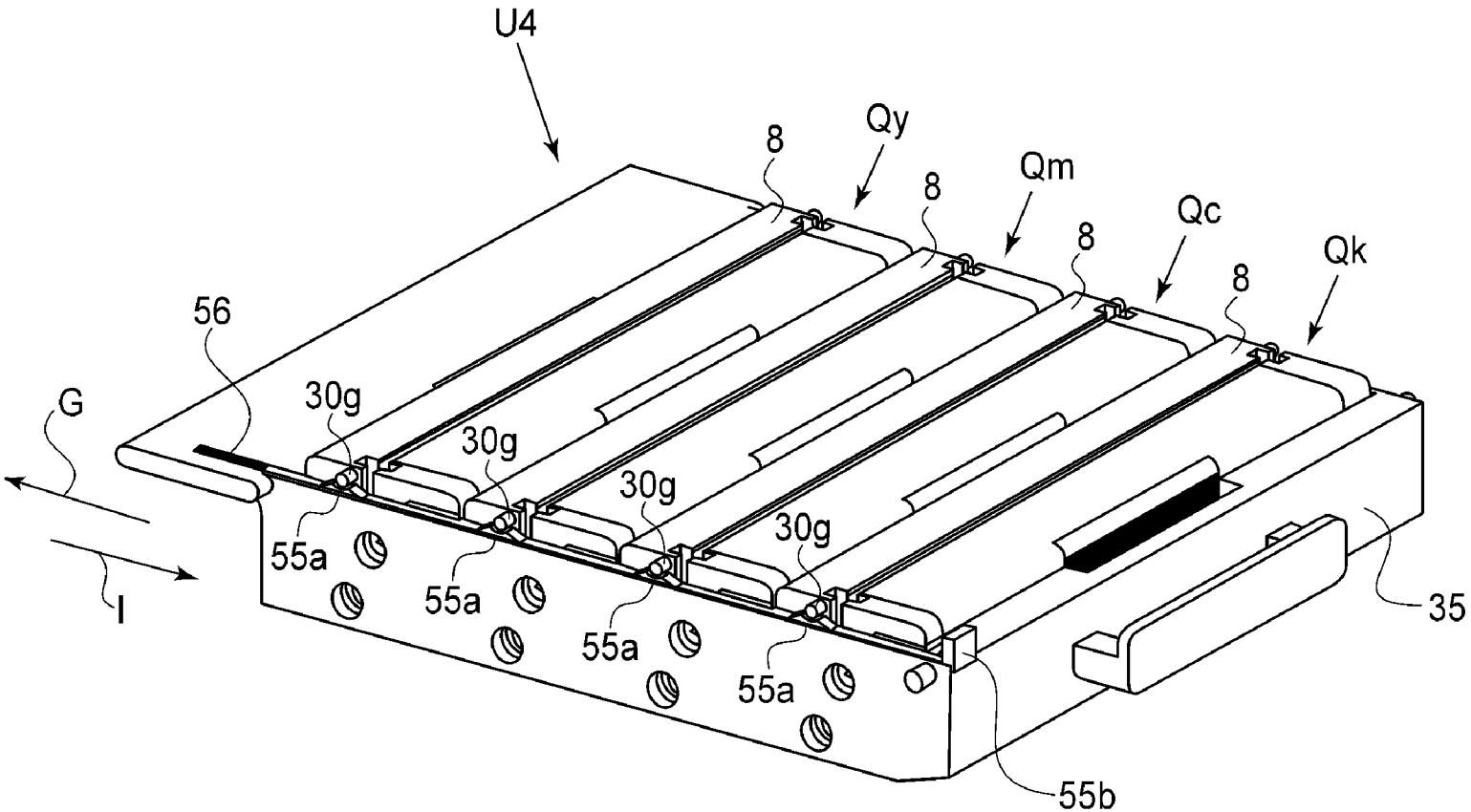
FIG. 42 is a perspective view of the drawer unit according to Embodiment 4 of the present invention.

FIG. 42 is a perspective view of the drawer unit according to Embodiment 4 of the present invention. In FIG. 42, all the process cartridges Qy, Qm, Qc, Qk are mounted. The developing units 4*y*, 4*m*, 4*c*, 4*k* may be simply called a developing unit 4 where doing so is clear, although y represents yellow; m represents magenta; c represents cyan; and k represents black.

In the state, the drawer unit U4 is drawn from the main assembly, process cartridge Q is simply mounted to the drawer member 35, and the force receiving portion 30*g* provided on the photosensitive member unit 8 is in contact with a projection 55*a* provided to the contacting and spacing member 55 (FIG. 42). Similarly to the case of Embodiment 1, therefore, the process cartridge Q is held in the position higher than the image forming position.

Thus, in the state, the drawer unit U4 is drawn from the main assembly, process cartridge Q is mounted to the drawer member 35, and the surface of the photosensitive drum 1 is separated from the surface of the transfer belt 11 by the contacting and spacing member 55. The position of the contacting and spacing member 55 for spacing the photosensitive drum 1 from the transfer belt 11 is a first position.

One-end portion of the contacting and spacing member 55 according to this embodiment is provided with the projection (force receiving portion) 55*b* projected beyond the upper surface of the drawer member 35. The projection 55*b* is contacted to a projection 34*a* as the force applying portion provided in the door 34 (FIG. 43) in response to the position of the door 34 of the main assembly, and moves the contacting and spacing member 55.

The other end portion of the contacting and spacing member 55 is provided with an urging member 56 for urging the contacting and spacing member 55 toward the direction of the one-end portion (direction of arrow I in the Figure). The drawer member 35 is provided with the unshown disengagement preventing means (stopper, for example) for preventing the contacting and spacing member 55 urged by the urging member 56 from the disengaging from the drawer member 35. The contacting and spacing member 55 can be moved in the drawer member 35 by the disengagement preventing means without disengaging from the drawer member 35.

Figure 43:
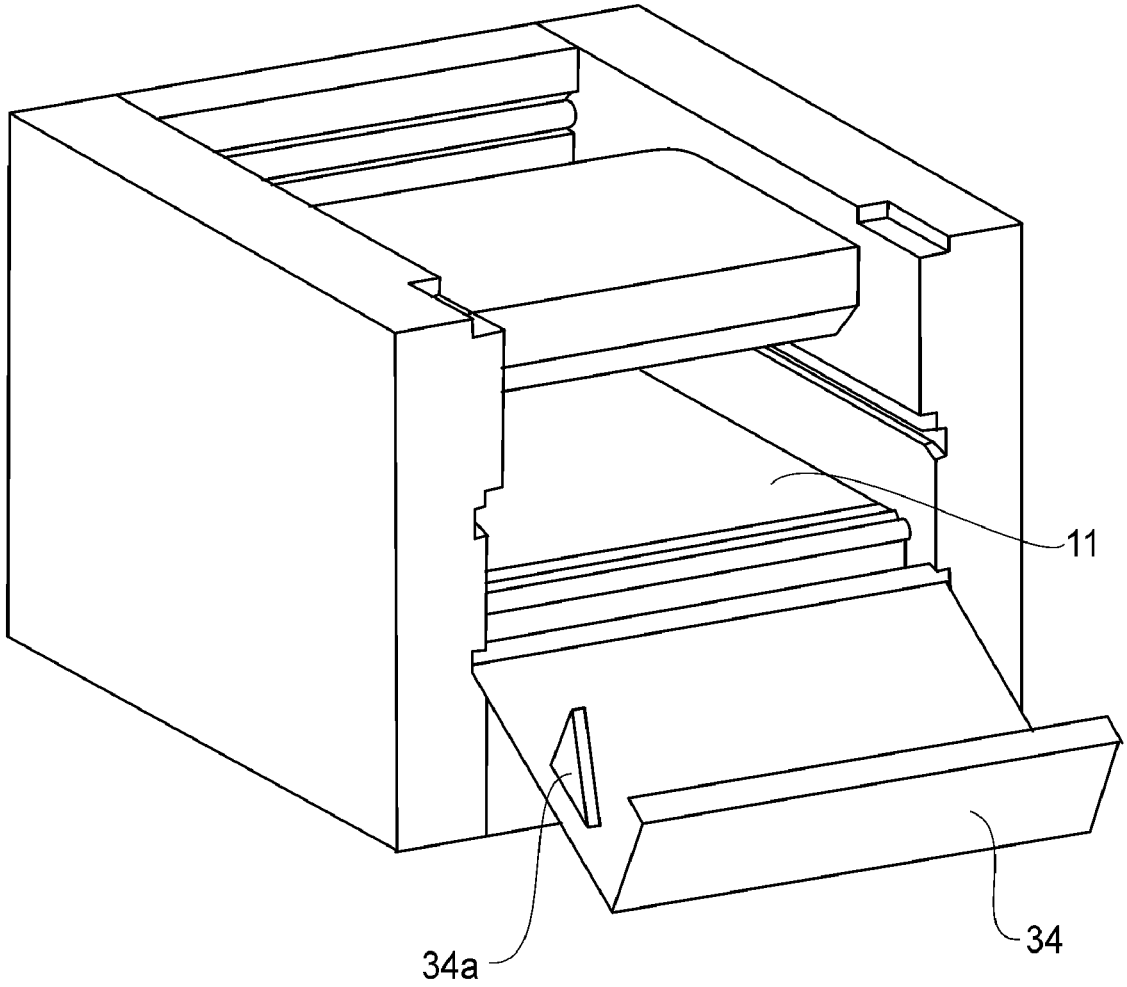
FIG. 43 is a perspective view illustrating the mounting portion for the drawer member of the main assembly of the image forming apparatus according to Embodiment 4 of the present invention.

FIG. 43 is a perspective view illustrating the mounting portion for the drawer member of the main assembly of the image forming apparatus according to Embodiment 4 of the present invention. As illustrated, the widthwise direction one side of the door 34 is provided with Projection (force applying portion) 34*a*.

Figure 44:
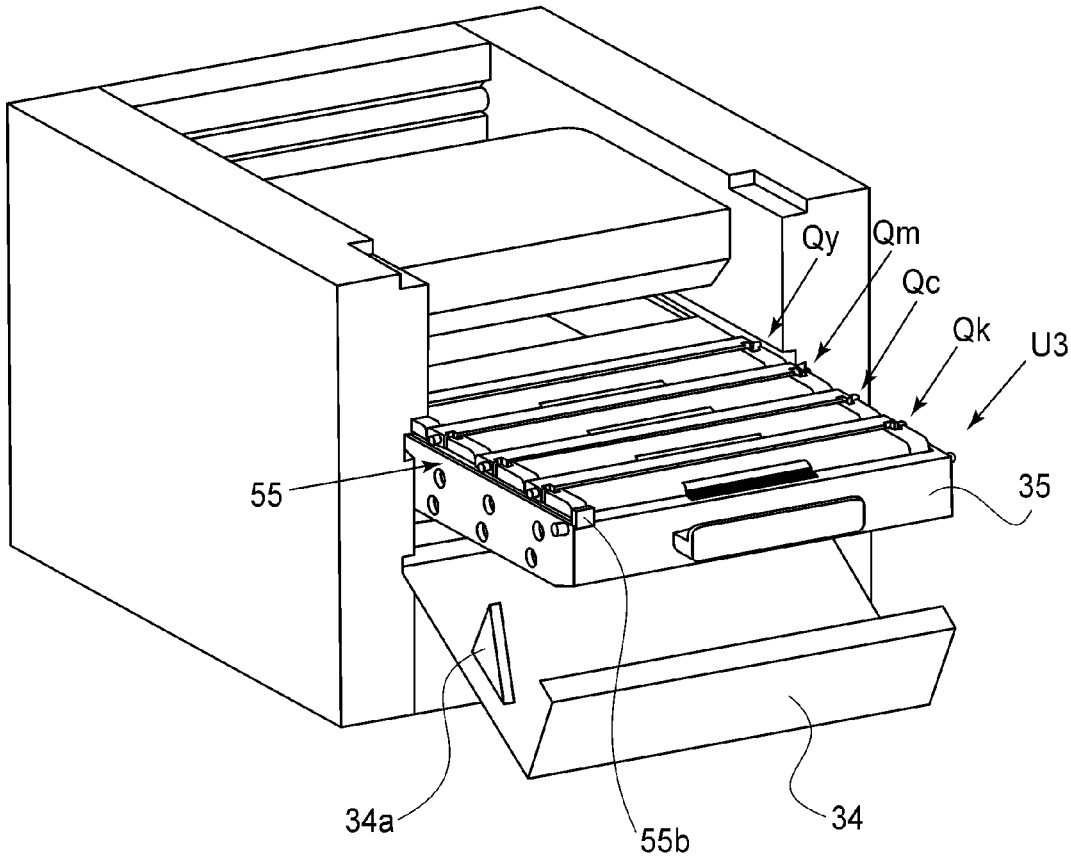
FIG. 44 is a perspective view illustrating the state that the drawer unit is drawn from the main assembly of the image forming apparatus according to Embodiment 4 of the present invention.

FIG. 44 is a perspective view illustrating the state that the drawer unit is drawn from the main assembly of the image forming apparatus according to Embodiment 4 of the present invention.

At the time of the exchange of process cartridge Q and so on, the user moves the drawer unit U4 from the position shown in FIG. 44 to the mount position in the main assembly. During the mounting operation of the drawer member 35, the contacting and spacing member 55 is in the first position, and is spaced from each other with the surface of the photosensitive drum 1 and the transfer belt 11. Therefore, the drawer unit U4 can be inserted into the main assembly without the surface of the photosensitive drum 1 rubbing on the surface of the transfer belt 11.

Figure 45:
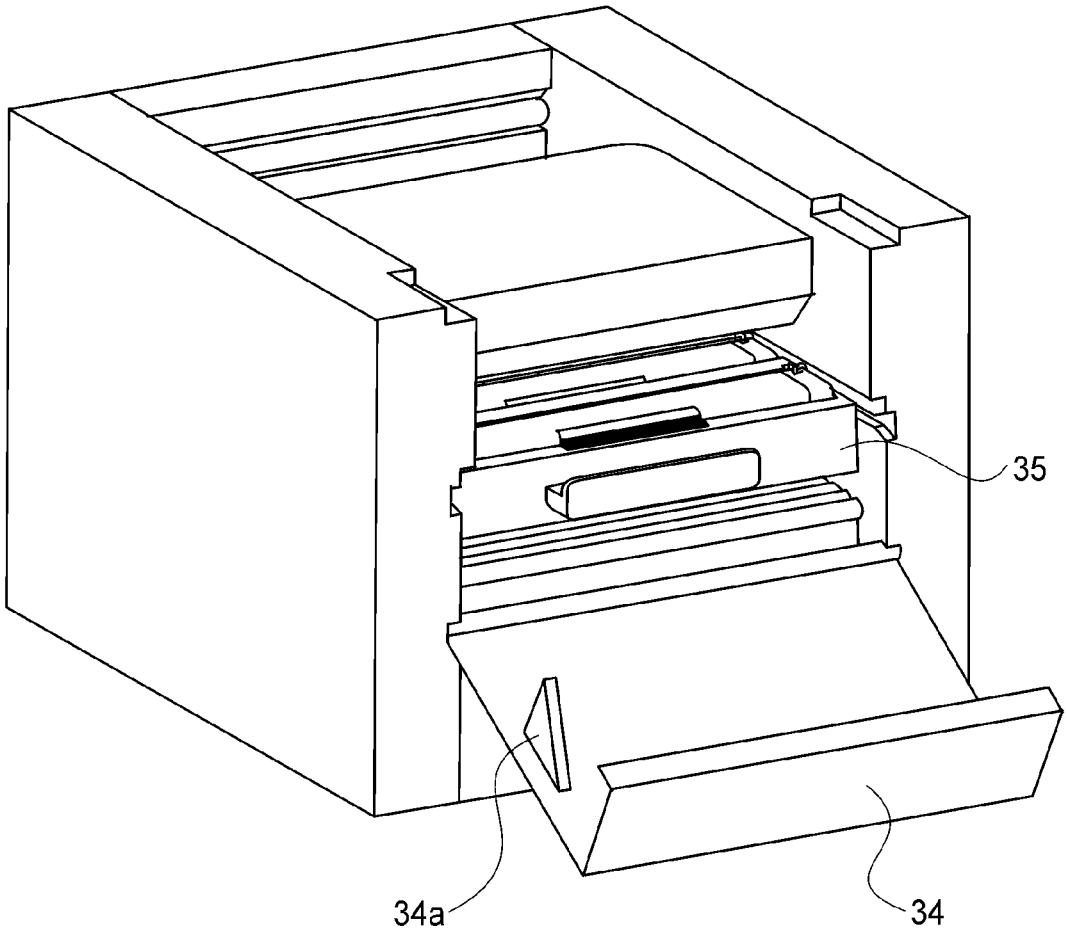
FIG. 45 is a perspective view illustrating the state that the drawer unit is mounted to the main assembly of the image forming apparatus according to Embodiment 4 of the present invention.
Figure 46:
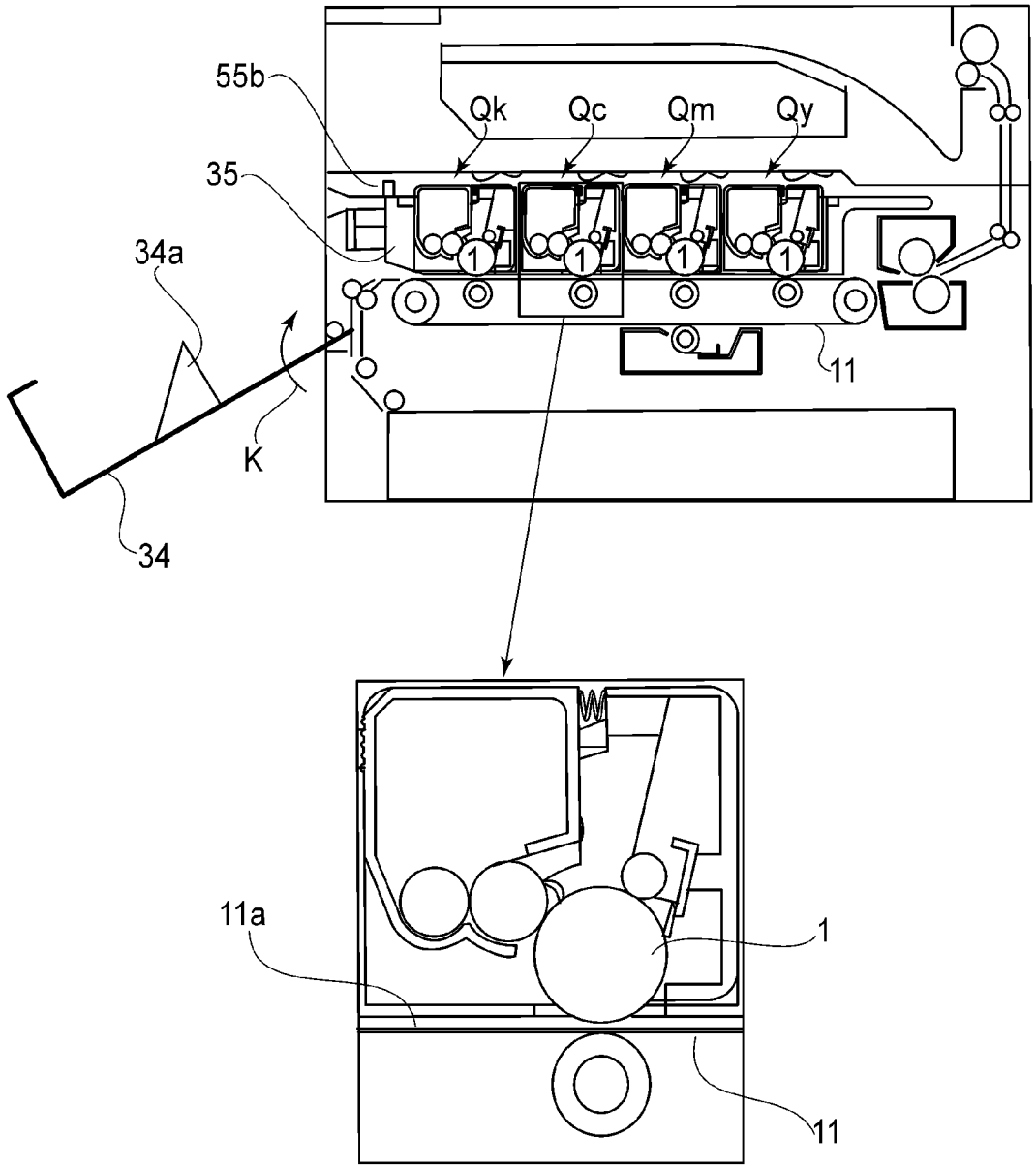
FIG. 46 is a schematic sectional view illustrating the state that the drawer unit is mounted to the main assembly of the image forming apparatus according to Embodiment 4 of the present invention.

FIG. 45 is a perspective view illustrating the state that the drawer unit is mounted to the main assembly in the image forming apparatus according to Embodiment 4 of the present invention. FIG. 46 is a schematic sectional view illustrating the state that the drawer unit is mounted to the main assembly in the image forming apparatus according to Embodiment 4 of the present invention. FIG. 46 shows a schematic sectional view of the entirety of the device and a schematic enlarged cross-sectional view of the neighborhood of one photosensitive drum. In FIGS. 45 and 46, the door 34 is open, and a part of a drawer member 35 is exposed.

By rotating the door 34 in the direction of arrow K in FIG. 46, the door 34 is closed to enable the image formation.

Here, in this embodiment, in the closing process of the door 34, the projection 34*a* as the force applying portion provided in the door 34 contacts to the projection 55*b* of the contacting and spacing member 55. Furthermore, by the door 34 being closed, the contacting and spacing member 55 receives the force from the projection 34*a* to move in the direction of arrow G in FIG. 42 relative to the drawer member 35 against the urging force of the urging member 56. By this, the force receiving portion 30*g* separates from the projection 55*a*, by which the photosensitive member unit 8 moves downwardly by the weight, so that the surface of the photosensitive drum 1 is contacted to the surface of the transfer belt 11. The position, for contacting the photosensitive drum 1 to the transfer belt 11, of the contacting and spacing member 55 is the second position. As has been described hereinbefore, although the contacting and spacing member 55 is moved in interrelation with the closing operation of the door 34, the position of the drawer member 35 is not moved.

Figure 47:
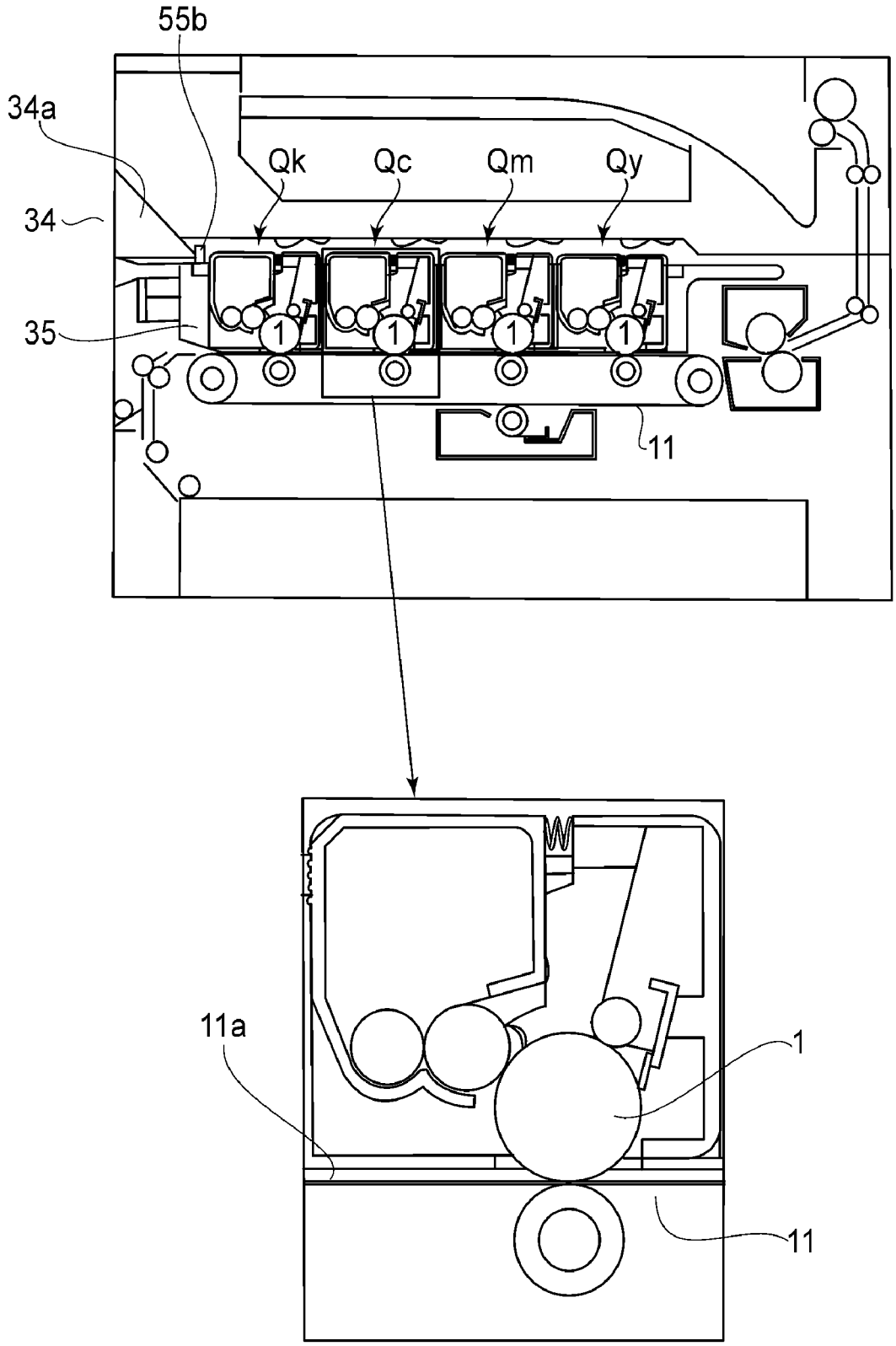
FIG. 47 is a schematic sectional view illustrating the state that the drawer unit is mounted to the main assembly of the image forming apparatus according to Embodiment 4 of the present invention and the door is closed.

FIG. 47 is a schematic sectional view illustrating the state that the drawer unit is mounted to the main assembly of the image forming apparatus according to Embodiment 4 of the present invention and the door is closed. FIG. 47 is a schematic sectional view of the entirety of the device, and a schematic enlarged cross-sectional view of the neighborhood of one photosensitive drum.

As has been described hereinbefore, when the door 34 is closed, the contacting and spacing member 55 moves to the second position to contact the photosensitive drum 1 and the transfer belt 11 to each other, thus enabling the image forming operation. The image forming operation is similar to Embodiment 1.

In taking out process cartridge Q the user opens the door 34. Then, with the opening operation of the door 34, the projection 34*a* provided on the door 34 separates from the projection 55*b* of the contacting and spacing member 55, and the contacting and spacing member 55 is moved in the direction of arrow I in FIG. 42 relative to the drawer member 35 by the urging force of the urging member 56.

Therefore, the projection 55*a* of the contacting and spacing member 55 abuts to the force receiving portion 30*g* of the photosensitive member unit 8 to separate the surface of the photosensitive drum 1 from the surface of the transfer belt 11. In other words, the contacting and spacing member 55 is positioned in the first position, and in this state, the drawer member 35 can be moved to the outside position of the main assembly. Therefore, the drawer member 35 can be moved to an outside of the apparatus main assembly without the surface of the photosensitive drum 1 rubbing with the surface of the transfer belt 11.

As has been described in the foregoing, in this embodiment, the contacting and spacing member 55 provided in the drawer member 35 can be moved in interrelation with the opening and closing operation of the door 34 of the main assembly. Therefore, as compared with Embodiment 1, the contacting and spacing member 55 can move from the first position to the second position with the simpler structure.

While the invention has been described with reference to the structures disclosed herein, it is not confined to the details set forth, and this application is intended to cover such modification or changes as may come within the purposes of the improvements or the scope of the following claims.

This application claims priority from Japanese Patent Application No. 027690/2009 filed Feb. 9, 2009 which is hereby incorporated by reference.

What is claimed is:

1. An electrophotographic image forming apparatus for forming an image on a recording medium, said apparatus comprising:

a main assembly;

a transfer member, provided inside of said main assembly, for transferring a developer image onto the recording medium; and a drawer configured to support a photosensitive member and being movable between an inside position in which said drawer is inside of said main assembly and an outside position in which said drawer is pulled out from said main assembly, wherein said drawer includes a contacting and spacing member movable, in a state that said drawer is in the inside position, between a first position for spacing the photosensitive member from said transfer member and a second position for contacting the photosensitive member to said transfer member.

2. An apparatus according to claim 1, wherein said contacting and spacing member includes a driving force receiving portion for receiving a driving force from said main assembly for moving between the first position and the second position.

3. An apparatus according to the claim 1, wherein said contacting and spacing member is configured to take the first position when said drawer is in the outside position.

4. An apparatus according to claim 1, wherein said main assembly includes a force applying portion for applying a force to said contacting and spacing member to contact the photosensitive member and said transfer member to each other, when said drawer is in the inside position, said contacting and spacing member being moved to the second position from the first position by said force applying portion applying a force to said contacting and spacing member to contact the photosensitive member and said transfer member to each other.

5. An apparatus according to claim 4, wherein said force applying portion applies the force to said contacting and spacing member by said drawer moving to the inside position from the outside position.

6. An apparatus according to claim 4, wherein said main assembly is provided with a door for opening and closing an opening when the drawer moves between the outside position and the inside position, said force applying portion applying the force to said contacting and spacing member by the door being closed in the state that said drawer is in the inside position.

7. An apparatus according to claim 6, wherein said force applying portion is provided on the door.

8. An apparatus according to claim 4, wherein said drawer is provided with an urging member for urging said contacting and spacing member to the first position from the second position, wherein said force applying portion moves said contacting and spacing member from the first position to the second position against an urging force of said urging member.

9. An apparatus according to claim 1, wherein said drawer supports a developing roller for forming a developer image by depositing developer onto a latent image formed on the photosensitive member, both when said contacting and spacing member is in the first position and when said contacting and spacing member is in the second position the developing roller is spaced by said contacting and spacing member from the photosensitive member, said contacting and spacing member being movable to a third position for contacting the photosensitive member to said transfer member and for contacting the developing roller to the photosensitive member.

10. An apparatus according to claim 1, further comprising a cartridge detachably mountable to said drawer.

11. An apparatus according to claim 10, wherein said cartridge includes a developing roller for developing a latent image formed on the photosensitive member.

12. An apparatus according to claim 10, wherein said cartridge includes the photosensitive member.

13. An apparatus according to claim 10, wherein said cartridge includes the photosensitive member and a developing roller for developing a latent image formed on the photosensitive member.

14. An apparatus according to claim 1, wherein said transfer member is configured and positioned to transfer a developer image from the photosensitive member onto the recording medium.

15. An apparatus according to claim 1, wherein said transfer member is configured and positioned to transfer the developer image from the photosensitive member onto said transfer member and then transfer the developer image from said transfer member onto the recording medium.

* * * * *